US010551103B2

(12) United States Patent
Cheong et al.

(10) Patent No.: US 10,551,103 B2
(45) Date of Patent: Feb. 4, 2020

(54) COOLING DEVICE AND METHOD FOR CONTROLLING SAME

(71) Applicant: SAMSUNG ELECTRONICS CO., LTD., Suwon-si (KR)

(72) Inventors: Young Min Cheong, Seoul (KR); Ki Yong Song, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 355 days.

(21) Appl. No.: 15/326,901

(22) PCT Filed: Jan. 20, 2015

(86) PCT No.: PCT/KR2015/000566
§ 371 (c)(1),
(2) Date: Jan. 17, 2017

(87) PCT Pub. No.: WO2016/010220
PCT Pub. Date: Jan. 21, 2016

(65) Prior Publication Data

US 2017/0205125 A1 Jul. 20, 2017

(30) Foreign Application Priority Data

Jul. 18, 2014 (KR) ..... 10-2014-0090949

(51) Int. Cl.

| | |
|---|---|
| ***F25B 47/02*** | (2006.01) |
| ***F28F 9/02*** | (2006.01) |
| ***F25B 49/02*** | (2006.01) |
| ***F28F 1/10*** | (2006.01) |

(52) U.S. Cl.
CPC ..... *F25B 47/02* (2013.01); *F25B 49/02* (2013.01); *F28F 1/10* (2013.01); *F28F 9/02* (2013.01)

(58) Field of Classification Search
CPC ..... F25B 47/02; F25B 2400/01; F28F 1/10; F28F 2009/0285; F28D 1/05366; F28D 2021/0068
See application file for complete search history.

(56) References Cited

U.S. PATENT DOCUMENTS

| | | | | |
|---|---|---|---|---|
| 5,995,711 | A | 11/1999 | Fukuoka et al. | |
| 6,078,024 | A | 6/2000 | Inoue et al. | |
| 2010/0288752 | A1* | 11/2010 | Lee | H05B 3/24 219/544 |

(Continued)

FOREIGN PATENT DOCUMENTS

| | | |
|---|---|---|
| CN | 101999063 | 3/2011 |
| CN | 103868310 | 6/2014 |

(Continued)

OTHER PUBLICATIONS

Extended European Search Report dated Dec. 11, 2017 in European Patent Application No. 15822588.8.

(Continued)

*Primary Examiner* — Ana M Vazquez
(74) *Attorney, Agent, or Firm* — Staas & Halsey LLP

(57) ABSTRACT

Disclosed herein are a cooling device and method of controlling the same. Cooling device includes a plurality of refrigerant pipes including a polymer material and a power source configured to supply heating power for self-heating of the refrigerant pipes to the refrigerant pipes.

19 Claims, 37 Drawing Sheets

(56) References Cited

U.S. PATENT DOCUMENTS

| | | | | |
|---|---|---|---|---|
| 2013/0025826 | A1* | 1/2013 | Sakamoto | F28D 15/0266 165/104.21 |
| 2014/0262183 | A1* | 9/2014 | Zafiris | F28F 21/062 165/173 |

FOREIGN PATENT DOCUMENTS

| | | | | |
|---|---|---|---|---|
| DE | 19823457 | | 12/1998 | |
| EP | 2284459 | | 2/2011 | |
| EP | 2284459 | A1 * | 2/2011 | F25B 41/04 |
| EP | 2741032 | | 6/2014 | |
| KR | 2001-0017166 | | 3/2001 | |
| KR | 2003-0030762 | | 4/2003 | |
| KR | 10-2008-0088841 | | 10/2008 | |
| KR | 10-2009-0072677 | | 7/2009 | |
| KR | 10-2010-0119958 | | 11/2010 | |
| KR | 10-2014-0074653 | | 6/2014 | |
| KR | 20140074653 | A * | 6/2014 | F25D 21/002 |

OTHER PUBLICATIONS

International Search Report dated Apr. 29, 2015 in corresponding International Application No. PCT/KR2015/000566.

Chinese Office Action dated Feb. 2, 2019 in corresponding Chinese Patent Application No. 201580050483.9 (6 pages).

Chinese Notification of the Decision to Grant a Patent Right for Patent for Invention dated Sep. 23, 2019 in related Chinese Application No. 201580050483.9.

* cited by examiner

[Fig. 1]
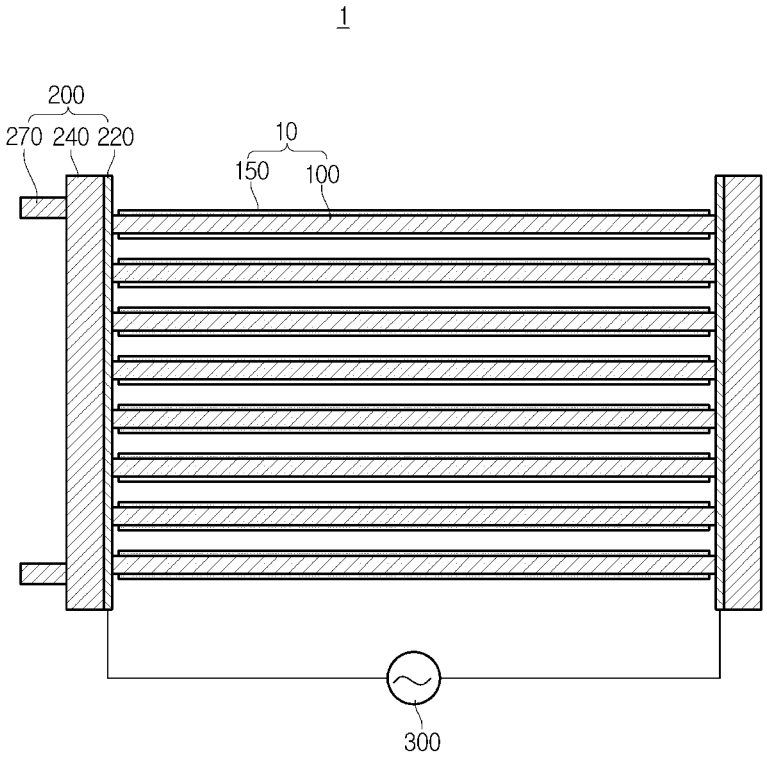

[Fig. 2]
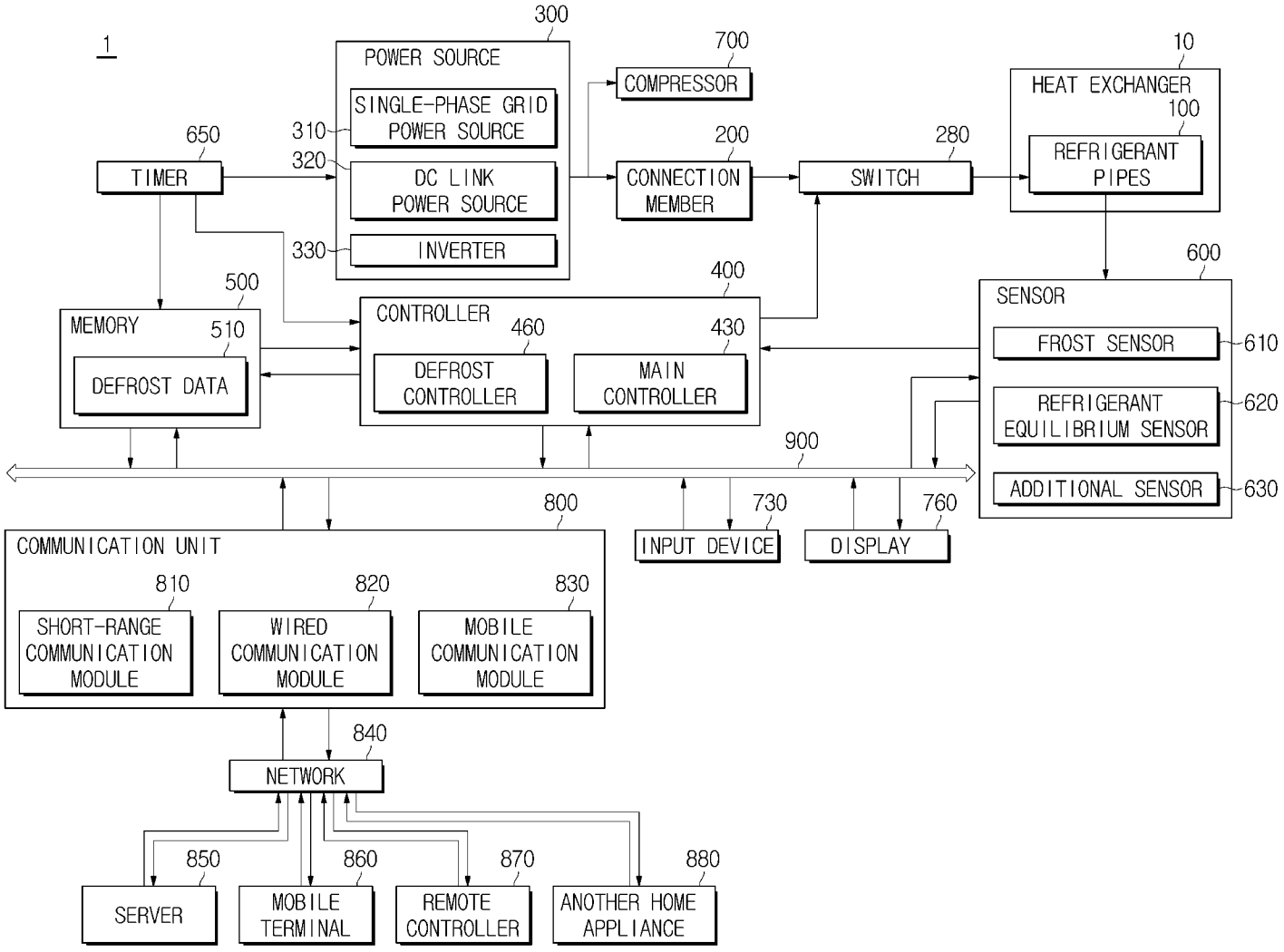

[Fig. 3]
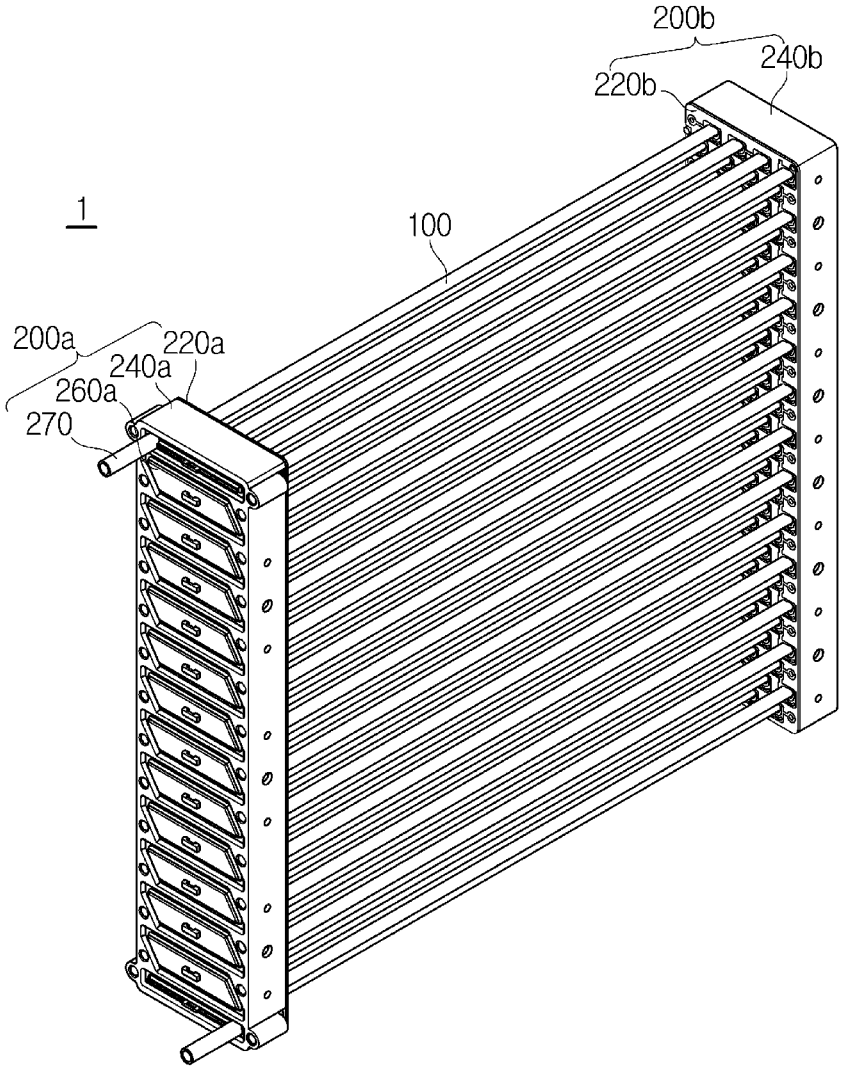
[Fig. 4]
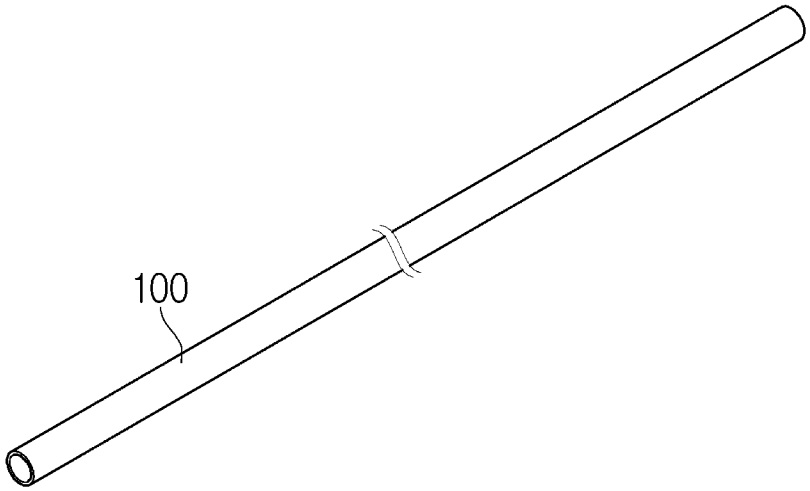

[Fig. 5a]
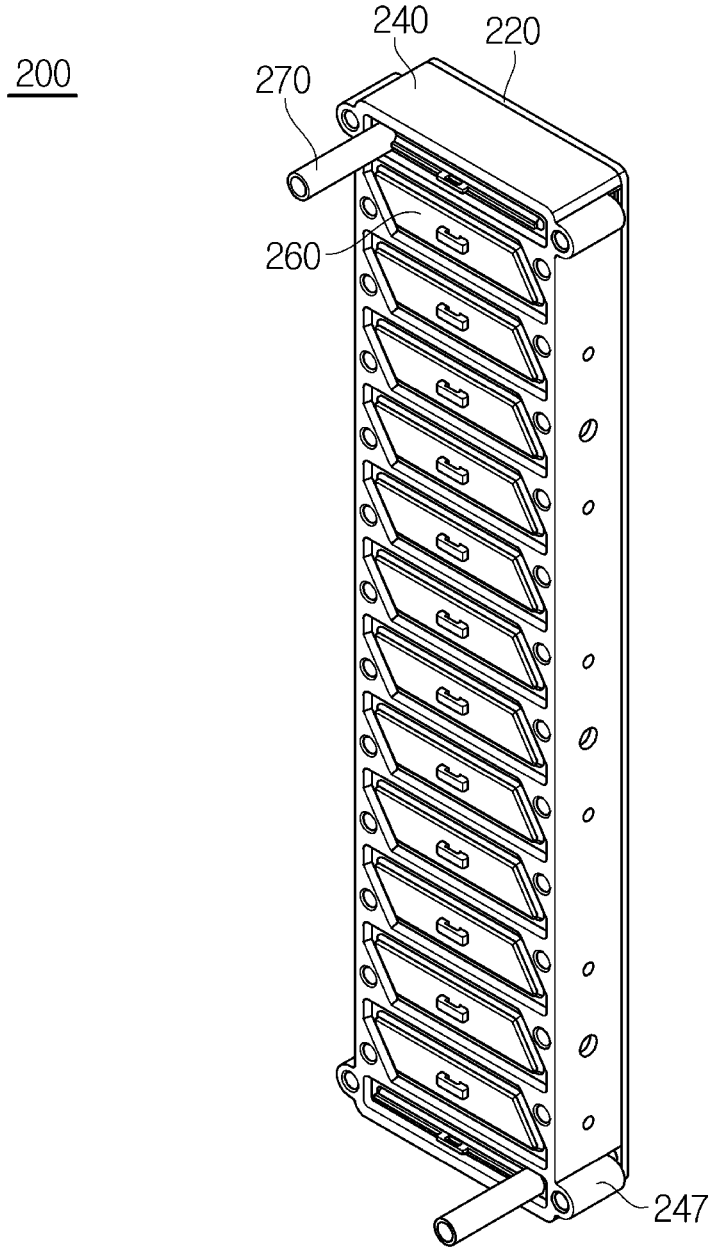

[Fig. 5b]
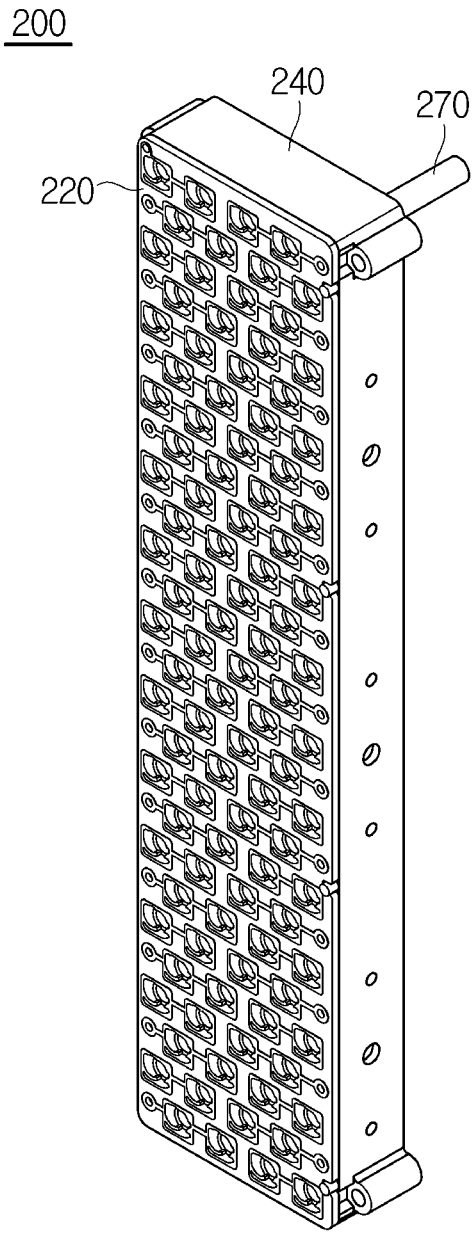

[Fig. 6a]
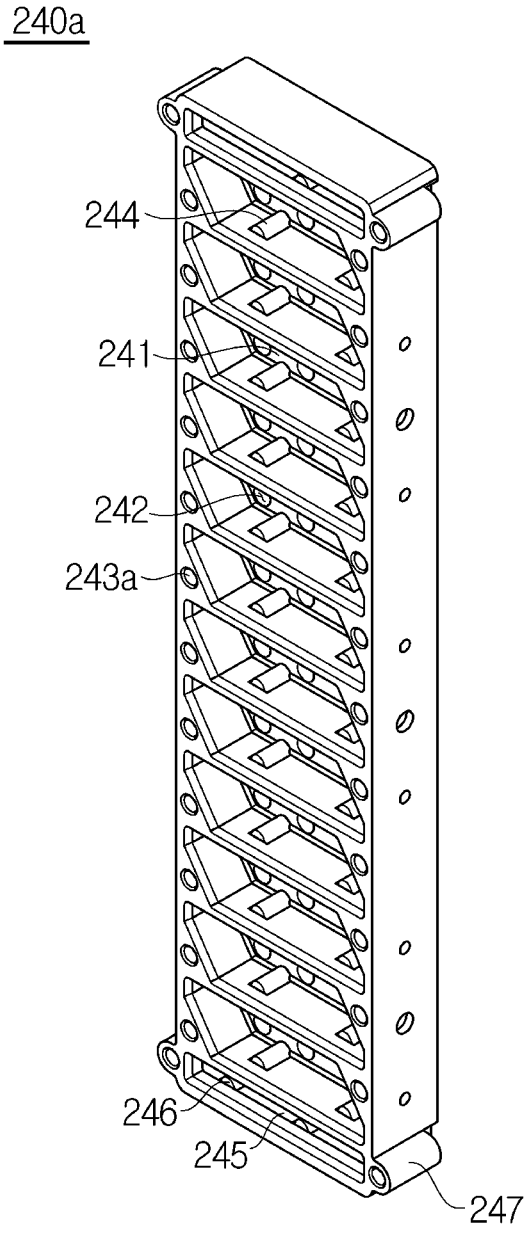

[Fig. 6b]
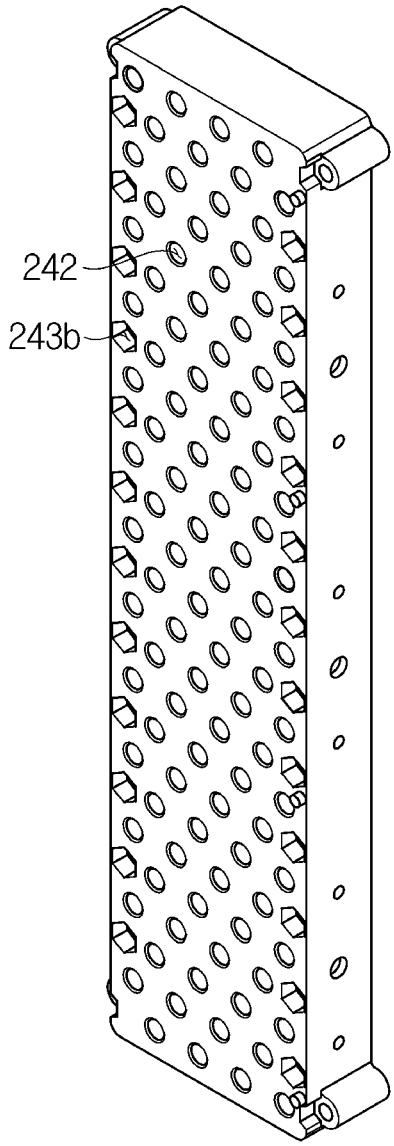

[Fig. 6c]
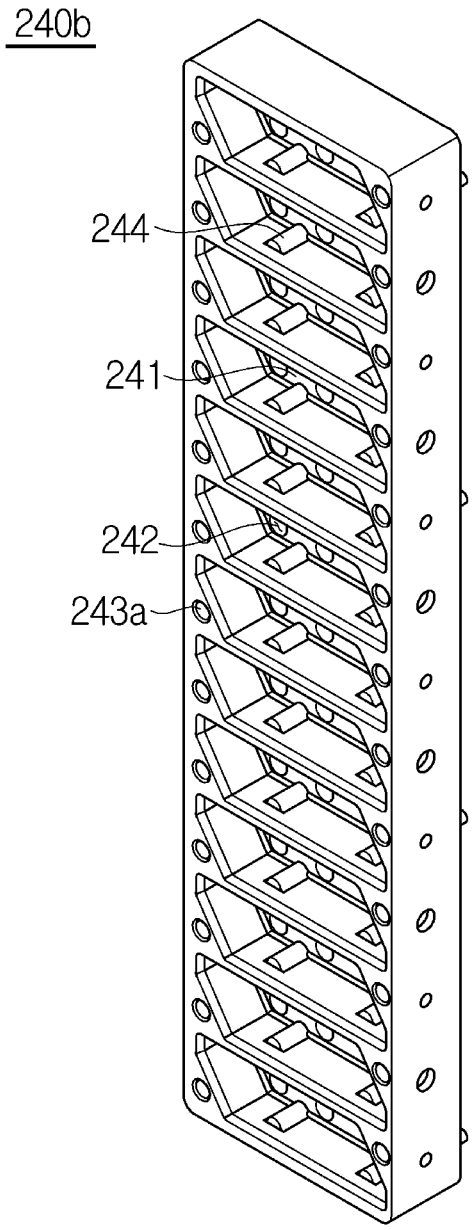

[Fig. 6d]
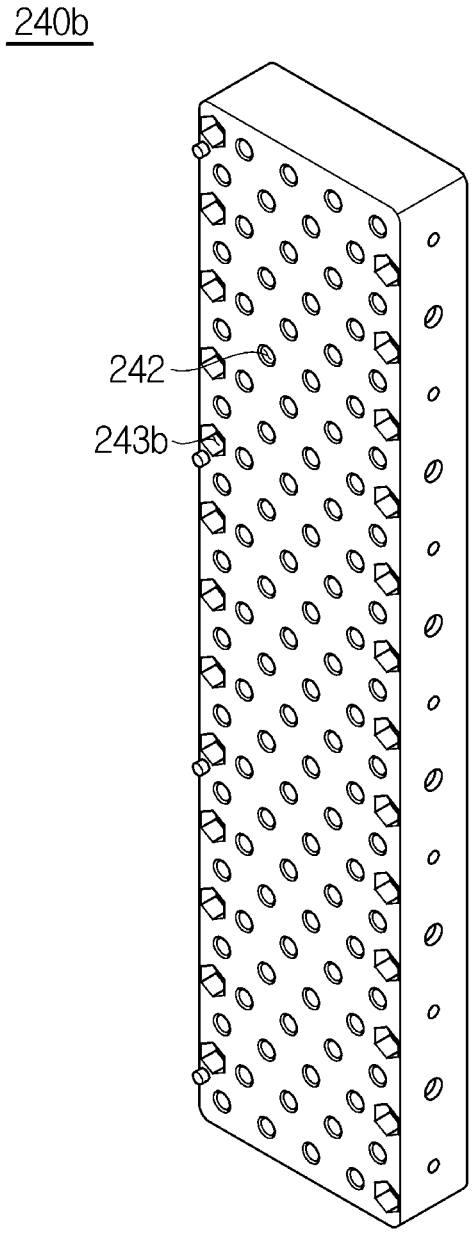

[Fig. 7a]
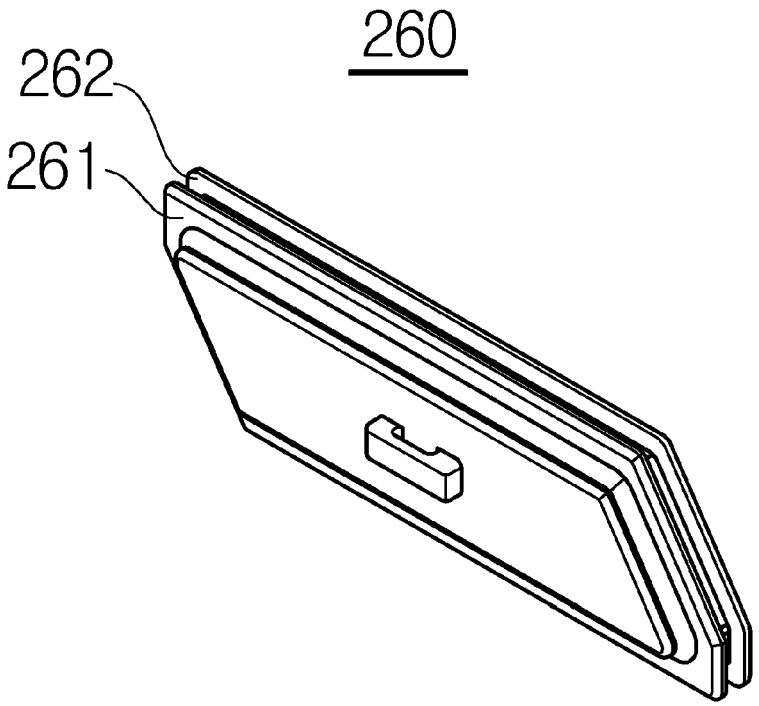
[Fig. 7b]
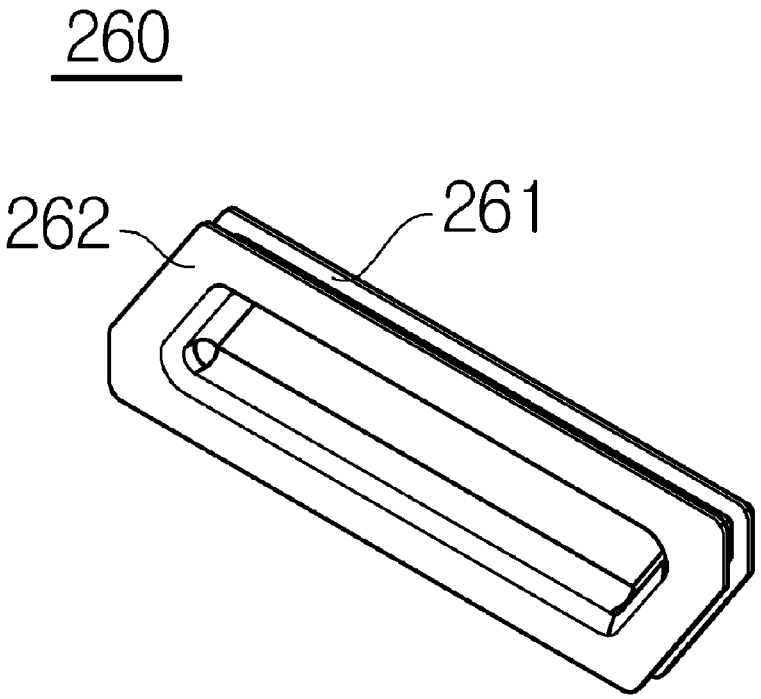

[Fig. 8a]
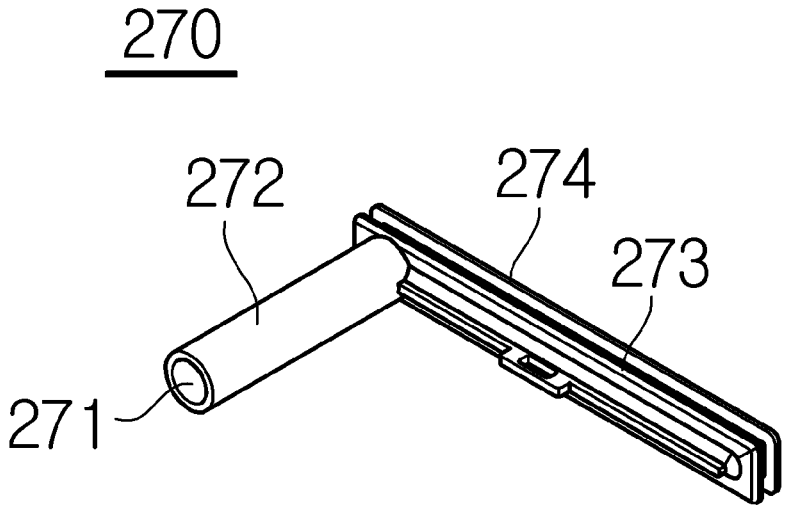
[Fig. 8b]
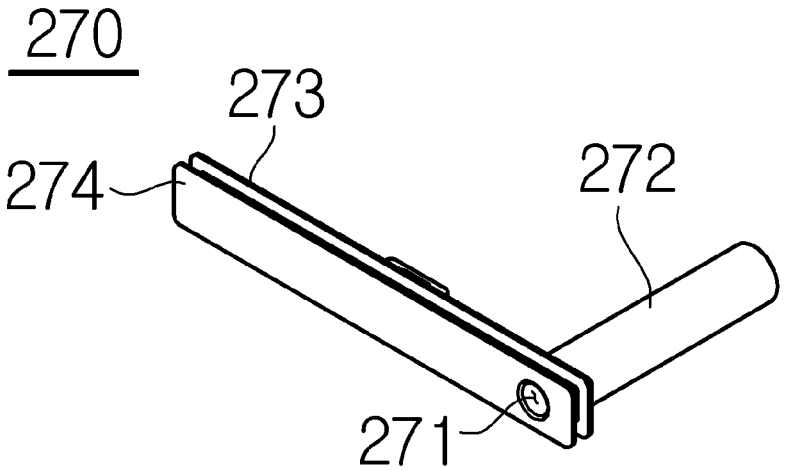

[Fig. 9]
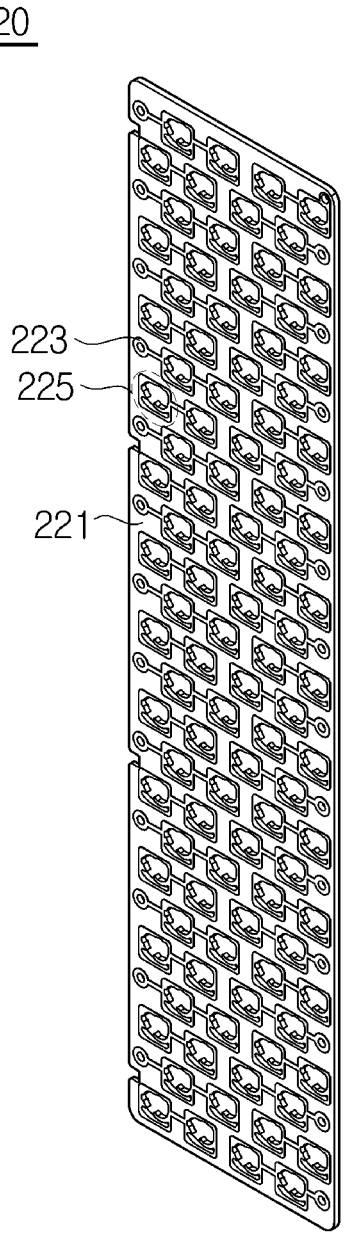

[Fig. 10a]
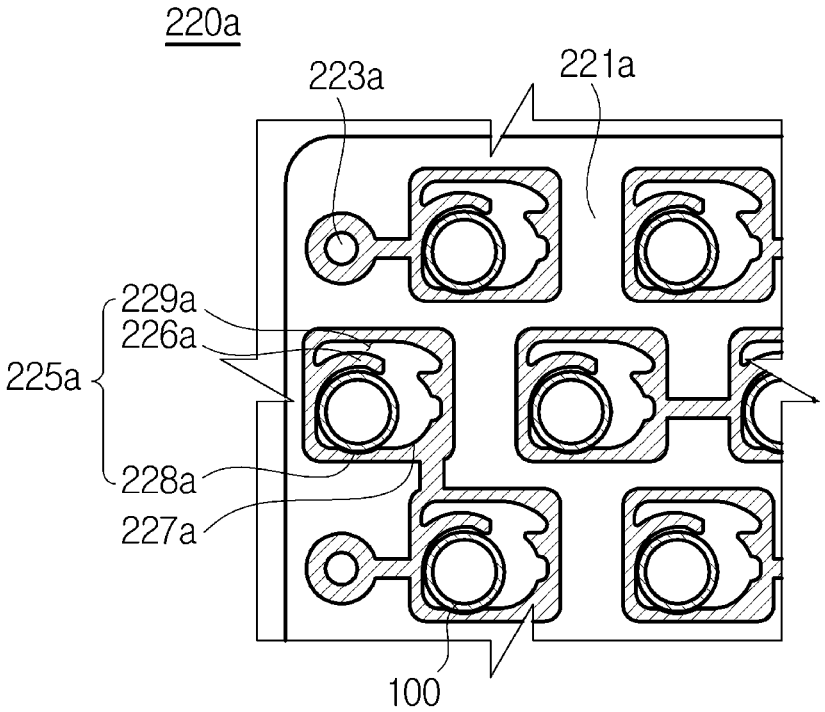
[Fig. 10b]
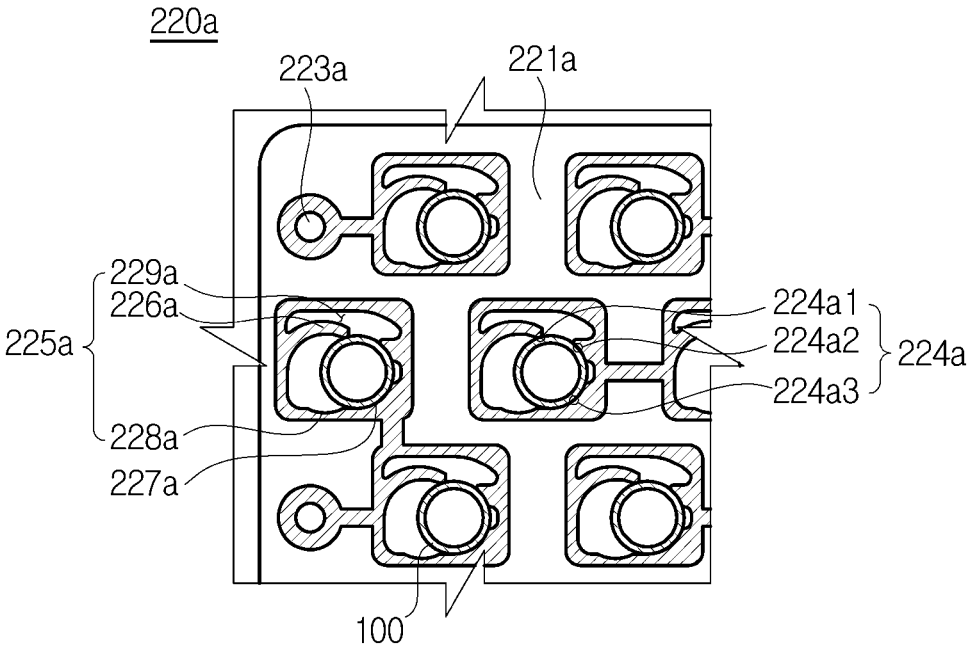

[Fig. 11a]
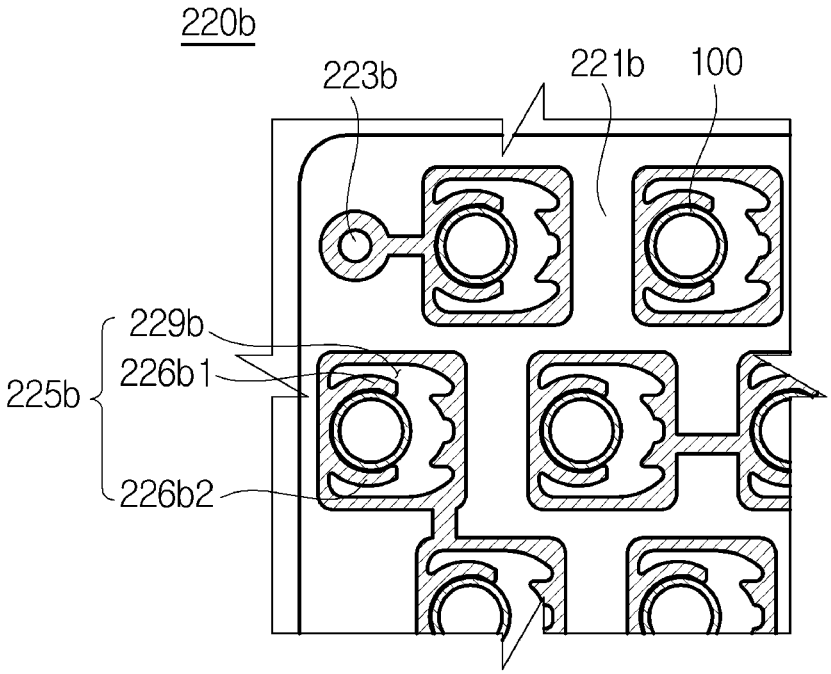
[Fig. 11b]
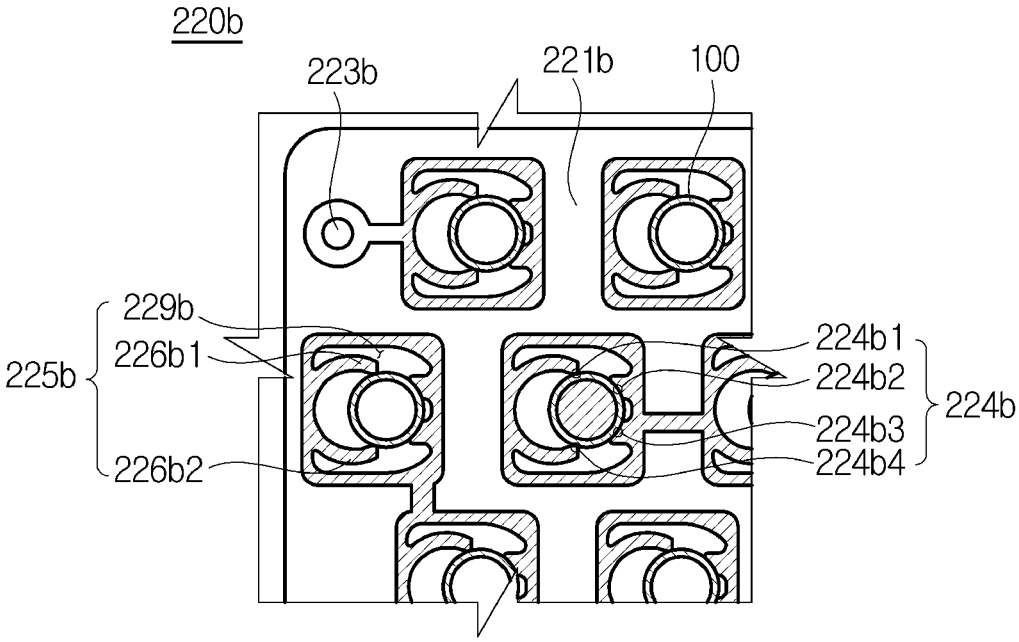

[Fig. 12a]
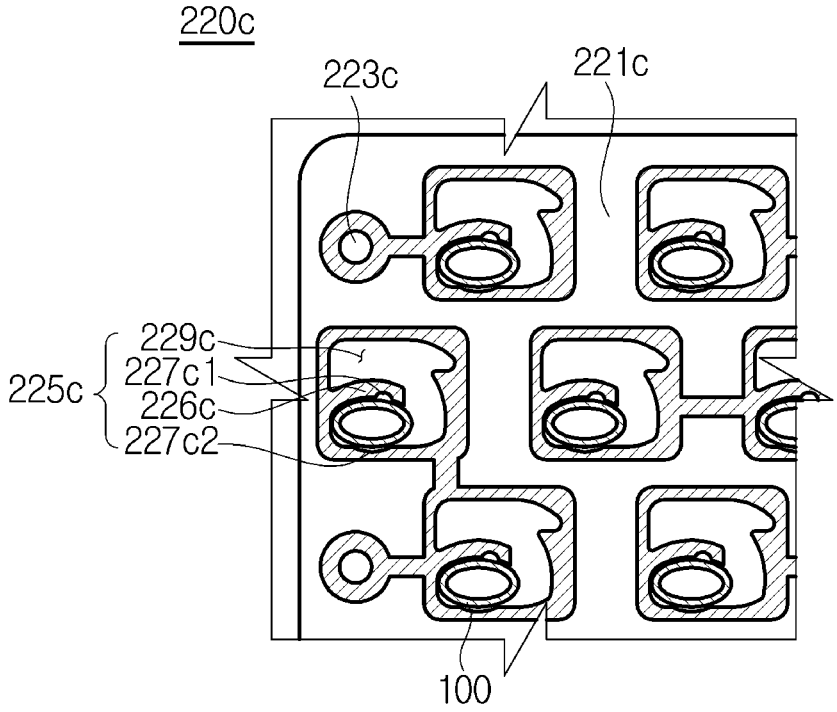
[Fig. 12b]
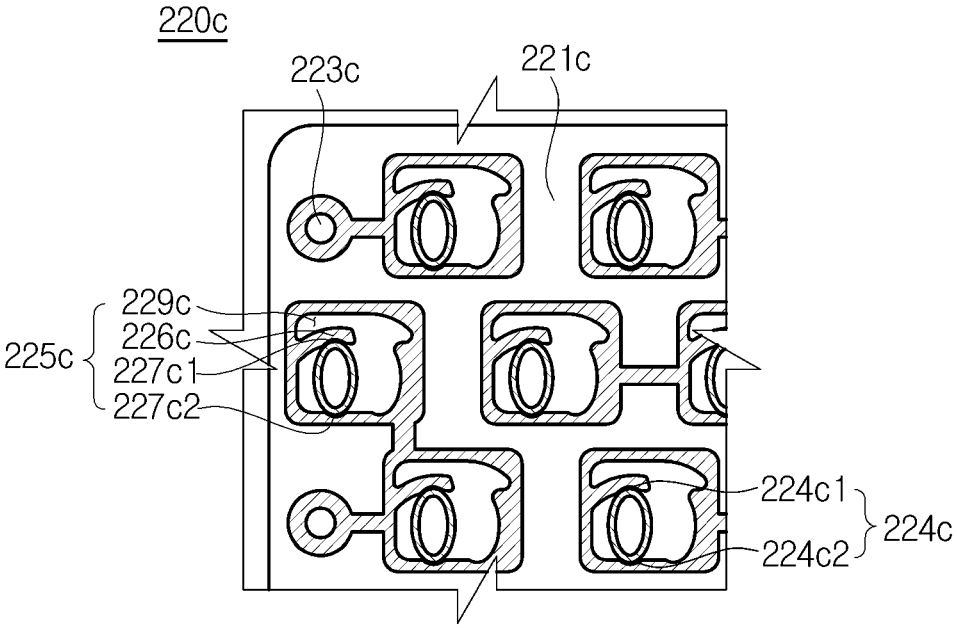

[Fig. 13a]
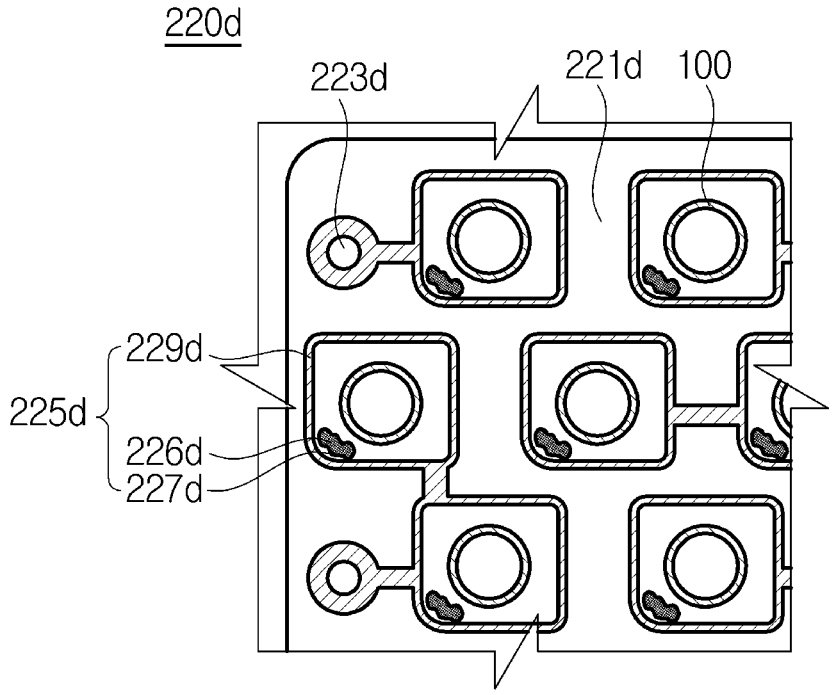
[Fig. 13b]
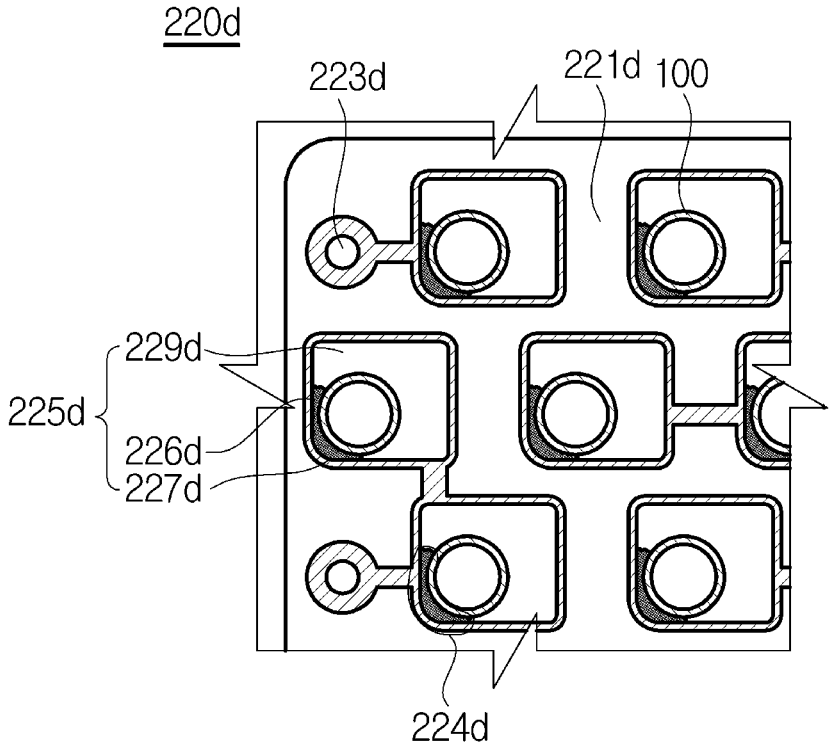

[Fig. 14a]
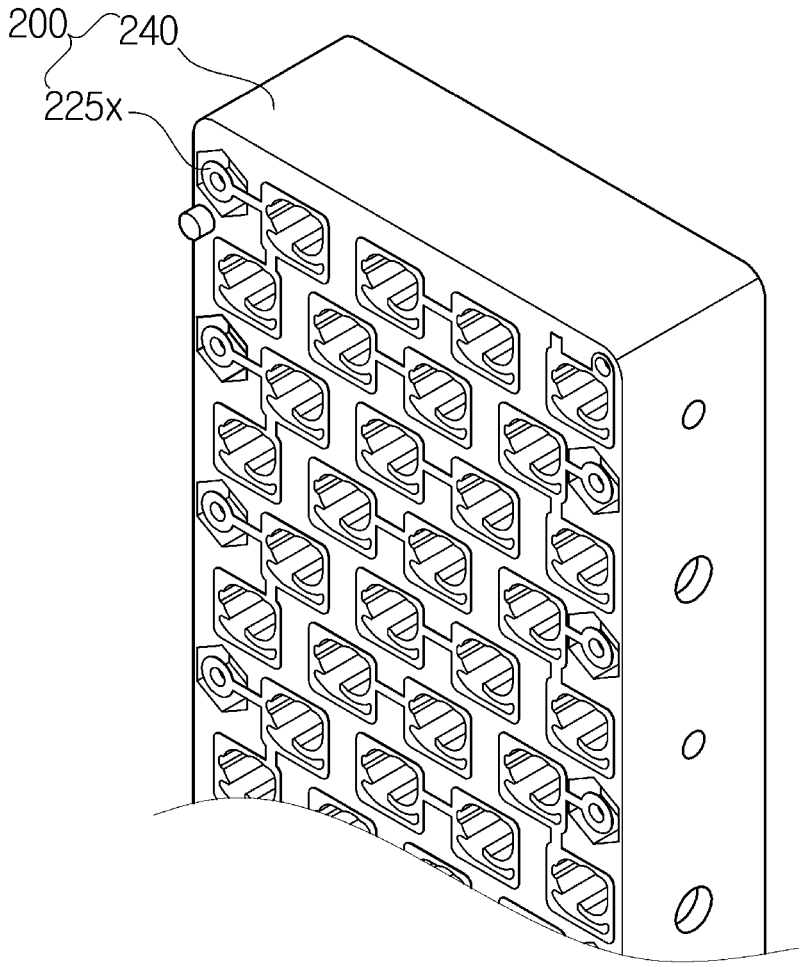

[Fig. 14b]
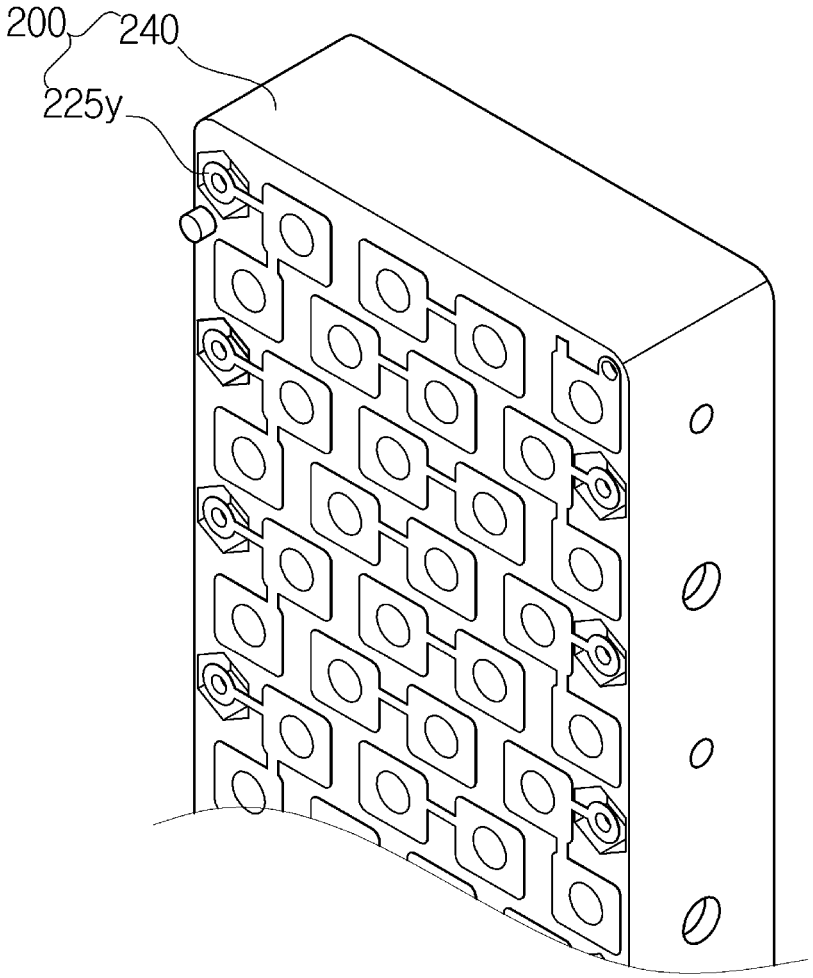

[Fig. 15]
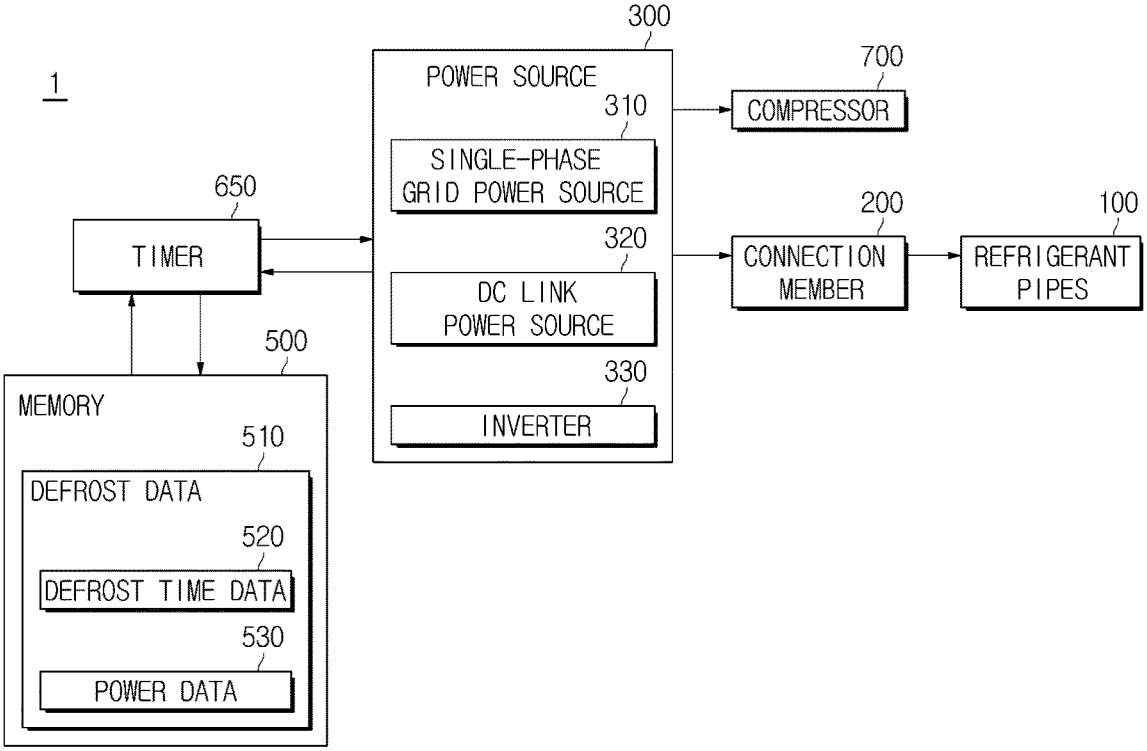

[Fig. 16]
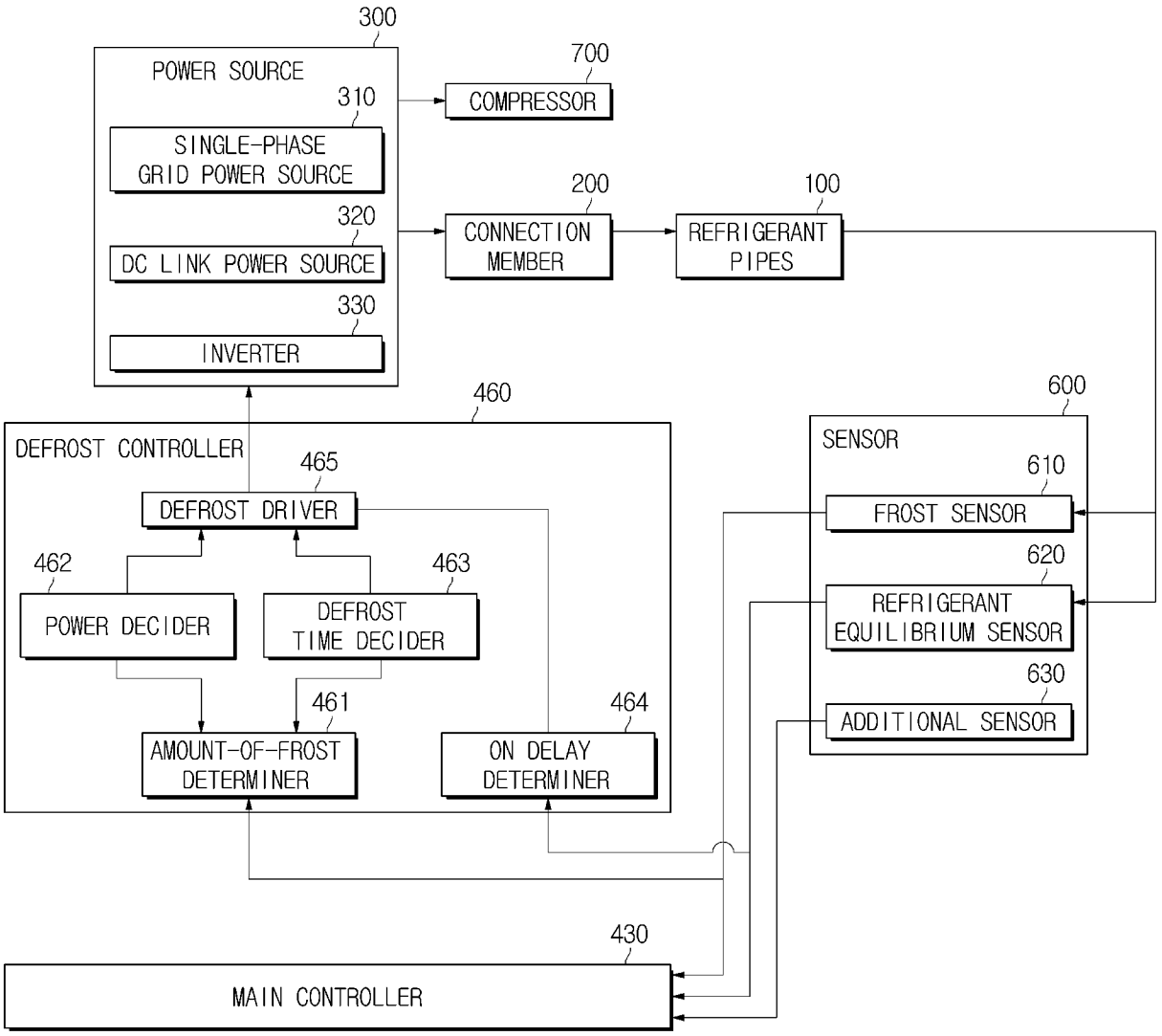

[Fig. 17a]
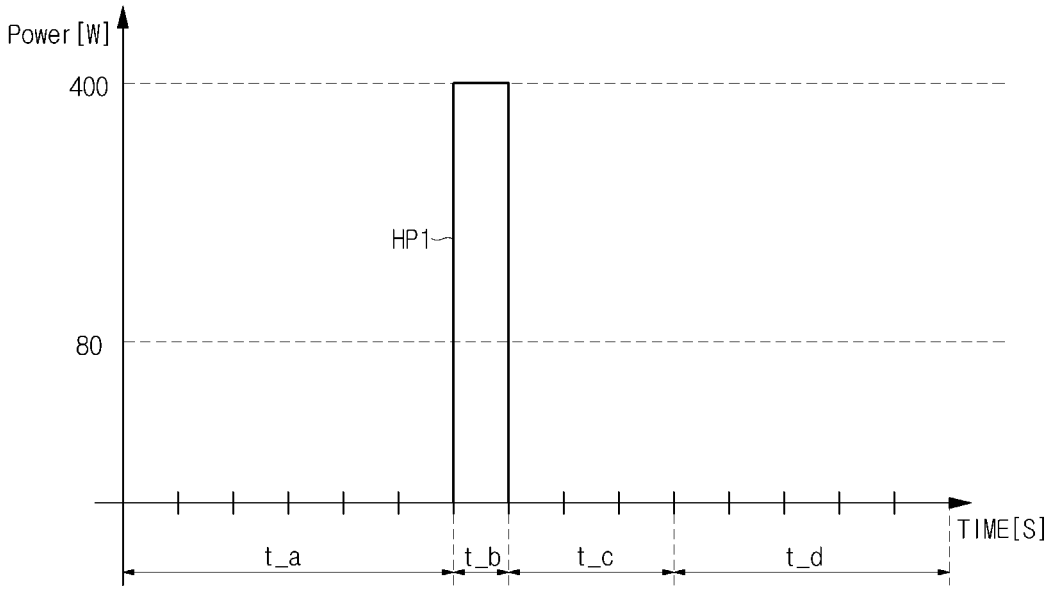
[Fig. 17b]
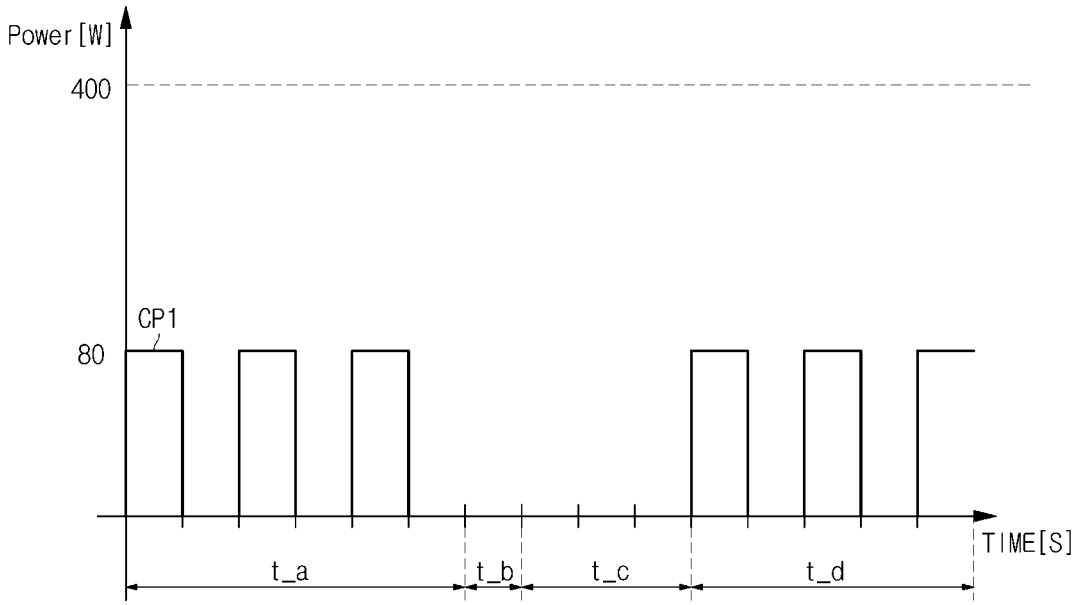

[Fig. 18a]
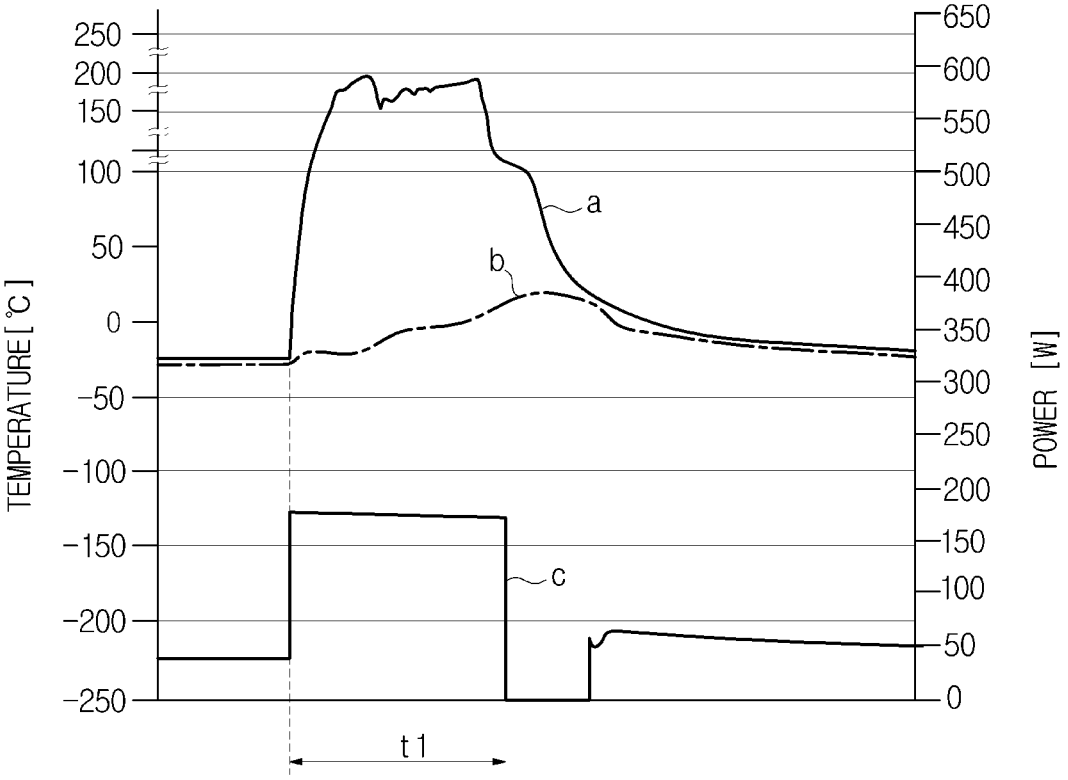
[Fig. 18b]
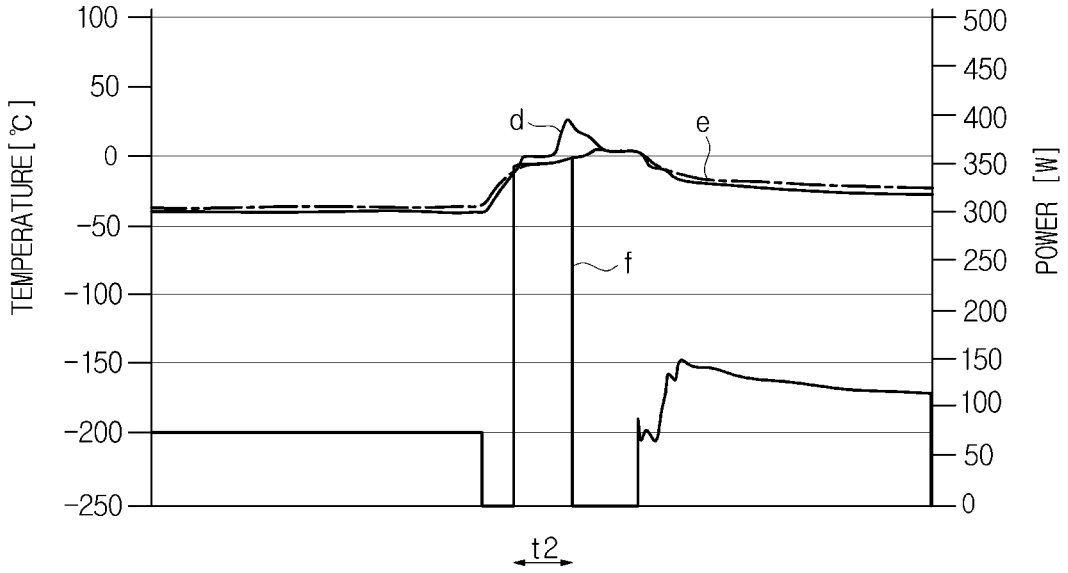

[Fig. 19]
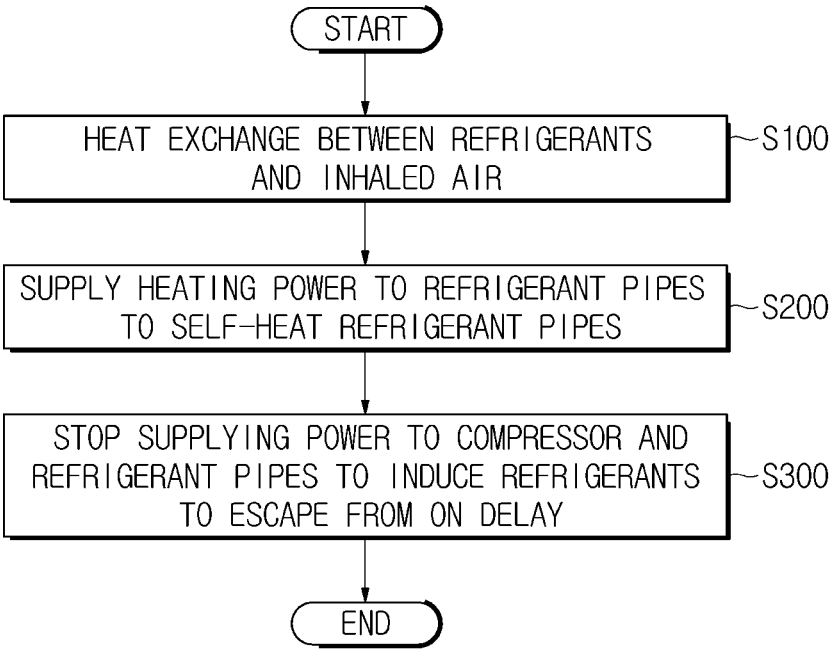

[Fig. 20]
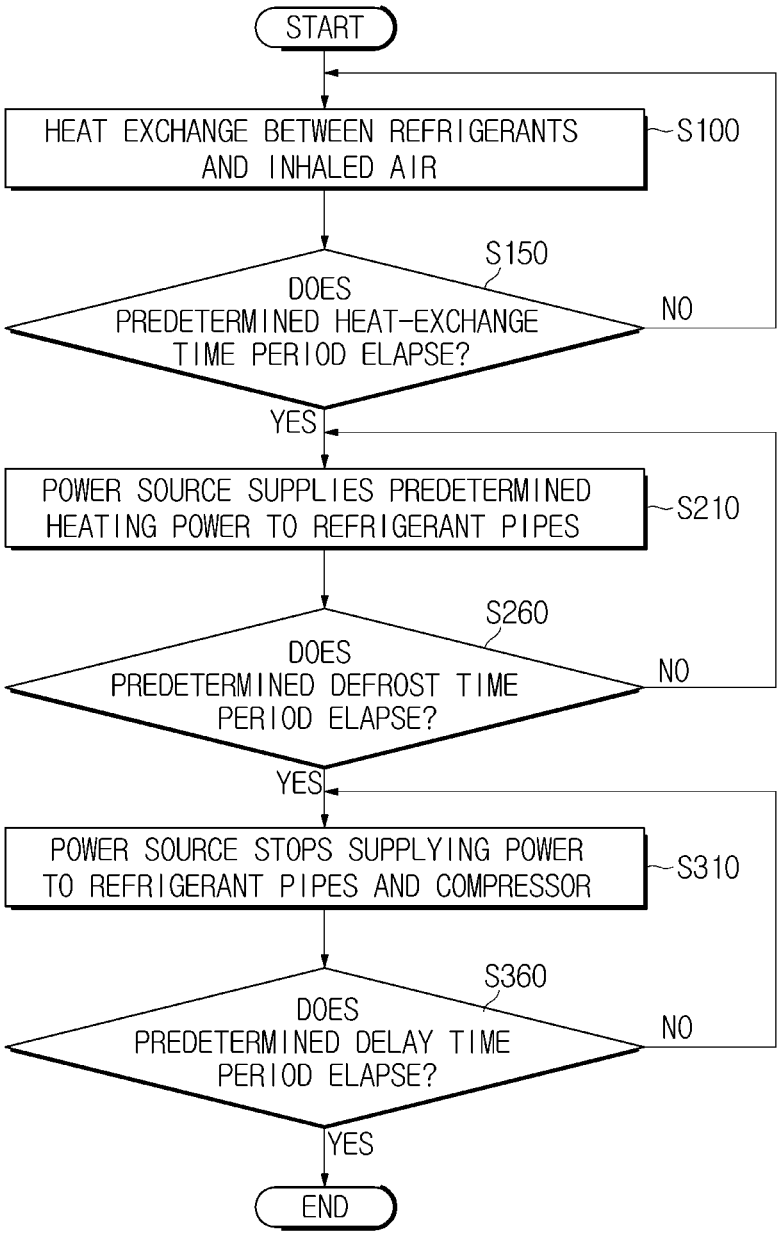

[Fig. 21]
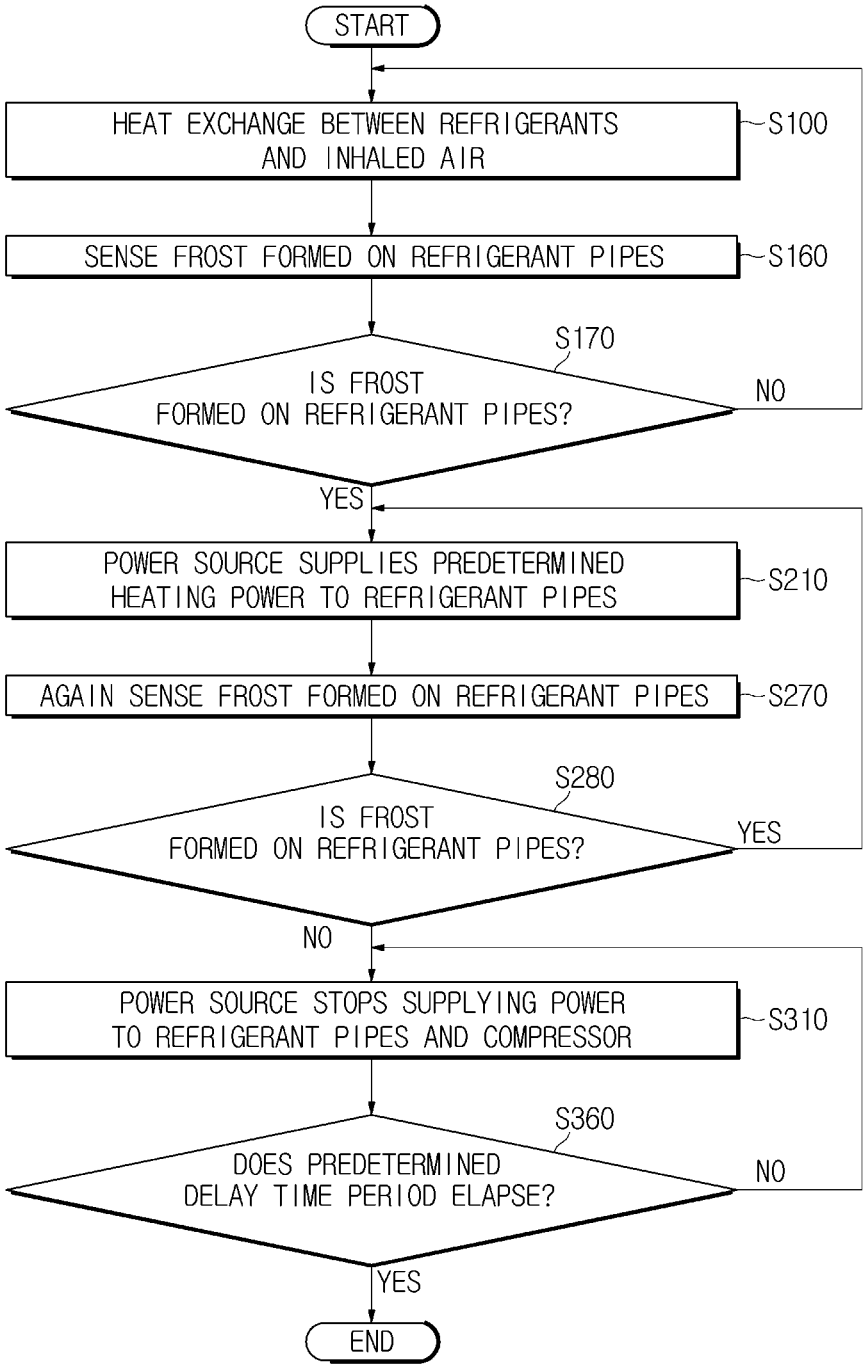

[Fig. 22]
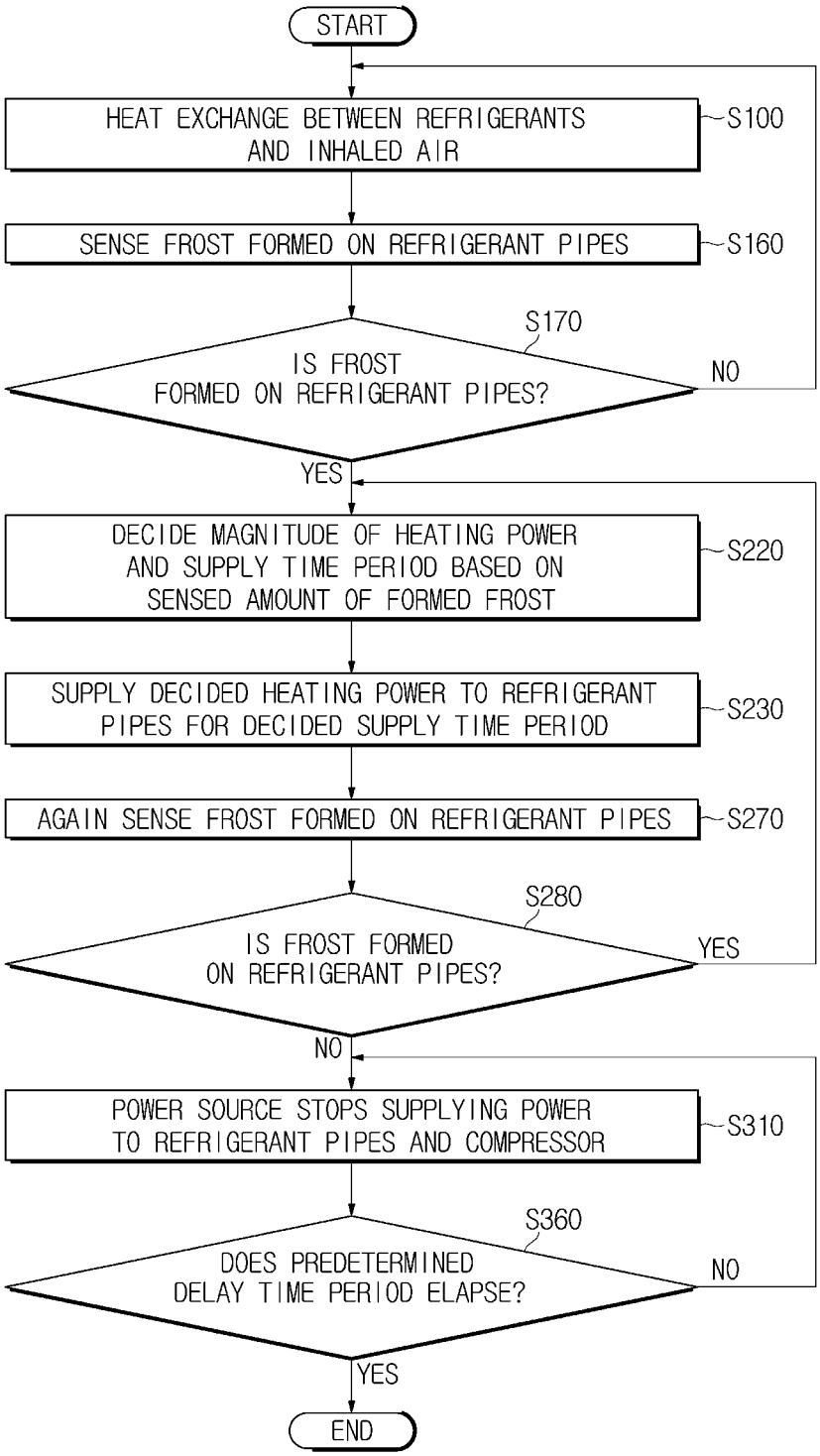

[Fig. 23]
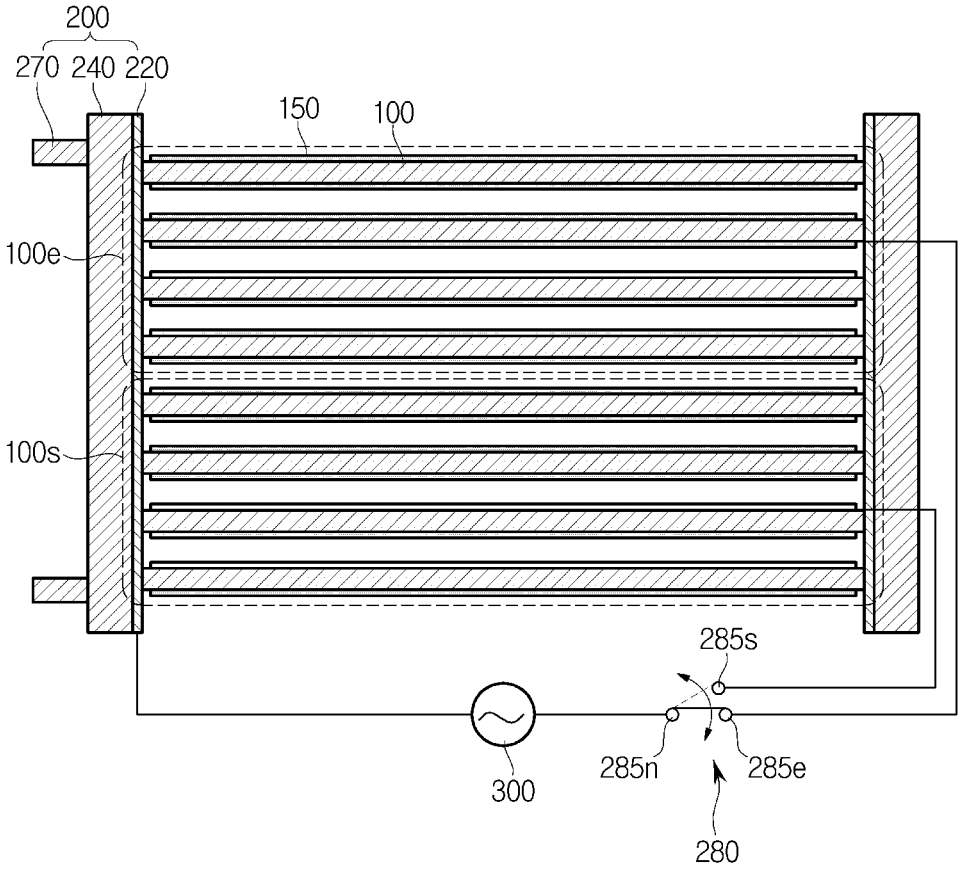

[Fig. 24]
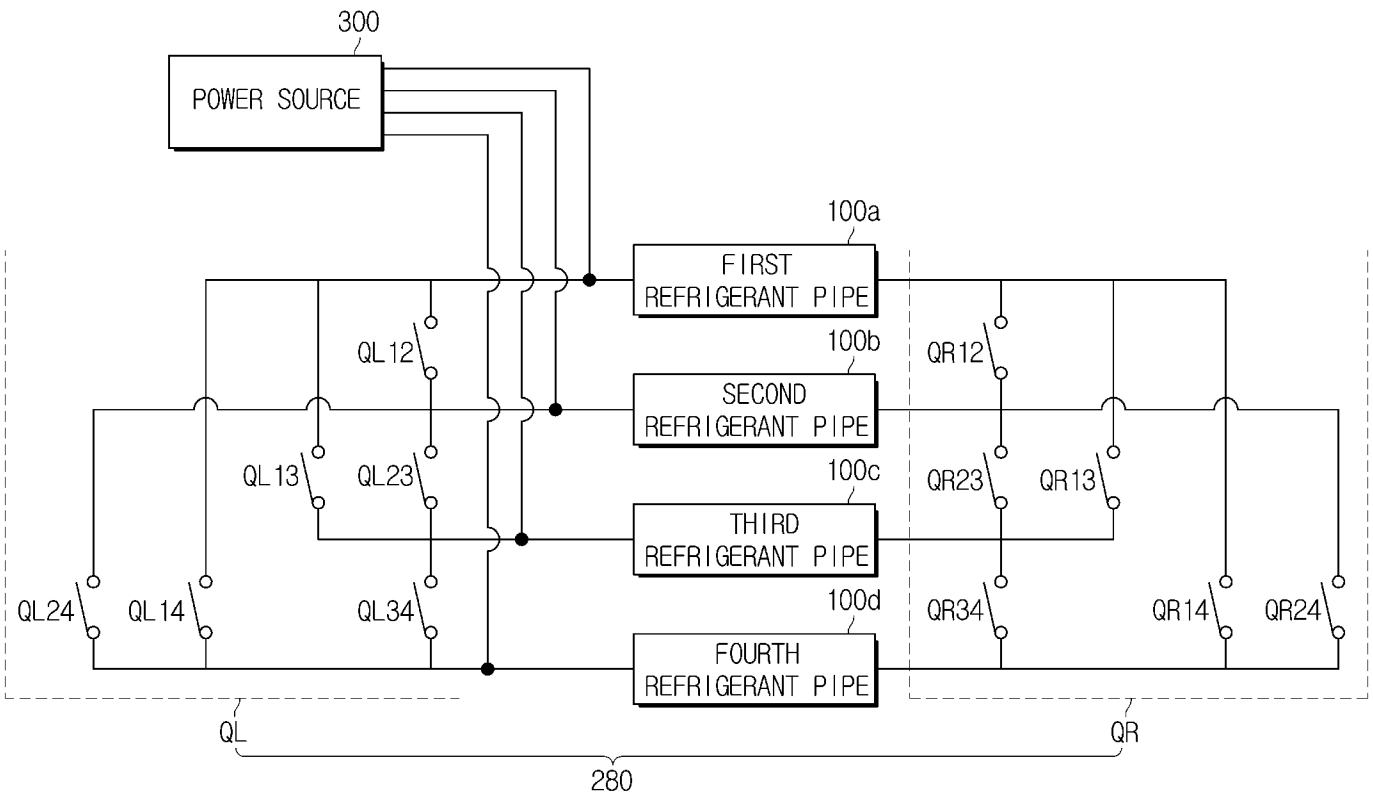

[Fig. 25a]
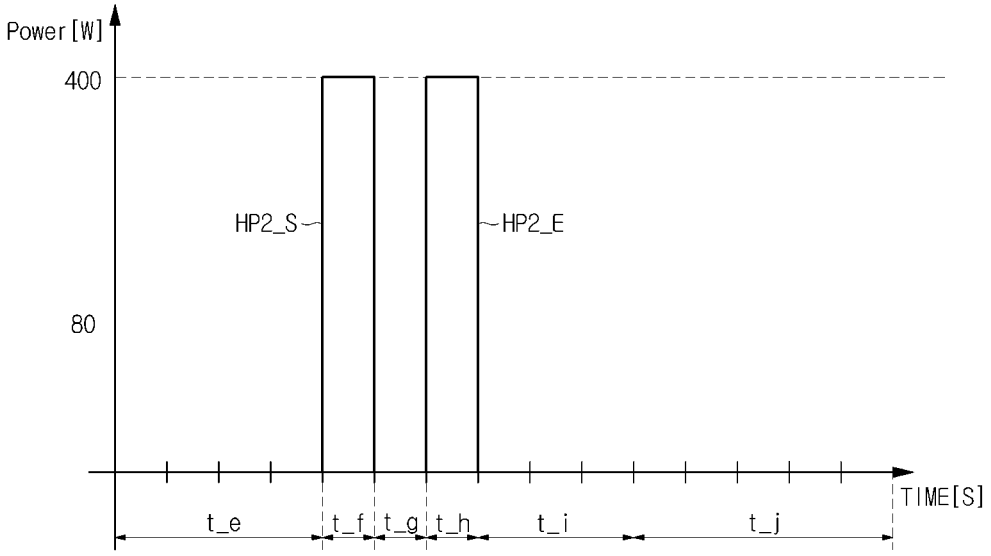
[Fig. 25b]
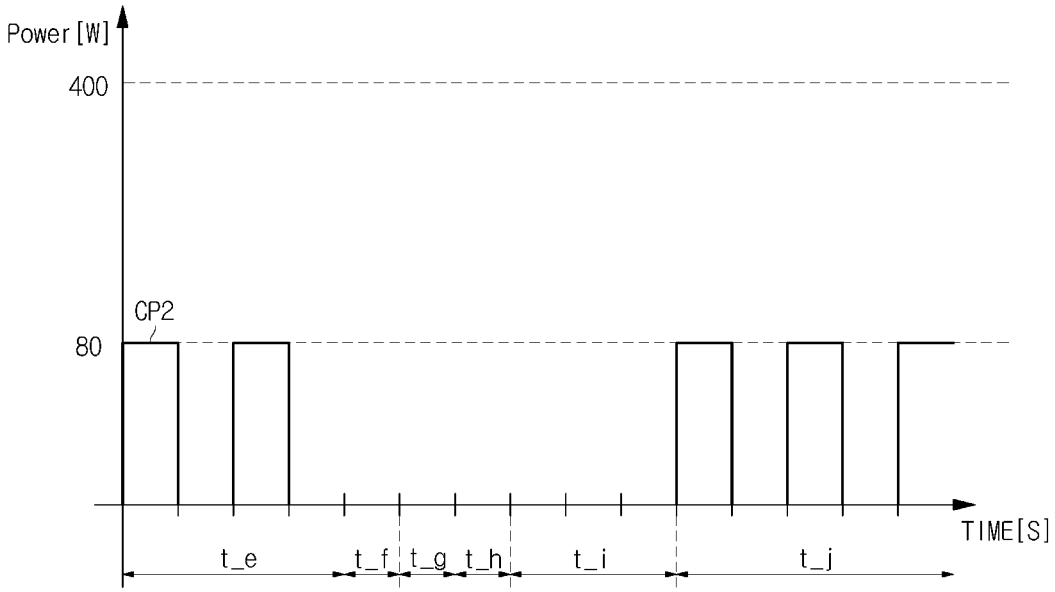

[Fig. 26]
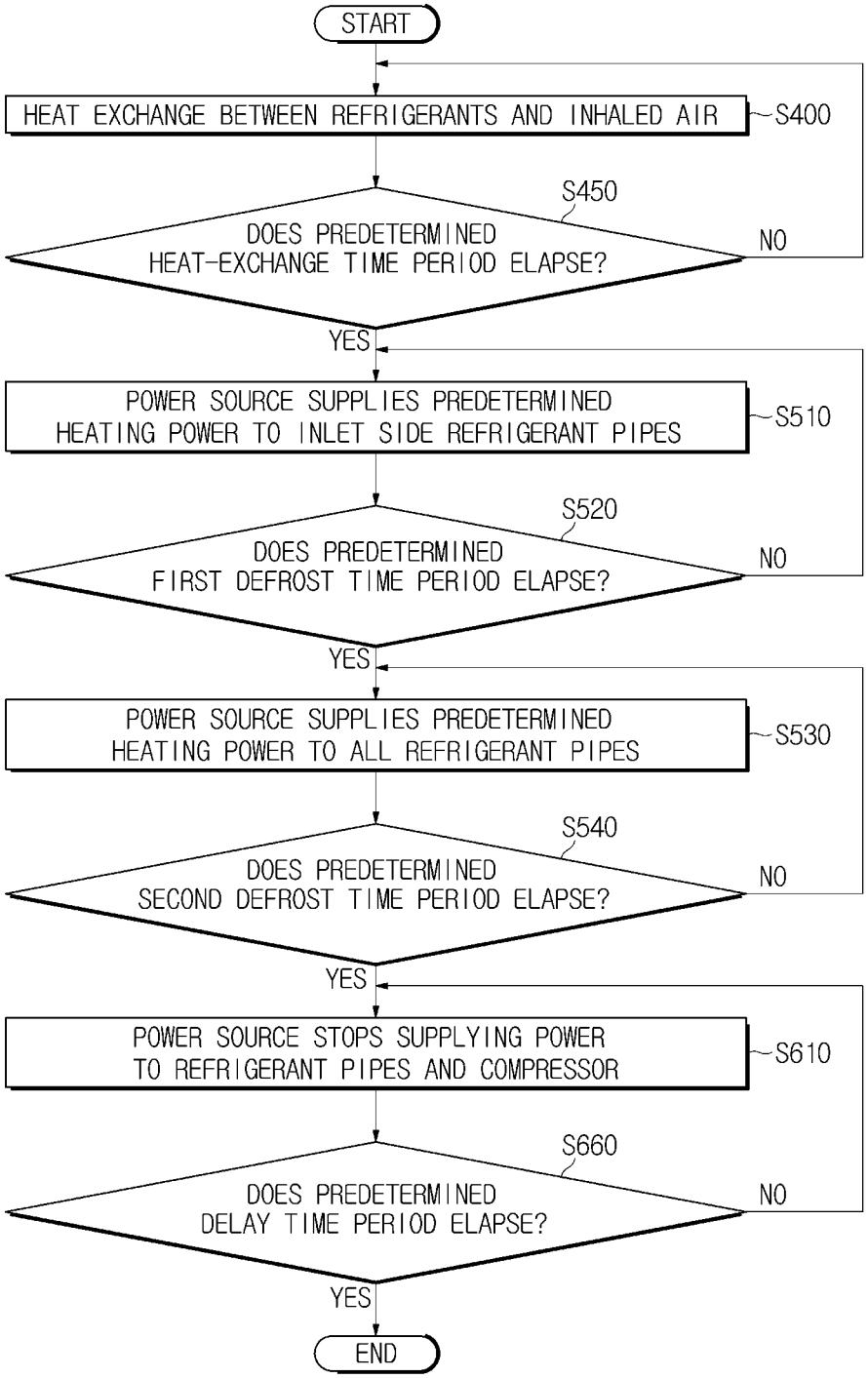

[Fig. 27]
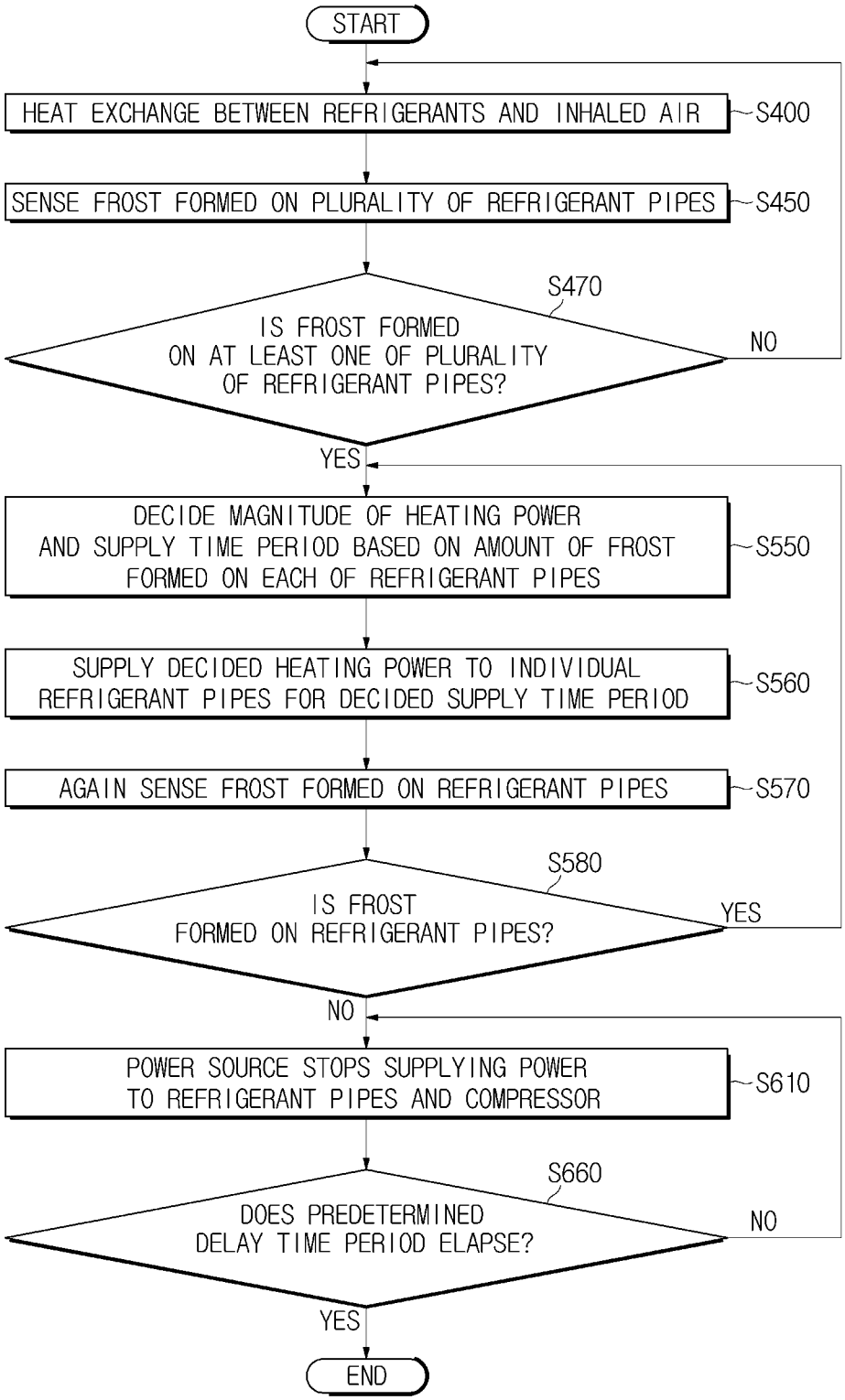

[Fig. 28a]
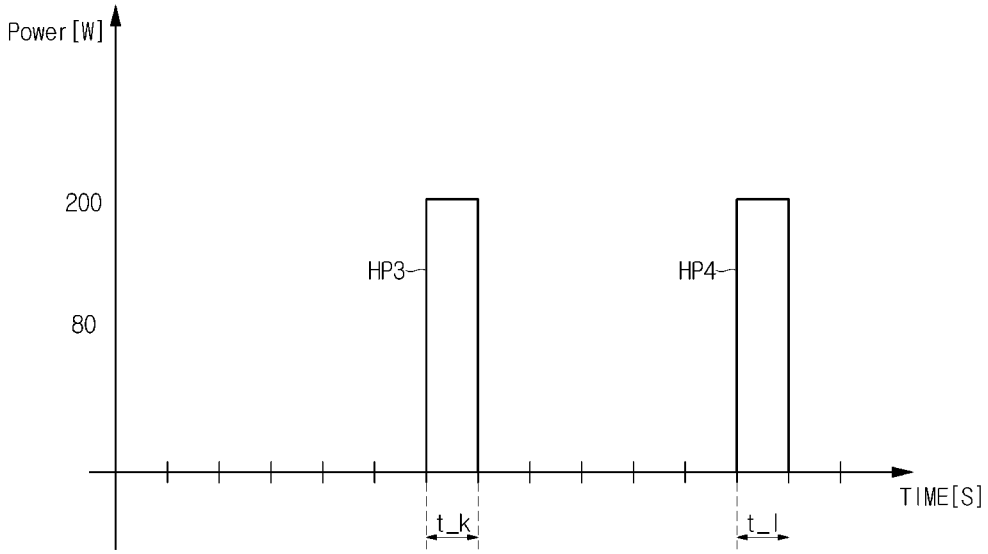
[Fig. 28b]
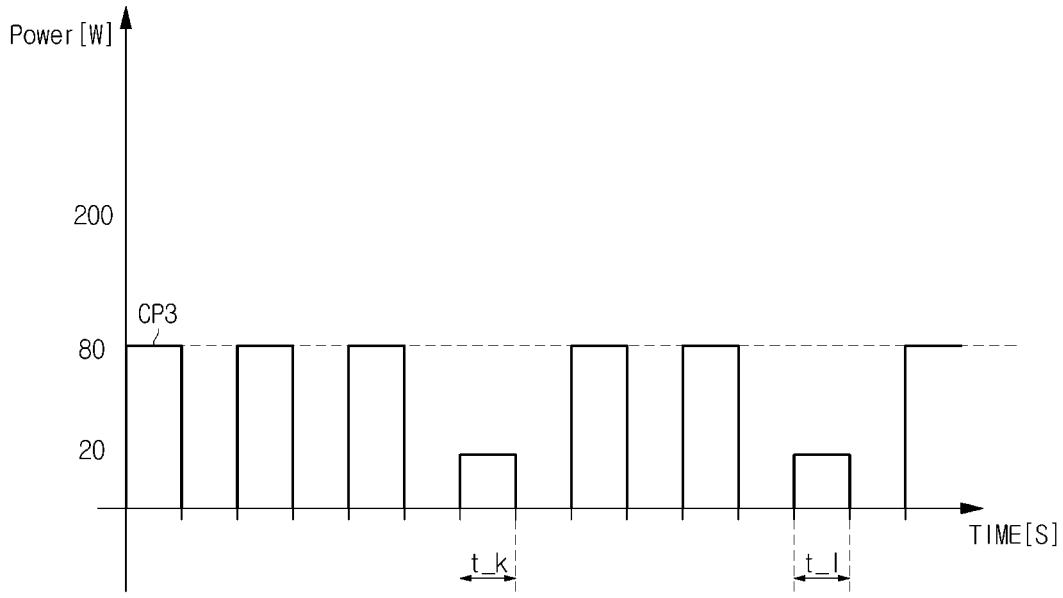

[Fig. 29]
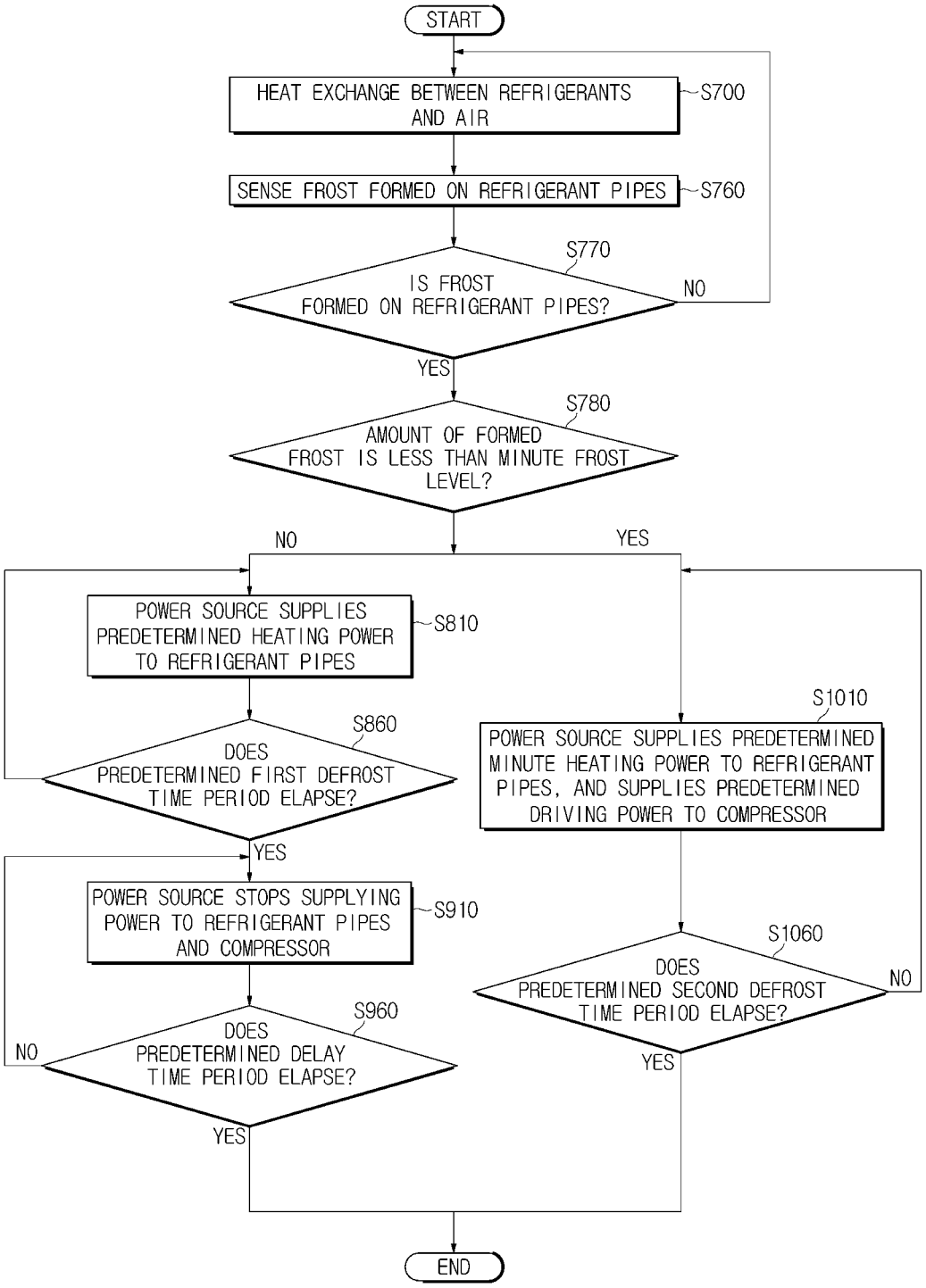

[Fig. 30a]
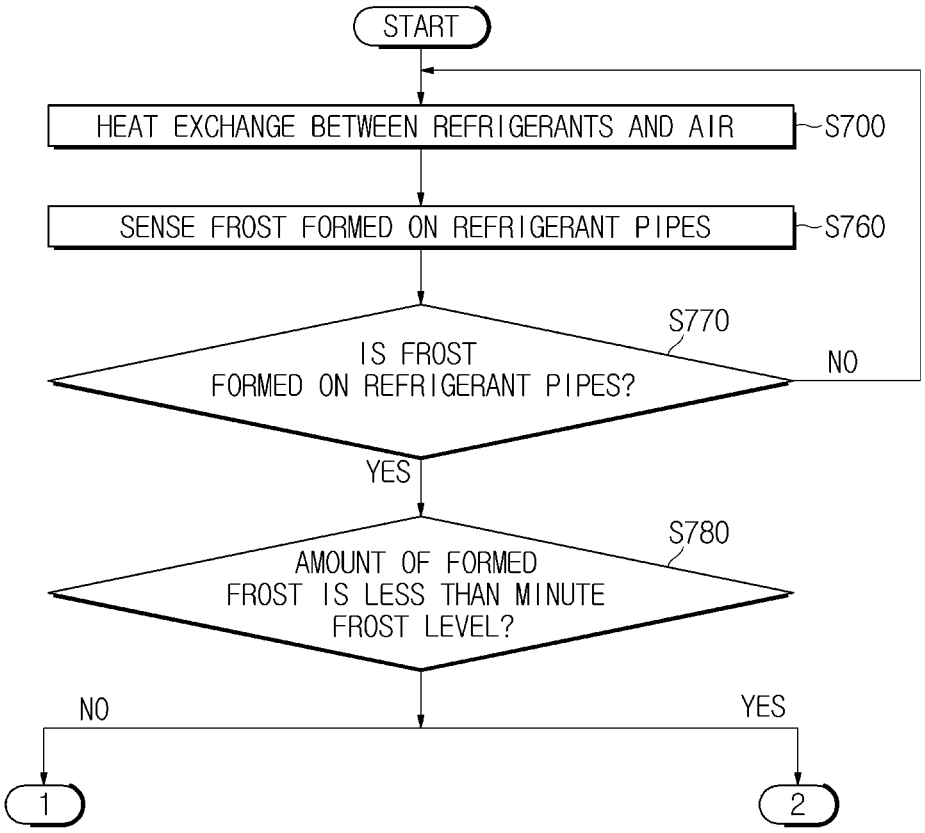

[Fig. 30b]
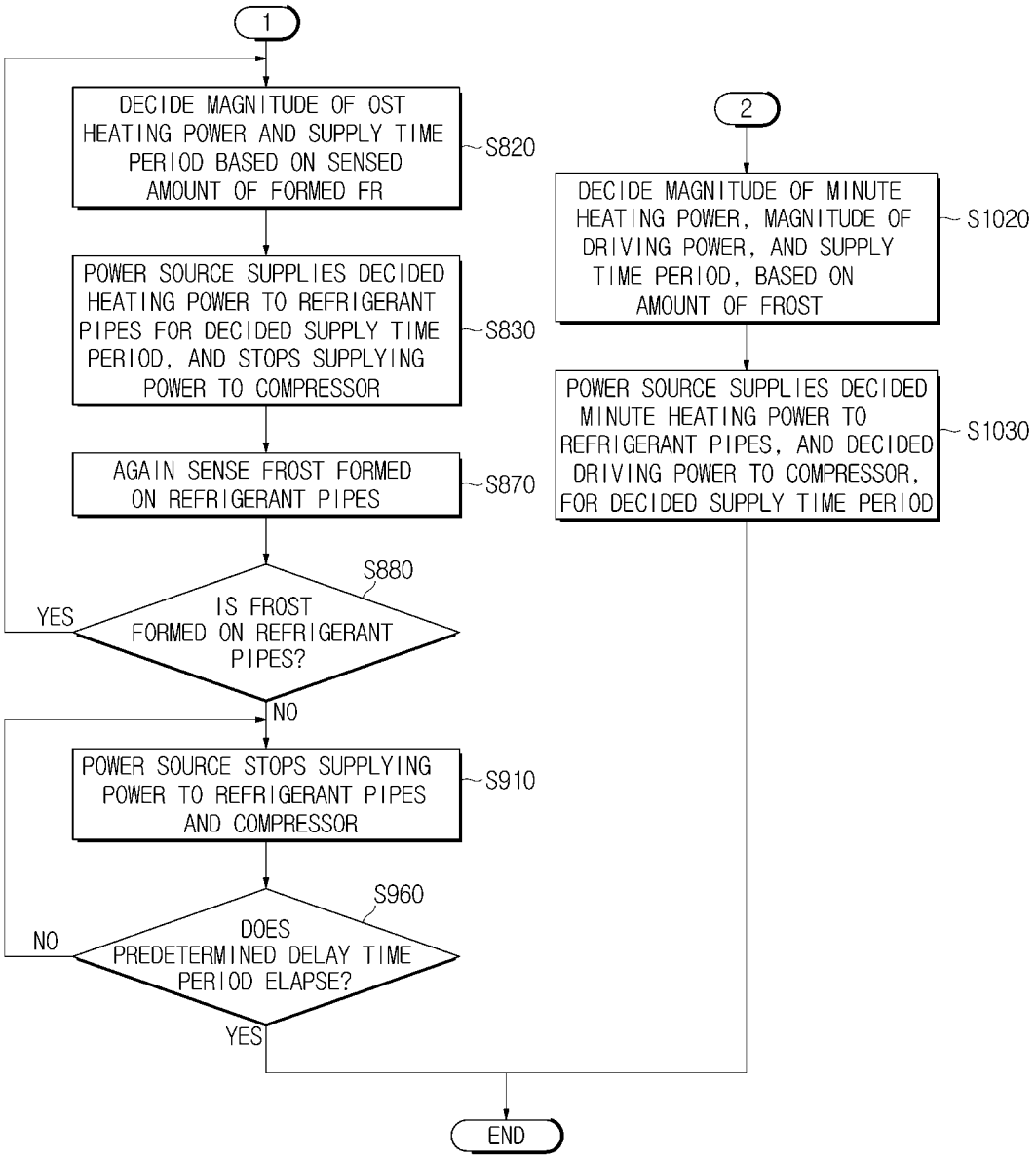

[Fig. 31]
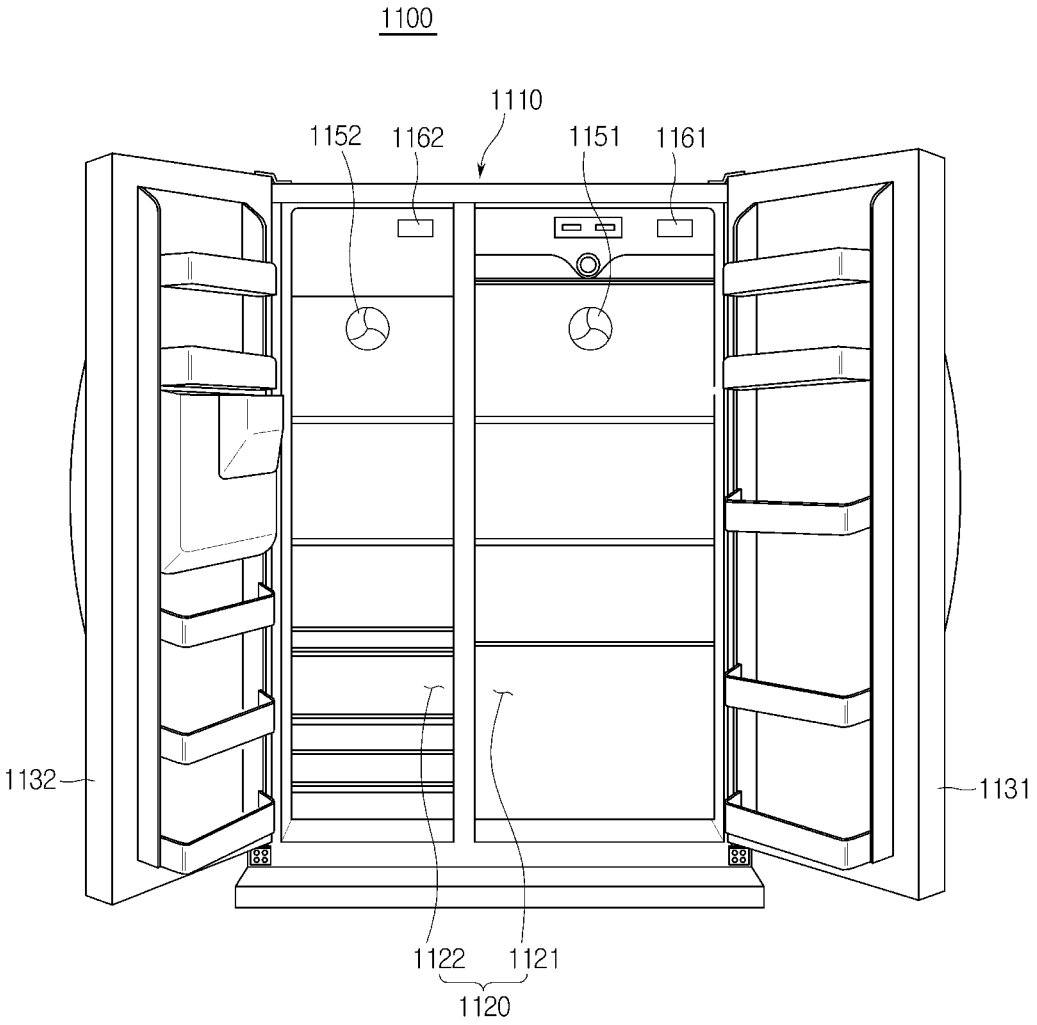

[Fig. 32]
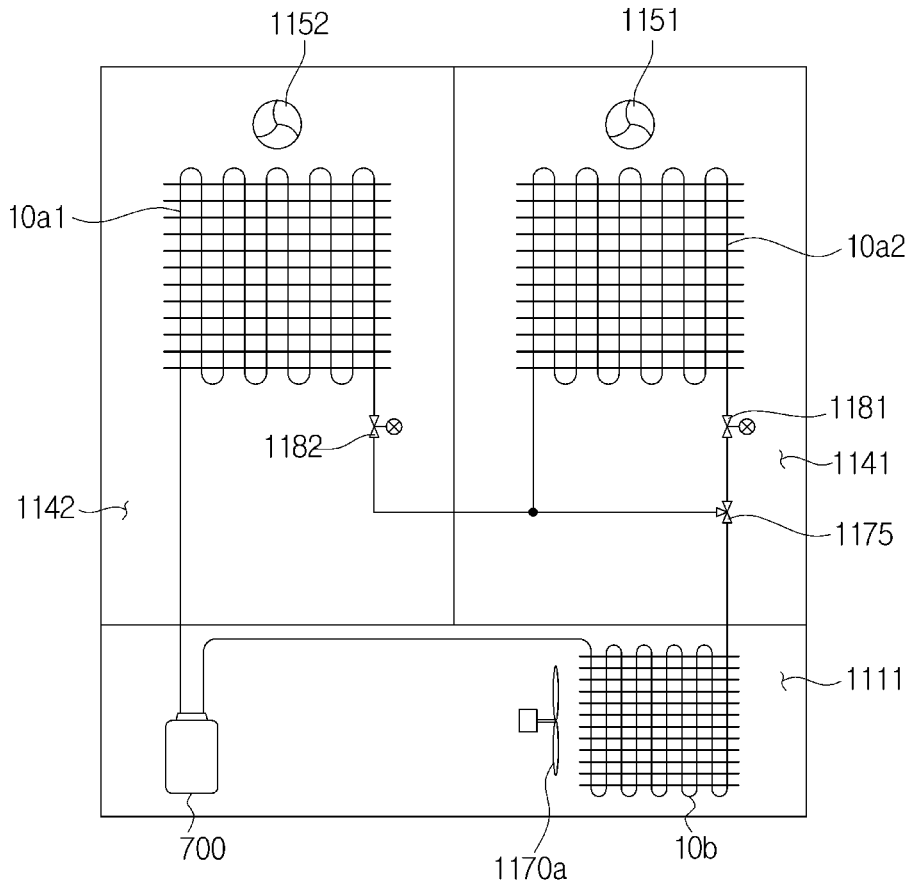

COOLING DEVICE AND METHOD FOR CONTROLLING SAME

CROSS-REFERENCE TO RELATED APPLICATION

This application is a U.S. national stage application, which claims the benefit under 35 USC § 371 of PCT International Patent Application No. PCT/KR2015/000566, filed Jan. 20, 2015 which claims foreign priority benefit under 35 USC § 119 of Korean Patent Application No. 10-2014-0090949, filed on Jul. 18, 2014, the entire contents of which are incorporated herein by reference.

TECHNICAL FIELD

The present invention relates to a cooling device of removing formed frost, and a method of controlling the cooling device.

BACKGROUND ART

A cooling device is used to cool specific space by circulating refrigerants according to a cooling cycle. The cooling device includes a refrigerator, a kimchi refrigerator, an air conditioner, etc. The cooling cycle is to change refrigerants to four stages of compression, condensation, expansion, and evaporation. In order to perform the cooling cycle, a compressor, an expansion valve, a condenser, and a heat exchanger such as an evaporator should be provided.

That is, in the cooling device, refrigerants in a gaseous state are compressed by driving the compressor, the compressed refrigerants are sent to the condenser so as to be cooled through heat exchange with ambient air in the condenser, the flow of the refrigerants changed to a liquid state by cooling is adjusted by the expansion valve and then sprayed into the evaporator, and then the sprayed refrigerants are suddenly expanded to be vaporized. At this time, the evaporator absorbs heat from ambient air to supply cool air to internal space such as a storage chamber or indoor space, thereby cooling the space. Also, the refrigerants changed to the gaseous state in the evaporator again enter the compressor to be compressed to the liquid state. In this way, the cooling cycle is repeated.

Since the surface temperature of the evaporator of absorbing heat of the internal space through the cooling cycle to cool the internal space is relatively lower than the temperature of air of the internal space, moisture from the air of the internal space with relatively high temperature and humidity are condensed on the surface of the evaporator so that frost is formed on the surface of the evaporator. The frost formed on the surface of the evaporator becomes thicker over time, and accordingly, the heat-exchange efficiency of air passing through the evaporator deteriorates to lower cooling efficiency, resulting in excessive power consumption.

If a separate heater is included in the cooling device in order to remove the formed frost, heat generated by the heater is transferred to the frost through radiation or convection, which causes low efficiency, long defrost time, a change in inside temperature of the refrigerator, etc. Recently, studies for overcoming the problem are underway.

DISCLOSURE

Technical Problem

An aspect of the present disclosure is to provide a cooling device of providing high efficiency through self-heating of refrigerant pipes without using a separate heater, and a method of controlling the cooling device.

Technical Solution

In accordance with an aspect of the present disclosure, there is provided a cooling device includes a plurality of refrigerant pipes including a polymer material and a power source configured to supply heating power for self-heating of the refrigerant pipes to the refrigerant pipes.

Here, the cooling device may further comprise a connection member disposed at both ends of the refrigerant pipes, and configured to electrically connect the refrigerant pipes to the power source.

Also, wherein the connection member may include a plurality of insertion holes, a header configured to circulate refrigerants in the refrigerant pipes, and a connection film contacting the refrigerant pipes inserted into the insertion holes.

Also, the connection film may be disposed on the inner circumference surfaces of the insertion holes.

Also, the connection member may include a plurality of insertion holes, a header configured to circulate refrigerants in the refrigerant pipes, and a Flexible Printed Circuit Board (FPCB) having flexibility and including a plurality of connection holes corresponding to the insertion holes, and wherein the FPCB includes a connection film contacting the refrigerant pipes inserted into the connection holes.

Also, the connection film may be disposed on the inner circumference surfaces of the connection holes.

Also, the refrigerant pipes may comprise a carbon allotrope.

Also, an insulator film may be formed on the surfaces of the refrigerant pipes to prevent surface current from leaking out.

Also, consumption power of inlet side refrigerant pipes disposed close to an inlet side among the refrigerant pipes may be higher than or equal to consumption power of outlet side refrigerant pipes disposed close to an outlet side among the refrigerant pipes.

Also, consumption power of the refrigerant pipes may be reduced to predetermined consumption power levels in order from the inlet side refrigerant pipes to the outlet side refrigerant pipes.

Also, wherein electric resistance values of inlet side refrigerant pipes disposed close to an inlet side among the refrigerant pipes may be smaller than or equal to electric resistance values of outlet side refrigerant pipes disposed close to an outlet side among the refrigerant pipes.

Also, the electric resistance values of the refrigerant pipes may increase to predetermined resistance values in order from the inlet side refrigerant pipes to the outlet side refrigerant pipes.

Also, the power source may supply predetermined heating power to the refrigerant pipes for a predetermined defrost time period.

Also, the power source may stop supplying power to the refrigerant pipes and the compressor for a predetermined delay time period.

Also, after a predetermined heat-exchange time period elapses, the power source may supply the predetermined heating power to the refrigerant pipes.

Also, the cooling device may comprise a sensor configured to sense an amount of frost formed on the refrigerant pipes.

Also, if the sensed amount of frost is greater than or equal to a predetermined value, the power source may supply the predetermined heating power to the refrigerant pipes.

Also, the power source may decide a magnitude of heating power and a supply time period of the heating power, based on the sensed amount of frost, and supplies the decided heating power to the refrigerant pipes for the decided supply time period.

Also, the cooling device may further comprise a switch configured to select one or more refrigerant pipes to which the heating power is supplied.

Also, the switch may select the refrigerant pipes such that the heating power is supplied to the selected refrigerant pipes, starting from inlet side refrigerant pipes disposed close to an inlet side among the refrigerant pipes, for a predetermined defrost time period.

Also, the cooling device may further comprise a sensor configured to sense an amount of frost formed on the plurality of refrigerant pipes, wherein if the sensed amount of frost is greater than or equal to a predetermined value, the switch connects the refrigerant pipes to the power source.

Also, the power source may decide a magnitude of heating power and a supply time period of the heating power for each refrigerant pipe based on the sensed amount of frost, and supplies the decided heating power to the refrigerant pipe for the decided supply time period.

Also, the power source may decide a magnitude of heating power and a supply time period of the heating power for each refrigerant pipe, based on the sensed amount of frost, and supplies the decided heating power to the refrigerant pipe for the decided supply time period.

Also, the cooling device may further comprises a sensor configured to sense an amount of frost formed on the refrigerant pipes, wherein if the sensed amount of frost is smaller than a predetermined minute frost level, the power source supplies predetermined minute heating power to the refrigerant pipes, and supplies predetermined driving power to the compressor.

Also, if the sensed amount of frost is smaller than the predetermined minute frost level, the power source decides a magnitude of minute heating power, a magnitude of driving power, and a supply time period, based on the sensed amount of frost, supplies the decided minute heating power to the refrigerant pipes for the decided supply time period, and supplies the decided driving power to the compressor for the decided supply time period.

In accordance with an aspect of the present disclosure, there is provided a method of controlling a cooling device includes supplying predetermined heating power to a plurality of refrigerant pipes for a defrost time period for self-heating of the refrigerant pipes and stopping supplying power to the refrigerant pipes and a compressor for a delay time period.

Also, the method of controlling a cooling device may further comprise exchanging heat between refrigerants and air for a predetermined heat-exchange time period, wherein the supplying of the predetermined heating power comprises supplying the predetermined heating power after the predetermined heat-exchange time period elapses.

Also, the method of controlling a cooling device may further comprise sensing an amount of frost formed on the refrigerant pipes, wherein the supplying of the predetermined heating power comprises supplying the predetermined heating power to the refrigerant pipes if the sensed amount of frost is greater than or equal to a predetermined value.

Also, the method of controlling a cooling device may further comprise deciding a magnitude of heating power and a supply time period of the heating power based on the sensed amount of frost, wherein the supplying of the predetermined heating power comprises supplying the decided heating power to the refrigerant pipes for the decided supply time period.

Also, the method of controlling a cooling device may further comprise selecting one or more refrigerant pipes to which the predetermined heating power is supplied, through a switch.

Also, the selecting of the one or more refrigerant pipes comprises selecting the refrigerant pipes such that the heating power is supplied to the selected refrigerant pipes, starting from inlet side refrigerant pipes disposed close to an inlet side among the refrigerant pipes, for a defrost time period.

Also, the method of controlling a cooling device may further comprise sensing an amount of frost formed on the plurality of refrigerant pipes, wherein the selecting of the one or more refrigerant pipes comprises selecting the refrigerant pipes if an amount of frost sensed from the refrigerant pipes is greater than or equal to a predetermined value.

Also, the method of controlling a cooling device may further comprise deciding a magnitude of heating power and a supply time period of the heating power for each refrigerant pipe based on the sensed amount of frost, wherein the supplying of the heating power comprises supplying the decided heating power to the refrigerant pipe for the decided supply time period.

Also, the method of controlling a cooling device may further comprise sensing an amount of frost formed on the refrigerant pipes; and supplying predetermined driving power to the compressor if the sensed amount of frost is smaller than a predetermined minute frost level, wherein the supplying of the heating power comprises supplying predetermined minute heating power to the refrigerant pipes if the sensed amount of frost is smaller than the predetermined minute frost level.

Also, the method of controlling a cooling device may further comprise deciding a magnitude of minute heating power, a magnitude of driving power, and a supply time period, based on the sensed amount of frost, if the sensed amount of frost is smaller than the predetermined minute frost level; and supplying the decided driving power to the compressor for the decided supply time period, wherein the supplying of the heating power comprises supplying the decided minute heating power to the refrigerant pipes for the decided supply time period.

Advantageous Effects

According to the cooling device and the control method thereof, as described above, by heating formed frost through refrigerant pipes without using a separate heater to remove generated heat through thermal conductivity, it is possible to reduce time required for defrosting and to lower consumption power.

Also, by applying the cooling device to a refrigerator to reduce a factor of raising the inside temperature of the refrigerator, it is possible to keep food stored in the inside of the refrigerator fresh.

BRIEF DESCRIPTION OF THE DRAWINGS

FIG. 1 is a view for describing the technical concept of a cooling device according to an embodiment of the present disclosure.

FIG. 2 is a block diagram showing the configuration of a cooling device according to an embodiment of the present disclosure.

FIG. 3 shows the outer appearance of the cooling device according to an embodiment of the present disclosure.

FIG. 4 shows the outer appearance of a refrigerant pipe according to an embodiment of the present disclosure.

FIG. 5A shows the outer appearance of one side of a connection member according to an embodiment of the present disclosure.

FIG. 5B shows the outer appearance of the other side of the connection member according to an embodiment of the present disclosure.

FIG. 6A shows the outer appearance of a surface of a header according to an embodiment of the present disclosure.

FIG. 6B shows the outer appearance of the other surface of the header according to an embodiment of the present disclosure.

FIG. 6C shows the outer appearance of a surface of another header according to an embodiment of the present disclosure.

FIG. 6D shows the outer appearance of the other surface of the other header according to an embodiment of the present disclosure.

FIG. 7A shows the outer appearance of one side of a cap according to an embodiment of the present disclosure.

FIG. 7B shows the outer appearance of the other side of the cap according to an embodiment of the present disclosure.

FIG. 8A shows the outer appearance of one side of a refrigerant inlet/outlet port according to an embodiment of the present disclosure.

FIG. 8B shows the outer appearance of the other side of the refrigerant inlet/outlet port according to an embodiment of the present disclosure.

FIG. 9 shows the outer appearance of a FPCB and a connection film according to an embodiment of the present disclosure.

FIG. 10A is an enlarged view showing the outer appearance of a FPCB and a connection film according to an embodiment of the present disclosure before they are fixed.

FIG. 10B is an enlarged view showing the outer appearance of the FPCB and the connection film according to an embodiment of the present disclosure after they are fixed.

FIG. 11A is an enlarged view showing the outer appearance of a FPCB and a connection film according to another embodiment of the present disclosure before they are fixed FIG. 11B is an enlarged view showing the outer appearance of the FPCB and the connection film according to another embodiment of the present disclosure after they are fixed.

FIG. 12A is an enlarged view showing the outer appearance of a FPCB and a connection film according to another embodiment of the present disclosure before they are fixed.

FIG. 12B is an enlarged view showing the outer appearance of the FPCB and the connection film according to another embodiment of the present disclosure after they are fixed.

FIG. 13A is an enlarged view showing the outer appearance of a FPCB and a connection film according to another embodiment of the present disclosure before they are fixed.

FIG. 13B is an enlarged view showing the outer appearance of the FPCB and the connection film according to another embodiment of the present disclosure after they are fixed.

FIG. 14A is an exploded perspective view showing the outer appearance of a header and a connection film according to an embodiment of the present disclosure.

FIG. 14B is an exploded perspective view showing the outer appearance of a header and a connection film according to another embodiment of the present disclosure.

FIG. 15 shows the configuration of a cooling device capable of removing formed frost using predetermined data according to an embodiment of the present disclosure.

FIG. 16 shows the configuration of a cooling device of removing formed frost based on data sensed by a sensor according to an embodiment of the present disclosure.

FIG. 17A shows a graph of heating power over time in a typical defrost algorithm according to an embodiment of the present disclosure.

FIG. 17B shows a graph of driving power over time in the typical defrost algorithm according to an embodiment of the present disclosure.

FIG. 18A shows a graph related to the temperature and consumption power of a cooling device of removing frost through radiation and convection according to an embodiment of the present disclosure.

FIG. 18B shows a graph related to the temperature and consumption power of a cooling device of removing frost through thermal conductivity according to an embodiment of the present disclosure.

FIG. 19 is a flowchart schematically illustrating the typical defrost algorithm according to an embodiment of the present disclosure.

FIG. 20 is a flowchart illustrating an embodiment a of the typical defrost algorithm.

FIG. 21 is a flowchart illustrating an embodiment b of the typical defrost algorithm.

FIG. 22 is a flowchart illustrating an embodiment c of the typical defrost algorithm.

FIG. 23 is a view for describing the technical concept of a cooling device including a switch, according to an embodiment of the present disclosure.

FIG. 24 is a view for describing the technical concept of a cooling device including a switch, according to another embodiment of the present disclosure.

FIG. 25A shows a graph of heating power over time in the defrost algorithm of splitting refrigerant pipes according to an embodiment of the present disclosure.

FIG. 25B shows a graph of driving power over time in the defrost algorithm of splitting refrigerant pipes according to an embodiment of the present disclosure.

FIG. 26 is a flowchart illustrating an embodiment a of the defrost algorithm of splitting refrigerant pipes.

FIG. 27 is a flowchart illustrating an embodiment b of the defrost algorithm of splitting refrigerant pipes.

FIG. 28A shows a graph of heating power over time in the minute defrost algorithm according to an embodiment of the present disclosure.

FIG. 28B shows a graph of driving power over time in the minute defrost algorithm according to an embodiment of the present disclosure.

FIG. 29 is a flowchart illustrating an embodiment a of the minute defrost algorithm.

FIG. 30A is a flowchart illustrating an embodiment b of the minute defrost algorithm.

FIG. 30B is a flowchart illustrating an embodiment b of the minute defrost algorithm.

FIG. 31 shows the outer appearance of a refrigerator to which the cooling device is applied according to an embodiment of the present disclosure.

FIG. 32 shows the inside of the refrigerator to which the cooling device is applied according to an embodiment of the present disclosure.

BEST MODE

Hereinafter, embodiments of the present disclosure will be described in detail with reference to the appended drawings such that one of ordinary skill in the art can easily understand and embody the present disclosure. In the following description, well-known functions or constitutions will not be described in detail if they would unnecessarily obscure the embodiments of the present disclosure.

Further, terms used in embodiments as described below are defined in consideration of functions in the embodiments, and the meanings of the terms may vary depending on a user's or operator's intention or practice. Therefore, the terms used in the embodiments should be interpreted based on the definition in the specification, and unless specifically defined, the terms are interpreted as common meanings of the terminologies that one of ordinary skill in the art to which the present disclosure pertains understands.

Also, in the following description, aspects described optionally or configurations of embodiments described optionally must be construed as being able to be freely combined with each other, if not specified, although they are shown as a single integrated configuration in the drawings, unless the combination is clearly technical contradiction as determined by one of ordinary skill in the art.

Hereinafter, a cooling device and a control method thereof according to embodiments of the present disclosure will be described with reference to the accompanying drawings.

Hereinafter, a cooling device according to an embodiment of the present disclosure will be described with reference to FIGS. 1 to 4.

FIG. 1 is a view for describing the technical concept of a cooling device.

A cooling device 1 is an apparatus to discharge air having temperature that is different from that of inhaled air through heat exchange between the inhaled air and refrigerants.

More specifically, as shown in FIG. 1, refrigerants may flow into/out of the cooling device 1 through a refrigerant inlet/outlet port 270, and the refrigerants may be circulated along a plurality of refrigerant pipes 100 via a header 240. In the refrigerant pipes 100, the refrigerants may exchange heat with air around the refrigerant pipes 100. That is, a condenser may perform heat exchange between inhaled air and the refrigerants to change air to be exhausted to a high-temperature state and to change the refrigerants to a low-temperature state. In contrast, an evaporator may perform heat exchange between inhaled air and refrigerants to change air to be exhausted to a low-temperature state and to change the refrigerants to a high-temperature state.

Both the evaporator and the condenser mean a heat exchanger 10 to exchange heat between inhaled air and refrigerants.

In this case, the surface temperature of the evaporator may be lower than the temperature of the inhaled air so that moisture contained in the inhaled air may be condensed to form frost on the surface of the evaporator. In order to remove the formed frost, a separate heater may be provided to transfer heat to the frost through radiation or convection to melt the frost. However, heat transfer through radiation or convection among three kinds of heat transfer processes is not preferable since the heat transfer efficiency is low.

Accordingly, as shown in FIG. 1, the heat exchanger 10 may be implemented such that the refrigerant pipes 100 can themselves emit heat, without a separate heater.

More specifically, the refrigerant pipes 100 of the heat exchanger 10 may be tubes formed of a polymer material having high electric resistance, instead of aluminum (Al) having low electric resistance, so that if a power source 300 supplies power to the refrigerant pipes 100, the refrigerant pipes 100 themselves emit heat due to the high electric resistance, and the emitted heat is transferred to the formed frost through conductivity, thereby removing the frost.

Also, the refrigerant pipes 100 may be fabricated with a material having high thermal conductivity among polymer materials so as to efficiently perform heat exchange between inhaled air and refrigerants.

Also, an insulator film 150 may be formed on the surfaces of the refrigerant pipes 100 in order to prevent surface current from leaking between the adjacent refrigerant pipes 100.

The insulator film 150 may be formed on the surfaces of the refrigerant pipes 100 contacting air, except for both ends of the refrigerant pipes 100. Also, the insulator film 150 may be formed of epoxy, Teflon, or silicon having high insulating properties. Alternatively, the insulator film 150 may be formed of partlene (partlene type-c, 5.6 kV, 24.5 um, 2.8 cc·min/m^2·day·atm). Also, the insulator film 15 may be formed of one of various materials that can be formed on the surfaces of the refrigerant pipes 100 to prevent surface current of the refrigerant pipes 100 from leaking out.

The refrigerant pipes 100, a connection member 200, and the power source 300 will be described in detail with reference to FIGS. 2 to 14B, below.

FIG. 2 is a block diagram showing the configuration of a cooling device, and FIG. 3 shows the outer appearance of the cooling device.

The cooling device 1 may be an apparatus to change the temperature of air to be exhausted through heat exchange between inhaled air and refrigerants to thereby lower the inside temperature of a refrigerator, and may include the heat exchanger 10, the connection member 200, the power source 300, memory 500, a timer 650, a sensor 600, a controller 400, a switch 280, a compressor 700, an input device 730, a display 760, and a communication device 800. Also, the above-mentioned components may be connected to each other through a bus 900.

The heat exchanger 10 may be an apparatus to perform heat exchange between inhaled air and refrigerants, and may include an evaporator to lower the temperature of inhaled air, and a condenser to raise the temperature of inhaled air. In addition, the heat exchanger 10 may include the refrigerant pipes 100.

The refrigerant pipes 100 may be configured by arranging a plurality of polymer tubes each having a cylindrical shape in parallel, as shown in FIG. 3.

The refrigerant pipes 100 will be described in detail with reference to FIG. 4, later.

The connection member 200, for example a connection member 200*a*, a connection member 200*b* as shown in FIG. 3 may be an apparatus to electrically connect the refrigerant pipes 100 to the power source 200 to provide a fixing force for fixing the refrigerant pipes 100, and may include a header 240, for example a header 240*a*, a header 240*b* as shown in FIG. 3, a cap 260, for example a cap 260*a*, a cap 260*b* as shown in FIG. 3, the refrigerant inlet/outlet port 270, a connection film 225 as shown in FIG. 9, and a Flexible Printed Circuit Board (FPCB) 220 as shown in FIG. 9.

As shown in FIG. 3, two connection members 200 may be disposed respectively at both ends of the refrigerant pipes 100, wherein the FPCB 220 may be positioned on the inner surface of each connection member 200, the header 240 may be positioned on the outer portion of the FPCB 220, and the cap 260 may be coupled with the outer surface of the header 240. Also, two refrigerant inlet/outlet ports 270 may be respectively disposed in the upper and lower outer surfaces of one header 240 of two headers 240 disposed at both ends of the refrigerant pipes 100.

The connection member 200 will be described in detail with reference to FIGS. 5A to 14B, later.

The power source 300 may supply power required for driving of the compressor 700, self-heating of the refrigerant pipes 100, and additional driving of the cooling device 1. Also, heating power supplied to the refrigerant pipes 100 by the power source 300 may be in the form of Direct Current (DC), Alternating Current (AC), or DC pulses. Accordingly, the power source 300 may include a single-phase grid power source 310, a DC link power source 320, and an inverter 330 according to the form of heating power which it supplies.

Herein, the heating power may be power that is supplied to the refrigerant pipes 100 for self-heating of the refrigerant pipes 100. The heating power may be a predetermined value or a value decided based on data sensed through the sensor 600, which will be described later. Also, driving power may be power that is supplied for driving the compressor 700. The driving power may be a predetermined value or a value decided based on data sensed through the sensor 600, which will be described later.

The single-phase grid power source 310 may be a power source to provide AC power to the refrigerant pipes 100 and the DC link power source 320.

More specifically, the single-phase grid power source 310 may receive power from an external device, and supply heating power in the form of AC to the refrigerant pipes 100. For example, the single-phase grid power source 310 may supply AC power of 200V, 50 Hz received from an external device, as heating power, to the refrigerant pipes 100.

Also, the single-phase grid power source 310 may receive power from an external device, and transfer the received power to the DC link power source 320 so that the DC link power source 320 can generate power in the form of DC.

The DC link power source 320 may generate power in the form of DC to supply heating power to the refrigerant pipes 100 or to supply power for additional driving of the cooling device 1.

More specifically, the DC link power source 320 may convert AC power received from the single-phase grid power source 320 into DC power to supply heating power to the refrigerant pipes 100, or may convert, like a battery, chemical energy into electrical energy to supply heating power to the refrigerant pipes 100.

Also, the DC link power source 320 may convert AC power received from the single-phase grid power source 310 into DC power to provide electrical energy required for driving the inverter 330, or may convert, like a battery, chemical energy into electrical energy to provide electrical energy required for driving the inverter 330.

The inverter 330 may generate square waves in the form of DC pulses to supply the square waves as power for driving or heating to the compressor 700 or the refrigerant pipes 100.

More specifically, the inverter 330 may include an upper switching circuit connected to DC power of the DC link power source 320, and a lower switching circuit connected to the ground. Also, the upper switching circuit may be one-to-one connected in series to the lower switching circuit, and a node connecting the upper switching circuit to the lower switching circuit may become an output terminal of the inverter 330.

The upper switching circuit and the lower switching circuit of the inverter 330 may include a high voltage switch, such as a high voltage bipolar junction transistor, a high voltage field effect transistor, or an Insulated Gate Bipolar Transistor (IGBT), and a free wheeling diode.

The memory 500 may store an amount of frost formed on the refrigerant pipes 100, sensed by the sensor 600, the distribution of the amount of frost formed on the plurality of refrigerant pipes 100, control data of the controller 400, input data of the input device 730, communication data of the communication device 800, etc.

Also, the memory 500 may store defrost data 510.

The timer 650 may measure an execution time period of current operation, load an execution time period required for the current operation from the memory 500, and compare the measured execution time period to the loaded execution time period to determine whether to perform the next operation.

The memory 500 and the timer 650 will be described in detail with reference to FIG. 15, later.

The sensor 600 may sense an amount of frost formed on the refrigerant pipes 100, the temperature and pressure of refrigerants inside the refrigerant pipes 100, the magnitude of power supplied to the compressor 700 or the refrigerant pipes 100, the inside temperature and humidity of the refrigerator, etc.

Also, the sensor 600 may provide sensed data about the state of the cooling device 1 to the controller 400 to provide a feedback so that the controller 400 can control operation that is to be performed, based on the sensed data.

The controller 400 may transfer control signals to internal configurations in order to perform the operation of the cooling device 1.

More specifically, the controller 400 may determine whether to supply heating power to the refrigerant pipes 100, decide a magnitude of heating power to be supplied and a supply time period of the heating power, or determine whether to perform a minute defrost algorithm, based on the amount of frost formed on the refrigerant pipe 100, sensed by the sensor 600. Also, the controller 400 may include a main controller 430 and a defrost controller 460.

The sensor 600 and the controller 400 will be described in detail with reference to FIG. 16, later.

When a defrost algorithm of splitting the refrigerant pipes 100 is performed, the switch 280 may be switched on/off between the plurality of refrigerant pipes 100.

More specifically, the switch 280 may be disposed between the power source 300 and the connection members 200 disposed at both ends of the refrigerant pipes 100 to connect a plurality of switch elements in series or in parallel, or to change a connection pattern of the refrigerant pipes 100 divided into a plurality of different groups so that heating power is supplied to the individual groups.

The switch 280 will be described in detail with reference to FIGS. 22 and 23, later.

The compressor 700 may compress refrigerants in a gaseous state that is to be transferred to the condenser to condense the refrigerants to a liquid state, and may compress refrigerants vaporized to a gaseous state from a liquid state through the evaporator to condense the refrigerants to a liquid state. Also, the compressor 700 may receive driving power from the power source 300 to compress the refrigerants.

The input device 730 may be a combination of a plurality of manipulation buttons for selecting operation of the cooling device 1. The input device 730 may be a push button that can be pressed, a slide switch of selecting operation of the cooling device 1, a touch screen, a type of recognizing a user's voice signal to select operation of the cooling device 1, a keyboard, a trackball, a mouse, or a joystick. Also, the input device 730 may be one of various methods of converting a user' command into an input signal.

The display 760 may display the controlled state of the cooling device 1 controlled by the controller 400, the operation state of the cooling device 1 sensed by the sensor 600, etc., visibly, audibly, or tactually for a user.

For example, the display 760 may be a display, a speaker, or a vibration motor.

The communication device 800 may be connected to a network 840 in a wired/wireless fashion to communicate with another home appliance 880 or a server 850. The communication device 800 may transmit/receive data to/from the server 850 or the other home appliance 880 connected through a home server. Also, the communication device 800 may perform data communication according to the standard of the home server.

The communication device 800 may transmit/receive data related to remote control through the network 840, and transmit/receive operation of the other home appliance 880 through the network 840. Furthermore, the communication device 800 may receive information about the user's life pattern from the server 850 to use the information about the user's life pattern for operation of the cooling device 1. Furthermore, the communication device 800 may perform data communication with the user's mobile terminal 860, as well as the server 850 or a remote controller 870 in home.

The communication device 800 may be connected to the network 840 in a wired/wireless fashion to transmit/receive data to/from the server 850, the remote controller 870, the mobile terminal 860, or the other home appliance 880. The communication device 800 may include one or more components to communicate with the other home appliance 880. For example, the communication device 800 may include a short-range communication module 810, a wired communication module 820, and a mobile communication module 830.

The short-range communication module 810 may be a module for short-range communication at a short distance. Short-range communication technology may be Wireless Local Area Network (WLAN), Wireless-Fidelity (Wi-Fi), Bluetooth, Zigbee, Wi-Fi Direct (WFD), Ultra Wideband (UWB), Infrared Data Association (IrDA), Bluetooth Low Energy (BLE), Near Field Communication (NFC), etc., although not limited to these.

The wired communication module 820 may be a module for communication using electrical or optical signals. Wired communication technology may be a pair cable, a coaxial cable, an optical fiber cable, an Ethernet cable, etc., although not limited to these.

The mobile communication module 830 may transmit/receive radio signals to/from at least one of a base station, an external terminal, and a server on a mobile communication network. The radio signals may include various formats of data according to the transmission/reception of voice call signals, video call signals, or text/multimedia messages.

FIG. 4 shows the outer appearance of a refrigerant pipe.

If heating power is supplied to both ends of the refrigerant pipes 100, the refrigerant pipes 100 may themselves emit heat by their own resistance heat according to the heating power.

More specifically, the refrigerant pipes 100 may be formed of a material having electrical conductivity and high electric resistance, and if heating power is supplied to both ends of the refrigerant pipes 100, the refrigerant pipes 100 may themselves emit heat due to high electric resistance.

In order for the refrigerant pipes 100 to have high electric resistance in addition to electrical conductivity, the refrigerant pipes 100 may include a polymer material, and a carbon allotrope.

For example, the refrigerant pipes 100 may include a polymer material, and also include graphite, carbon, carbon nanotube, and Carbon Fiber Reinforced Plastics (CFRP), as filler. Thereby, the electrical conductivity of the refrigerant pipes 100 can increase.

Also, the refrigerant pipes 100 may be formed of a material having high thermal conductivity in order to efficiently cause heat exchange between inhaled air and refrigerants, and may be formed in the shape of a circular cylinder capable of maximizing the surface area between inhaled air and refrigerants.

According to another embodiment, the sections of both ends of each refrigerant pipe 100 may be in the shape of an ellipse so that the refrigerant pipe 100 can be connected to and fixed at the connection member 200. If the sections of both ends of each refrigerant pipe 100 are in the shape of an ellipse, the section of the refrigerant pipe 100 may be narrowed by Beroulli's law so that the flow velocities of refrigerants flowing into the refrigerant pipe 100 and refrigerants flowing out of the refrigerant pipe 100 increase. As a result, the flow of refrigerants in the refrigerant pipes 100 can have high efficiency.

Also, the refrigerant pipes 100 may have one of various shapes capable of increasing the efficiency of heat exchange between inhaled air and refrigerants, and increasing the flow efficiency of refrigerants.

Also, the refrigerant pipes 100 may be formed by extruding or injection-molding a shape for increasing the efficiency of heat exchange and the flow efficiency of refrigerants as described above.

The cooling device 1 may include the plurality of refrigerant pipes 100.

The plurality of refrigerant pipes 100 may have the same resistance value or different resistance values.

More specifically, if the plurality of refrigerant pipes 100 have different resistance values, the plurality of refrigerant pipes 100 may be arranged such that consumption power of the refrigerant pipes 100 (also, referred to as inlet side refrigerant pipes 100) located close to the inlet side is greater than consumption power of the refrigerant pipes 100 (also, referred to as outlet side refrigerant pipes 100) located close to the outlet side, since the formation probability of frost on the inlet side refrigerant pipes 100 is higher than the formation probability of frost on the outlet side refrigerant pipes 100 due to high air humidity around the inlet side.

For example, the refrigerant pipes 100 may be arranged such that consumption power of the refrigerant pipes 100 is reduced to predetermined consumption power levels in order from the inlet side refrigerant pipes 100 to the outlet side refrigerant pipes 100. That is, if the refrigerant pipes 100 are arranged to have four different consumption power levels, the refrigerant pipes 100 may be arranged to consume power of 400 W, 300 W, 200 W, and 100 W in order from the inlet side refrigerant pipes 100 to the outlet side refrigerant pipes 100.

Also, if the plurality of refrigerant pipes 100 are connected in parallel, the plurality of refrigerant pipes 100 may be arranged such that the electric resistance of the inlet side refrigerant pipes 100 is smaller than that of the outlet side refrigerant pipes 100. That is, the refrigerant pipes 100 having the lower electric resistance may be disposed closer to the inlet side so that the inlet side refrigerant pipes 100 have higher consumption power by P=V^2/R.

For example, if the plurality of refrigerant pipes 100 are connected in parallel, the plurality of refrigerant pipes 100 may be arranged such that the resistance values of the refrigerant pipes 100 increase to predetermined resistance values in order from the inlet side refrigerant pipes 100 to the outlet side refrigerant pipes 100. That is, if the refrigerant pipes 100 are arranged to have three different electric resistance values, the refrigerant pipes 100 may be arranged to have electric resistance values of 150Ω, 200Ω, and 250Ω in order from the inlet side refrigerant pipes 100 to the outlet side refrigerant pipes 100.

In contrast, if the plurality of refrigerant pipes 100 are connected in series, the plurality of refrigerant pipes 100 may be arranged such that the electric resistance of the inlet side refrigerant pipes 100 is greater than that of the outlet side refrigerant pipes 100. That is, the refrigerant pipes 100 having the higher electric resistance may be disposed closer to the inlet side such that the inlet side refrigerant pipes 100 have higher consumption power by P=I^2*R.

For example, if the plurality of refrigerant pipes 100 are connected in series, the plurality of refrigerant pipes 100 may be arranged such that the resistance values of the refrigerant pipes 100 are reduced to predetermined resistance values in order from the inlet side refrigerant pipes 100 to the outlet side refrigerant pipes 100. That is, if the refrigerant pipes 100 are arranged to have three different electric resistance values, the refrigerant pipes 100 may be arranged such that the refrigerant pipes 100 have electric resistance values of 150Ω, 100Ω, and 50Ω in order from the inlet side refrigerant pipes 100 to the outlet side refrigerant pipes 100.

Also, in the cooling device 1 that performs a defrost algorithm of splitting the refrigerant pipes 100 through the switch 280, the refrigerant pipes 100 may be arranged such that power consumed by self-heating the inlet side refrigerant pipes 100 is equal to power consumed by self-heating all of the refrigerant pipes 100 according to a typical defrost algorithm.

For example, it is assumed that the number of the refrigerant pipes 100 disposed in the cooling device 1 is 54, and the resistance value of each of the refrigerant pipes 100 connected in parallel to each other is 150Ω. In this case, if a defrost algorithm of splitting the refrigerant pipes 100 to two groups is performed, the resistance value of each of the 27 inlet side refrigerant pipes 100 may be reduced to 75Ω such that consumption power is equal to power consumed in the case of self-heating the 54 refrigerant pipes 100 according to the typical defrost algorithm.

Hereinafter, an embodiment of the connection member 200 will be described with reference to FIGS. 5A to 14B.

FIG. 5A shows the outer appearance of one side of a connection member, and FIG. 5B shows the outer appearance of the other side of the connection member.

As shown in FIGS. 5A and 5B, the connection member 200 may include the header 240, the cap 260, the refrigerant inlet/outlet port 270, and the FPCB 220.

The header 240 may enable compressed refrigerants received from the compressor 700 to flow into a refrigerant pipe 100, and guide refrigerants flowing out of the refrigerant pipe 100 to enter another refrigerant pipe 100.

The header 240 will be described in detail with reference to FIGS. 6A and 6B, later.

The cap 260 may be disposed in the outer surface of the header 240, which is opposite to the inner surface of the header 240 with which the refrigerant pipes 100 are coupled, so as to block the outer surface of the header 240 to prevent refrigerants flowing into the header 240 from leaking out.

The cap 260 will be described in detail with reference to FIGS. 7A and 7B, later.

The refrigerant inlet/outlet port 270 may enable refrigerants in a liquid state compressed by the compressor 700 to flow into the header 240, and enable refrigerants in a gaseous state evaporated through heat exchange with inhaled air to flow out of the header 240.

The refrigerant inlet/outlet port 270 will be described in detail with reference to FIGS. 8A and 8B, later.

The FPCB 220 may be electrified with the refrigerant pipes 100 having electrical conductivity to thus function as a connector so that the power source 300 can supply heating power to the refrigerant pipes 100.

The FPCB 220 will be described in detail with reference to FIGS. 9 to 13B, later.

FIG. 6A shows the outer appearance of a surface of a header, FIG. 6B shows the outer appearance of the other surface of the header, FIG. 6C shows the outer appearance of a surface of another header, and FIG. 6D shows the outer appearance of the other surface of the other header.

The header 240 may enable refrigerants to flow into a refrigerant pipe 100, and enable refrigerants flowing out of the refrigerant pipe 100 to enter another refrigerant pipe 100.

Two headers 240 having different shapes may be respectively disposed at both ends of the refrigerant pipes 100. The headers 240 may include a first header 240*a* and a second header 240*b*.

The first header 240*a* may include, as shown in FIGS. 6A and 6B, a refrigerant guide 241, an insertion hole 242, a first support hole 243*a*, a cap support 244, a refrigerant inlet/outlet guide 245, a refrigerant inlet/outlet support 246, and a second support hole 247.

The refrigerant guide 241 may enable refrigerants entered through the refrigerant inlet/outlet guide 245 to flow into a refrigerant pipe 100, and enable refrigerants flowing out of the refrigerant pipe 100 to flow into another refrigerant pipe 100.

Also, the refrigerant guide 241 may guide refrigerants to flow into/out of a plurality of refrigerant pipes 100 grouped into the same group in parallel. More specifically, as shown in FIGS. 6A and 6B, a single refrigerant guide 241 may guide refrigerants to flow into 8 refrigerant pipes 100 grouped into one group in parallel, and may be connected in series to another refrigerant guide 241 to guide refrigerants flowing out of the 8 refrigerant pipes 100 to flow into 8 refrigerant pipes 100 connected to another refrigerant guide 241.

The insertion hole 242 may be formed in the shape of a circle or ellipse in the inner portion of the refrigerant guide 241 to function as an inlet for allowing refrigerants to flow into the refrigerant pipes 100 or as an outlet for allowing refrigerants in the refrigerant pipes 100 to flow to the refrigerant guide 241. For example, as shown in FIGS. 6A and 6B, 8 insertion holes 242 may be formed in each refrigerant guide 241, and the refrigerant pipes 100 may be connected to the insertion holes 242.

A plurality of first support holes 243 may be formed in the longitudinal edges of the header 240 so that support members such as bolts can be inserted into the first support holes 243 to fix or support the FPCB 220 or the connection film 225 disposed on the other surface of the header 240*a*. Also, the support members such as bolts which are coupled with the first support holes 243 may supply heating power to the connection film 225 through a via 223 of the FPCB 220.

The cap support 244 may be formed in the inner side wall of the refrigerant guide 241 to fix the cap 260 covering the refrigerant guide 241. More specifically, as shown in FIG. 6A, a plurality of cap supports 244 may be arranged in the inner side wall of each refrigerant guide 241 in such a way to face each other, and also, each cap support 244 may have a step to prevent the cap 260 from being inserted into the refrigerant guide 241 to a predetermined depth or more.

Also, the cap support 244 may be, as shown in FIG. 6A, formed in the shape of a pillar having a section of a semicircle. However, the cap support 244 may be formed in the shape of a pillar having a section of a triangle, a quadrangle, or a polygon.

The refrigerant inlet/outlet guide 245 may guide refrigerants entered the header 240 through the refrigerant inlet/outlet port 270 to flow into the refrigerant pipes 100, and guide refrigerants required to be compressed after heat exchange with inhaled air to be transferred to the refrigerant inlet/outlet port 270 from the refrigerant pipes 100. Also, in the inner portion of the refrigerant inlet/outlet guide 245, the insertion holes 242 may be formed so that the refrigerant inlet/outlet guide 245 is connected to the refrigerant pipes 100, as shown in FIG. 6A.

The refrigerant inlet/outlet support 246 may be disposed on the inner side wall of the refrigerant inlet/outlet guide 245 to fix the refrigerant inlet/outlet port 270 covering the refrigerant inlet/outlet guide 245. More specifically, as shown in FIG. 6A, the refrigerant inlet/outlet support 246 may be disposed on the inner side wall of the refrigerant inlet/outlet guide 245 in such a way to face each other, and also, each refrigerant inlet/outlet support 246 may have a step to prevent the refrigerant inlet/outlet port 270 from being inserted into the refrigerant inlet/outlet guide 245 to a predetermined depth or more.

Also, the refrigerant inlet/outlet support 246 may be, like the cap support 244, formed in the shape of a pillar having a section of a semicircle. However, the refrigerant inlet/outlet support 246 may be formed in the shape of a pillar having a section of a triangle, a quadrangle, or a polygon.

A plurality of second support holes 247 may be formed at both the longitudinal edges of the header 240 so that support members such as bolts can be inserted into the second support holes 247 to fix or support the heat exchanger 10 at the housing or bracket of the cooling device 1.

The second header 240*b* may include, as shown in FIGS. 6C and 6D, a refrigerant guide 241, an insertion hole 242, a first support hole 243*a*, and a cap support 244.

The refrigerant guide 241, the insertion hole 242, the first support hole 243*a*, and the cap support 244 included in the second header 240*b* may be the same as or different from the refrigerant guide 241, the insertion hole 242, the first support hole 243*a*, and the cap support 244 included in the first header 240*a*.

FIG. 7A shows the outer appearance of one side of a cap, and FIG. 7B shows the outer appearance of the other side of the cap.

The cap 260 may be inserted into the refrigerant guide 241 to shield refrigerants in the refrigerant guide 241 from the outside.

Also, the cap 260 may be disposed to correspond to the refrigerant guide 241, and may include a first cap partition wall 261 and a second cap partition wall 262 to double shield the refrigerant guide 241 from the outside. Also, the cap 260 may be coupled with the refrigerant guide 241 such that the first cap partition wall 261 contacts the cap support 244 inside the refrigerant guide 241.

FIG. 8A shows the outer appearance of one side of a refrigerant inlet/outlet port, and FIG. 8B shows the outer appearance of the other side of the refrigerant inlet/outlet port.

The refrigerant inlet/outlet port 270 may be formed in the upper and lower portions of the header 240. The refrigerant inlet/outlet port 270 may function as a passage to enable refrigerants in a liquid state transferred from the compressor 700 to flow into the header 240, and to enable refrigerants in a gaseous state evaporated through heat exchange with inhaled air to flow out of the header 240.

More specifically, the refrigerant inlet/outlet port 270 may include a refrigerant inlet/outlet tube 272 formed in the shape of a cylinder to provide a passage through which refrigerants flow, a refrigerant inlet/outlet hole 271 which is formed in the inside of the refrigerant inlet/outlet tube 272 and through which refrigerants flow, the refrigerant inlet/outlet guide 245 formed in the side wall of the refrigerant inlet/outlet port 270 and connected to the refrigerant inlet/outlet port 270, and a first refrigerant inlet/outlet partition wall 273 and a second refrigerant inlet/outlet partition wall 274 to double shield refrigerants from the outside.

Also, the refrigerant inlet/outlet hole 271 can increase the velocity of refrigerants flowing thereinto by Beroulli's law since the diameter of the inner portion located close to the refrigerant inlet/outlet guide 245 is smaller than that of the outer portion. Accordingly, refrigerants can more efficiently flow into the header 240.

FIG. 9 shows the outer appearance of a FPCB and a connection film.

The FPCB 220 may connect the refrigerant pipes 100 to the power source 300 to function as a connector so that the power source 300 can supply heating power to the refrigerant pipe 100, and also the FPCB 220 may provide a fixing force for fixing the refrigerant pipes 100 due to its flexibility and elasticity.

More specifically, the FPCP 220 may include an insulating substrate 221, a plurality of vias 223, and a plurality of connection films 225.

The insulating substrate 221 may insulate the plurality of connection films 225 from each other to prevent the plurality of connection films 225 from being shorted, while preventing heating power supplied to the connection films 225 from leaking out. Also, the insulating substrate 221 may be formed to correspond to the shape of the inner surface of the header 240, and may include a material having flexibility and elasticity. For example, the insulating substrate 221 may include a heat-tolerant plastic film having flexibility and elasticity, such as polyethylene terephthalate (PET) or polyimide (PI).

The vias 223 may be coupled with the first support holes 243 of the header 240 through support members such as bolts so that the FPCB 220 can be coupled with the inner surface of the header 240. Also, the vias 223 may provide passages through which the power source 300 is connected to a support member having electrical conductivity to supply heating power to the connection films 225. Also, the inner diameter of the vias 223 may be decided by the inner diameter of the first support holes 243 and the outer diameter of the support members inserted into the first support holes 243, and the vias 223 may be preferably in the shape of a circle.

The connection films 225 may be disposed on one surface or both surfaces of the insulating substrate 221. Also, if the connection films 225 are disposed on both surfaces of the insulating substrate 221, the connection films 225 may be coated on the inner side surfaces of connection holes so that the connection films 225 disposed on both the surfaces of the insulating substrate 221 can be electrified with each other.

Also, the connection films 225 may be formed of a material having low electric resistance and high electrical conductivity so that the power source 300 supplies heating power through the support members coupled with the vias 223. For example, the connection films 225 may be formed of copper. Also, the connection films 225 may be formed of various materials having low electric resistance and high electrical conductivity so that the power source 300 can supply heating power.

Also, the connection films 225 may have a pattern in which a plurality of connection films 225 connected to a plurality of refrigerant pipes 100 grouped into the same group can be electrically connected to each other to supply the same heating power to the plurality of refrigerant pipes 100.

For example, as shown in FIGS. 6A and 6B, if 8 refrigerant pipes 100 are grouped into one group, 8 connection films 225 corresponding to the 8 refrigerant pipes 100 may be electrically connected to each other. Also, various combinations of the connection films 225 are possible.

Hereinafter, a FPCB and a connection film according to an embodiment of the present disclosure will be described with reference to FIGS. 10A to 13B.

FIG. 10A is an enlarged view showing the outer appearance of a FPCB and a connection film according to a first embodiment of the present disclosure before they are fixed, and FIG. 10B is an enlarged view showing the outer appearance of the FPCB and the connection film according to the first embodiment of the present disclosure after they are fixed.

As shown in FIGS. 10A and 10B, a FPCB 220*a* according to a first embodiment of the present disclosure on which a connection film 225*a* is connected to and fixed at the refrigerant pipe 100 may include a fixing arm 226*a*, a before-fixing refrigerant pipe resting portion 228*a*, an after-fixing refrigerant pipe resting portion 227*a*, and a connection hole 229*a*.

The fixing arm 226*a* may be formed in the left, upper area of the connection hole 229*a* in such a way to be curved, and below the fixing arm 226*a*, the before-fixing refrigerant pipe resting portion 228*a* may be formed to provide space where the refrigerant pipe 100 is positioned before it is fixed at the FPCB 220.

The FPCB 220*a* may be fabricated by extrusion or injection-molding, unlike the header 240 fabricated by a mold, and accordingly, tolerance may be generated between the refrigerant pipe resting portions and the refrigerant pipe 100. Accordingly, a separate fixing device may be required so that the fixing arm 226*a* having elasticity and flexibility functions to connect the refrigerant pipe 100 to the FPCB 220*a* and fix the refrigerant pipe 100 at the FPCB 220*a*.

More specifically, as shown in FIG. 10A, the refrigerant pipe 100 may be rested on the before-fixing refrigerant pipe resting portion 228*a*, and then the FPCB 220*a* may be pushed to the left to fix the refrigerant pipe 100 at the FPCB 220*a*, as shown in FIG. 10B. Accordingly, as shown in FIG. 10B, the refrigerant pipe 100 may be fixed by the elasticity and flexibility of the fixing arm 226*a*. Also, through the lateral connection of the connection hole 229*a*, a plurality of contacts 224*a* (also, referred to as a first contact 224*a*1, a second contact 224*a*2, and a third contact 224*a*3) may be made so that the connection film 225*a* is electrified with the refrigerant pipe 100. More specifically, a scratch made on the surface of the refrigerant pipe 100 by pushing the FPCB 220*a* to the left may contact the first contact 224*a*1, the second contact 224*a*2, and the third contact 224*a*3 to thereby electrically connect the refrigerant pipe 100 to the connection film 225*a* and to mechanically fix the refrigerant pipe 100 at the fixing arm 226*a*.

FIG. 11A is an enlarged view showing the outer appearance of a FPCB and a connection film according to a second embodiment of the present disclosure before they are fixed, and FIG. 11B is an enlarged view showing the outer appearance of the FPCB and the connection film according to the second embodiment of the present disclosure after they are fixed.

As shown in FIGS. 11A and 11B, a FPCB 220*b* according to a second embodiment of the present disclosure on which a connection film 225*b* is connected to and fixed at the refrigerant pipe 100 may include a first fixing arm 226*b*1, a second fixing arm 226*b*2, and a connection hole 229*b*.

The first fixing arm 226*b*1 may be formed in the left, upper area of the connection hole 229*b* in such a way to be curved, and the second fixing arm 226*b*2 may be formed in the left, lower area of the connection hole 229*b* in such a way to be curved. Also, a refrigerant pipe resting portion may be formed between the first fixing arm 226*b*1 and the second fixing arm 226*b*2 to provide space where the refrigerant pipe 100 is positioned before it is fixed at the FPCB 220*b*.

The FPCB 220*b* may be fabricated by extrusion or injection-molding, unlike the header 240 fabricated by a mold, and accordingly, tolerance may be generated between the refrigerant pipe resting portion and the refrigerant pipe 100. Accordingly, a separate fixing device may be required so that the first and second fixing arms 226*b*1 and 226*b*2 having elasticity and flexibility function to connect the refrigerant pipe 100 to the FPCB 220*b* and fix the refrigerant pipe 100 at the FPCB 220*b*.

More specifically, as shown in FIG. 11A, the refrigerant pipe 100 may be rested between the first fixing arm 226*b*1 and the second fixing arm 226*b*2, and then, the FPCB 220*b* may be pushed to the left to fix the refrigerant pipe 100 at the FPCB 220*b*, as shown in FIG. 11B. Accordingly, as shown in FIG. 11B, the refrigerant pipe 100 may be fixed by the elasticity and flexibility of the first and second fixing arms 226*b*1 and 226*b*2. Also, through the lateral connection of the connection hole 229*a*, a plurality of contacts 224*b* (also referred to as a first contact 224*b*1, a second contact 224*b*2, a third contact 224*b*3, and a fourth contact 224*b*4) may be made so that the connection film 225*b* is electrified with the refrigerant pipe 100. More specifically, a scratch made on the surface of the refrigerant pipe 100 by pushing the FPCB 220*b* to the left may contact the first contact 224*b*1, the second contact 224*b*2, the third contact 224*b*3, and the fourth contact 224*b*4 to thereby electrically connect the refrigerant pipe 100 to the connection film 225*b* and to mechanically fix the refrigerant pipe 100 at the fixing arm 226*b*.

FIG. 12A is an enlarged view showing the outer appearance of a FPCB and a connection film according to a third embodiment of the present disclosure before they are fixed, and FIG. 12B is an enlarged view showing the outer appearance of the FPCB and the connection film according to the third embodiment of the present disclosure after they are fixed.

As shown in FIGS. 12A and 12B, a FPCB 220*c* according to a third embodiment of the present disclosure on which a connection film 225*c* is connected to and fixed at the refrigerant pipe 100 may include a fixing arm 226*c*, a first refrigerant pipe resting portion 224*c*1, a second refrigerant pipe resting portion 224*c*2, and a connection hole 229*c*.

The fixing arm 226*c* may be formed in the left, upper area of the connection hole 229*c* in such a way to be curved. Also, below the fixing arm 226*c*, the first and second refrigerant pipe resting portions 224*c*1 and 224*c*2 may be formed to provide space where the refrigerant pipe 100 is positioned before it is fixed at the FPCB 220*c*.

The FPCB 220*c* may be fabricated by extrusion or injection-molding, unlike the header 240 fabricated by a mold, and accordingly, tolerance may be generated between the first and second refrigerant pipe resting portions 224*c*1 and 224*c*2 and the refrigerant pipe 100. Accordingly, a separate fixing device may be required so that the fixing arm 226*c* having elasticity and flexibility functions to connect the refrigerant pipe 100 to the FPCB 220*c* and fix the refrigerant pipe 100 at the FPCB 220*c*.

More specifically, as shown in FIG. 12A, the refrigerant pipe 100 may be rested below the fixing arm 226*c*, and then the refrigerant pipe 100 may be rotated by 90 degrees to rest the refrigerant pipe 100 on the first refrigerant pipe resting portion 224*c*1 and the second refrigerant pipe resting portion 224*c*2 to thereby fix the refrigerant pipe 100 at the FPCB 220*c*, as shown in FIG. 12B. Accordingly, as shown in FIG. 12B, the refrigerant pipe 100 may be fixed by the elasticity and flexibility of the fixing arm 226*c*. Also, through the lateral connection of the connection hole 229*c*, a plurality of contacts 224*c* (also referred to as a first contact 224*c*1 and a second contact 224*c*2) may be made so that the connection film 225*c* is electrified with the refrigerant pipe 100. More specifically, a scratch made on the surface of the refrigerant pipe 100 by rotating the refrigerant pipe 100 by 90 degrees may contact the first contact 224*c*1 and the second contact 224*c*2 to thereby electrically connect the refrigerant pipe 100 to the connection film 225*c* and to mechanically fix the refrigerant pipe 100 at the fixing arm 226*c*.

FIG. 13A is an enlarged view showing the outer appearance of a FPCB and a connection film according to a fourth embodiment of the present disclosure before they are fixed, and FIG. 13B is an enlarged view showing the outer appearance of the FPCB and the connection film according to the fourth embodiment of the present disclosure after they are fixed.

As shown in FIGS. 13A and 13B, a FPCB 220*d* according to a fourth embodiment of the present disclosure on which a connection film 225*d* is connected to and fixed at the refrigerant pipe 100 may include a bump 226*d*, a refrigerant pipe resting portion 227*d*, and a connection hole 229*d*.

The connection hole 229*d* may be in the shape of a quadrangle having a chamfered, curved corner at the left lower part. Also, the chamfered, curved corner may become the refrigerant pipe resting portion 227*d* after the refrigerant pipe 100 is fixed.

According to the fourth embodiment, the FPCB 220*d* may be pushed toward the right-up direction until the bump 226*d* is positioned between the refrigerant pipe resting portion 227*b* and the refrigerant pipe 100, and then heat that is higher than the melting point of the bump 226*d* may be applied to the bump 226*d* to make a contact by the lateral connection of the connection hole 229*d* through bonding with the bump 226*d*. In this case, the bonding with the bump 226*d* may be soldering. That is, the bump 226*d* having electrical conductivity may electrically connect the refrigerant pipe 100 to the connection film 225*d*, and if the temperature of the bump 226*d* is lowered below the solidifying point of the bump 226*d*, the bump 226*d* may be solidified so that the refrigerant pipe 100 can be mechanically fixed at the FPCB 220.

Hereinafter, a header and a connection film according to an embodiment of the present disclosure will be described with reference to FIGS. 14A and 14B.

FIG. 14A is an exploded perspective view showing the outer appearance of a header and a connection film according to an embodiment of the present disclosure, and FIG. 14B is an exploded perspective view showing the outer appearance of a header and a connection film according to another embodiment of the present disclosure.

As shown in FIGS. 14A and 14B, the connection member 200 may include no FPCB 220, wherein a connection film having high electrical conductivity may be coated on the insertion hole 242 of the header 240.

The header 240 may be fabricated by a mold, unlike the FPCB 220 fabricated by extrusion or injection-molding, and accordingly, tolerance between the insertion hole 242 of the header 240 and the refrigerant pipe 100 may be small. That is, unlike the connection member 200 including the FPCB 220, no separate fixing member may be required.

Accordingly, the connection member 200 including no FPCB 220 may be configured by coating the connection film 225 on the insertion hole 242 of the header 240, inserting the refrigerant pipe 100 into the insertion hole 242 to mechanically fix the refrigerant pipe 100 at the header 240, and electrically connecting the refrigerant pipe 100 to the connection film 225 through lateral connection.

Also, in order to ensure electrical or mechanical reliability, after the refrigerant pipe 100 is inserted into the insertion hole 242, the refrigerant pipe 100 may be connected to and fixed at the connection film 225 through bump bonding.

Also, in this case, the shapes of the insertion hole 242 and the connection film 225 of the header 240 may be the same as those of the connection hole and the connection film 225 of the FPCB 220, as shown in FIG. 14A, or may be the same as that of the refrigerant pipe 100, as shown in FIG. 14B.

The configuration of the cooling device 1 according to an embodiment of the present disclosure has been described above.

Hereinafter, the operation of the cooling device 1 according to an embodiment of the present disclosure will be described.

Hereinafter, an embodiment of main components of a cooling device capable of removing formed frost will be described with reference to FIGS. 15 and 16.

FIG. 15 shows the configuration of a cooling device capable of removing formed frost using predetermined data.

The cooling device 1 which performs a defrost algorithm using predetermined data may include the refrigerant pipe 100, the connection member 200, the power source 300, the compressor 700, the memory 500, and the timer 650.

The refrigerant pipe 100, the connection member 200, the power source 300, and the compressor 700 as shown in FIG. 15 may be the same as or different from the refrigerant pipe 100, the connection member 200, the power source 300, and the compressor 700 as shown in FIG. 2.

The memory 500, which is a device of storing data required for driving the cooling device 1, may store defrost data 510.

The defrost data 510 may be data related to the defrost algorithm that is to be performed by the cooling device1 in order to remove formed frost. The defrost data 510 may be data about heating power and a supply time period set in advance by a manufacturer, a user, etc. Also, the defrost data 510 may be updated based on data accumulated by use of the cooling device 1.

The defrost data 510 may include defrost time data 520 and power data 530.

The defrost time data 520 may be data about the time series order of individual operations and time intervals between the individual operations with respect to the defrost algorithm of the cooling device 1.

For example, in the typical defrost algorithm, the defrost data 510 may be a time series order in which a predetermined heat-exchange time period, a predetermined defrost time period, and a predetermined delay time period are repeated in this order. Also, the defrost data 510 may be the lengths of the predetermined time periods. Generally, the predetermined heat-exchange time period may be an arbitrary time period in the range of 8 hours to 12 hours.

Also, in the defrost algorithm of splitting the refrigerant pipes 100, the defrost data 510 may be a time series order in which a predetermined heat-exchange time period, a predetermined first defrost time period, a predetermined second defrost time period, and a predetermined delay time period are repeated in this order. Also, the defrost data 510 may be the lengths of the predetermined time periods.

Also, in a minute defrost algorithm, the defrost data 510 may be a time series order in which a predetermined first defrost time period, a predetermined second defrost time period, and a predetermined delay time period are repeated in this order. Also, the defrost data 510 may be the lengths of the predetermined time periods.

Also, the predetermined heat-exchange time periods, the predetermined defrost time periods, and the predetermined delay time periods of the typical defrost algorithm, the defrost algorithm of splitting the refrigerant pipes 100, and the minute defrost algorithm may be the same or different.

Herein, the predetermined heat-exchange time period may be a time period for heat exchange between inhaled air and refrigerants in the refrigerant pipes 100 of the heat exchanger 10, and the predetermined defrost time period may be a time period for which heating power is supplied to the refrigerant pipes 100 in order to remove formed frost after heat exchange between inhaled air and refrigerants. Also, the predetermined delay time period may be a time period required for on delay, for example power-on delay, caused by heat generated by the heating power supplied to the refrigerant pipes 100 to disappear.

Also, the predetermined heat-exchange time period, the predetermined defrost time period, and the predetermined delay time period may be variables that are decided by the magnitude of supplied heating power, the supply time period of the heating power, the capacity of the heat exchanger 10, the kind of refrigerants, etc., and may be values set by a user, a manufacturer, etc. or values updated by accumulated operations of the cooling device 1.

Also, any other various variables may be used as examples of variables for setting the predetermined heat-exchange time period, the predetermined defrost time period, and the predetermined delay time period.

The power data 530 may be data about power that is supplied to the refrigerant pipes 100, the compressor 700, etc. to operate the cooling device 1.

For example, in the typical defrost algorithm, the power data 530 may be data about driving power that is supplied to the compressor 700 upon heat exchange between refrigerants and inhaled air, heating power that is supplied to the refrigerant pipes 100 for self-heating of the refrigerant pipes 100, and stopping supplying power to the refrigerant pipes 100 and the compressor 700 in order to escape from on delay.

Also, in the defrost algorithm of splitting the refrigerant pipes 100, the power data 530 may be data about driving power that is supplied to the compressor 700 upon heat exchange between refrigerants and inhaled air, heating power that is supplied to the refrigerant pipes 100 for self-heating of the refrigerant pipes 100, and stopping supplying power to the refrigerant pipes 100 and the compressor 700 in order to escape from on delay. Also, the power data 530 may be data about the number of times by which the refrigerant pipes 100 are splitted by the switch 280, the number of groups into which the refrigerant pipes 100 are splitted, and heating power that is supplied to each group of the splitted refrigerant pipes 100.

Also, in the minute defrost algorithm, the power data 530 may be data about driving power that is supplied to the compressor 700 upon heat exchange between refrigerants and inhaled air, minute heating power that is supplied to the refrigerant pipes 100 for self-heating of the refrigerant pipes 100, and driving power that is supplied to the compressor 700 when the minute heating power is supplied.

Also, the power data 530 may be data about the type of power that is supplied to the compressor 700 and the refrigerant pipes 100. For example, the power data 530 may be instruction data indicating that the type of power supplied to the compressor 700 and the refrigerant pipes 100 is one of DC, AC, and DC pulses.

Herein, the predetermined heating power may be power that is supplied to the refrigerant pipes 100 for self-heating of the refrigerant pipes 100 in the typical defrost algorithm and the defrost algorithm of splitting the refrigerant pipes 100, the predetermined minute heating power may be power that is supplied to the refrigerant pipes 100 in order to evaporate a minute amount of frost formed on the refrigerant pipes 100 in the minute defrost algorithm, and the predetermined driving power may be power that is supplied to the compressor 700 when the minute heating power is supplied to the refrigerant pipes 100 in the minute defrost algorithm.

Also, the predetermined heating power, the predetermined minute heating power, and the predetermined driving power of the typical defrost algorithm, the defrost algorithm of splitting the refrigerant pipes 100, and the minute defrost algorithm may be the same or different.

Also, the predetermined heat power, the predetermined minute heating power, and the predetermined driving power may be variables that are decided by a supply time period, the capacity of the heat exchanger 10, the kind of refrigerants, etc., and may be values set by a user, a manufacturer, etc. or values updated by accumulated operations of the cooling device 1.

Also, any other various variables may be used as examples of variables for setting the predetermined heating power, the predetermined minute heating power, and the predetermined driving power.

The timer 650 and the power source 300 may load the above-described defrost data 510 stored in the memory 500 to perform the individual algorithms.

The memory 500 may be non-volatile memory, such as Read Only Memory (ROM), high-speed Random Access Memory (RAM), a magnetic disk storage device, a flash memory device, or any other non-volatile semiconductor memory device.

For example, the memory 500 may be, as a semiconductor memory device, a Secure Digital (SD) memory card, a Secure Digital High Capacity (SDHC) memory card, a mini SD memory card, a mini SDHC memory card, a Trans Flash (TF) memory card, a micro SD memory card, a micro SDHC memory card, a memory stick, Compact Flash (CF), Multi-Media Card (MMC) card, MMC micro, an eXtreme Digital (XD) card, or the like.

Also, the memory 500 may include a network attached storage device allowing access through the network 840.

When a defrost algorithm is performed, the timer 650 may measure an execution time period of each operation, and compare the execution time period to a predetermined time period to determine whether to perform current operation or the next operation.

More specifically, the timer 650 may measure an execution time period of current operation. Then, the timer 650 may load the defrost time data 520 stored in the memory 500 to compare the measured execution time period to a predetermined time period of the current operation based on the defrost time data 520. If the execution time period is shorter than the predetermined time period, the cooling device 1 may continue to perform the current operation. In contrast, if the execution time period is longer than or equal to the predetermined time period, the cooling device 1 may perform the next operation.

For example, when heat exchange between refrigerants and inhaled air is performed, the timer 650 may measure an execution time period for which the heat exchange is performed, and compare the execution time period to a predetermined heat-exchange time period. If the execution time period is longer than or equal to the predetermined heat-exchange time period, the timer 650 may enable the power source 300 to supply heating power to the refrigerant pipes 100.

Also, when the power source 300 performs operation of supplying heating power to the refrigerant pipes 100, the timer 650 may newly measure an execution time period for which the operation is performed, and compare the execution time period to a predetermined defrost time period. If the execution time period is longer than or equal to the predetermined defrost time period, the timer 650 may enable the power source 300 to stop supplying power to the refrigerant pipes 100 and the compressor 700.

Also, when the cooling device 1 performs operation for on delay, the timer 650 may measure an execution time period for which the supply of power stops from time at which the power source 300 stops supplying power to the refrigerant pipes 100 and the compressor 700, and compare the execution time period to a predetermined delay time period. If the execution time period is longer than or equal to the predetermined delay time period, the timer 650 may enable the cooling device 1 to again perform heat exchange between the refrigerants and the inhaled air.

Also, the timer 650 may measure a switching time period in the defrost algorithm of splitting the refrigerant pipes 100, and if the switching time period reaches a predetermined time period, the timer 650 may enable the switch 280 to perform another predetermined switching.

That is, the cooling device 1 which performs the defrost algorithm using predetermined data may measure an execution time period for heat exchange between refrigerants and inhaled air, and compare the execution time period to a predetermined heat-exchange time period based on the defrost data 510 stored in the memory. If the execution time period is longer than or equal to the predetermined heat-exchange time period, the power source 300 may supply heating power to the refrigerant pipes 100. Also, the timer 650 may measure an execution time period for which operation of supplying heating power is performed from time at which the power source 300 starts supplying heating power to the refrigerant pipes 100, and compare the execution time period to a predetermined defrost time period based on the defrost data 510 stored in the memory 500. If the execution time period is longer than or equal to the predetermined defrost time period, the power source 300 may stop supplying heating power to the refrigerant pipes 100. Also, the timer 650 may measure an execution time period from time at which the heating power is no longer supplied, and compare the execution time period to a predetermined delay time period based on the defrost data 510 stored in the memory 500. If the execution time period is longer than or equal to the predetermined delay time period, the power source 300 may supply driving power to the compressor 700 to again perform heat exchange between the refrigerants and the inhaled air.

FIG. 16 shows the configuration of a cooling device of removing formed frost based on data sensed by a sensor according to an embodiment of the present disclosure.

The cooling device 1 which performs a defrost algorithm based on data sensed by the sensor 600 may include the refrigerant pipes 100, the connection member 200, the power source 300, the compressor 700, the sensor 600, and the controller 400.

The refrigerant pipes 100, the connection member 200, the power source 300, and the compressor 700 of FIG. 16 may be the same as or different from the refrigerant pipes 100, the connection member 200, the power source 300, and the compressor 700 of FIG. 2.

When the cooling device 1 performs specific operation, the sensor 600 may sense the current state of the cooling device 1.

More specifically, the sensor 600 may sense the amount of frost formed on the refrigerant pipe 100, the pressure or temperature of refrigerants flowing into/out of the compressor 700, the inside temperature of the refrigerator, and the magnitude of power supplied to the compressor 700 and the refrigerant pipes 100, etc. Also, the sensor 600 may include a frost sensor 610 to sense the amount of frost formed on the refrigerant pipes 100, a refrigerant equilibrium sensor 620 to sense the pressure or temperature of refrigerants flowing into/out of the compressor 700, and an additional sensor 630 to sense the overall states of the cooling device 1.

The frost sensor 610 may sense the amount of frost formed on the refrigerant pipes 100 or a fin.

More specifically, the frost sensor 610 may sense the amount of frost formed on the refrigerant pipes 100 or the fin, and transfer information about the sensed amount of frost to the controller 400, thereby enabling the controller 400 to determine whether to supply heating power to the refrigerant pipes 100, a magnitude of heating power to be supplied, whether to perform the minute defrost algorithm, etc.

Also, the frost sensor 610 may be a capacitance sensor, an optical sensor, a piezoelectric sensor, or a temperature sensor.

The capacitance sensor may sense the amount of frost formed on the refrigerant pipes 100 or the fin through a change in capacitance due to a change in dielectric constant caused by the frost. That is, the capacitance sensor may sense a change in capacitance to sense the amount of formed frost. Also, the optical sensor may irradiate light to the refrigerant pipes 100 or the fin, and sense the amount of formed frost according to the intensity of reflected light. Also, the piezoelectric sensor may generate vibrations in the refrigerant pipes 100 or the fin to sense the amount of formed frost based on the amount of vibrations received at a reception location. Also, the temperature sensor may sense the amount of formed frost based on the freezing point of water and the surface temperature of the refrigerant pipes 100 or the fin.

Also, other various methods capable of sensing the amount of frost formed on the refrigerant pipes 100 or the fin may be used as examples of the frost sensor 610.

The refrigerant equilibrium sensor 620 may sense the temperature or pressure of refrigerants inside the refrigerant pipe 100.

More specifically, the refrigerant equilibrium sensor 620 may sense the temperature or pressure of refrigerants flowing into the compressor 700, and the temperature or pressure of refrigerants flowing out of the compressor 700. The refrigerant equilibrium sensor 620 may transfer the sensed temperature or pressure of refrigerants flowing into/out of the compressor 700 to an on delay determiner 464 to determine whether there is on delay.

The additional sensor 630 may sense the state of the cooling device 1, which is not sensed by the frost sensor 610 and the refrigerant equilibrium sensor 620.

For example, when the cooling device 1 is applied to a refrigerator, the additional sensor 630 may sense the inside temperature and humidity of the refrigerator, and the magnitude of heating power that is supplied to the refrigerant pipe 100. Also, the additional sensor 630 may sense driving power supplied to the motor of the compressor 700, the rotational displacement of the rotor, current flowing through a shunt resistor, etc.

The controller 400 may transfer control signals to the individual components to execute the operation of the cooling device 1 according to a command input to the input device 730 by a user. Also, the controller 400 may control overall operations of the cooling device 1 and signal flow of the internal components of the cooling device 1, and perform a function of processing data. Also, the controller 400 may perform control operation of transferring power supplied from the power source 300 to the internal components of the cooling device 1, particularly, the refrigerant pipes 1 and the compressor 700. Also, the controller 400 may determine whether to supply heating power to the refrigerant pipes 100, and decide magnitudes and supply time periods of heating power and driving power to be supplied, based on data sensed by the sensor 600.

The controller 400 may function as a Central Processing Unit (CPU) such as a microprocessor, and the microprocessor may be a processing apparatus in which an arithmetic and logic unit, a register, a program counter, a command decoder, a control circuit, etc. are mounted on at least one silicon chip.

Also, the microprocessor may be a Graphic Processing Unit (GPU) for graphic processing of images or video. The microprocessor may be implemented in the form of a System On Chip (SOC) including a core and a GPU. The microprocessor may include a single core, a dual core, a triple core, a quad core, and multiple cores thereof.

Also, the controller 400 may include a graphic processing board including a GPU, RAM or ROM on a separate circuit board electrically connected to the microprocessor.

Also, the controller 400 may include the main controller 430 and the defrost controller 460.

The main controller 430 may receive data about the amount of frost formed on the refrigerant pipe 100, the temperature or pressure of refrigerants flowing into/out of the compressor 700, and the results of additional sensing, sensed by the sensor 600, store the data in the memory 500, or transfer the data to the display 760 to display the data. Also, the main controller 430 may transfer a control signal to the defrost controller 460 so that the cooling device 1 operates according to an input signal from the input unit 730.

The defrost controller 460 may generate control signals so that the cooling device 1 performs a defrost algorithm based on control signals from the main controller 430 and data sensed by the sensor 600, and transfer the control signals to individual drivers and the power source 300.

Also, the defrost controller 460 may include an amount-of-frost determiner 461, a power decider 462, a defrost time decider 463, the on delay determiner 464, and a defrost driver 465.

The amount-of-frost determiner 461 may determine the amount of frost formed on the refrigerant pipes 100 based on data sensed by the frost sensor 610, and classify the determined amount of frost into a predetermined degree of frost based on predetermined data. Also, the amount-of-frost determiner 461 may collect data sensed by a plurality of frost sensors 610 disposed on the plurality of refrigerant pipes 100 to decide and estimate the distribution of frost formed on the plurality of refrigerant pipes 100.

For example, if the frost sensor 610 is a capacitance sensor, the frost sensor 610 may detect a higher voltage as a larger amount of frost is formed, and accordingly, it may be determined that a larger amount of frost is formed as a higher voltage is detected.

Also, the amount-of-frost determiner 461 may determine whether to perform a defrost algorithm, and whether the cooling device 1 needs to perform the typical defrost algorithm, the defrost algorithm of splitting the refrigerant pipes 100, or the minute defrost algorithm, based on the determined amount of frost.

Also, the amount-of-frost determiner 461 may transfer the determined amount of frost and the distribution of frost formed on the plurality of refrigerant pipes 100 to the power decider 462 and the defrost time determiner 463.

The power decider 462 may decide a magnitude of heating power to be supplied to the refrigerant pipe 100 and a magnitude of driving power to be supplied to the compressor 700, based on the amount of frost formed on the refrigerant pipes 100, provided from the amount-of-frost determiner 461. Also, the defrost time decider 463 may decide a supply time period for which power is supplied to the refrigerant pipes 100 or the compressor 700, based on the amount of frost formed on the refrigerant pipes 100, provided from the amount-of-frost determiner 461.

More specifically, if the cooling device 1 performs the typical defrost algorithm, the power decider 462 may decide a magnitude of heating power to be supplied for self-heating of the refrigerant pipes 100, and decide that driving power to be supplied to the compressor 700 is a zero voltage. Also, in this case, the defrost time decider 463 may decide a supply time period of heating power to be supplied for self-heating of the refrigerant pipes 100.

Also, if the cooling device 1 performs the defrost algorithm of splitting the refrigerant pipes 100, the power decider 462 may decide a magnitude of heating power to be supplied to each of the splitted refrigerant pipes 100, and decide that driving power to be supplied to the compressor 700 is a zero voltage. Also, in this case, the defrost time decider 463 may decide a time period for which the heating power is supplied to each of the splitted refrigerant pipes 100.

Also, if the cooling device 1 performs the minute defrost algorithm, the power decider 462 may decide a magnitude of minute heating power to be supplied to the refrigerant pipes 100, and decide a magnitude of driving power to be supplied to the compressor 700. Also, in this case, the defrost time decider 463 may decide a time period for which the minute heating power is supplied to the refrigerant pipes 100 and a time period for which the driving power is supplied to the compressor 700.

The on delay determiner 464 may determine whether or not on delay is maintained, based on the pressure or temperatures of refrigerants flowing into/out of the compressor 700, sensed by the refrigerant equilibrium sensor 620.

More specifically, if a difference of the temperature or pressure of refrigerants flowing into/out of the compressor 700, sensed by the refrigerant equilibrium sensor 620 is smaller than or equal to a predetermined value, the on delay determiner 464 may determine that on delay is not maintained, and if the difference is greater than the predetermined value, the on delay determiner 464 may determine that on delay is maintained.

Also, the on delay determiner 464 may compare a time period measured from time at which on delay starts to a predetermined delay time period. If the on delay determiner 464 determines that the measured time period is shorter than the predetermined delay time period, the on delay determiner 464 may determine that on delay is maintained, and if the on delay determiner 464 determines that the measured time period is longer than or equal to the predetermined time period, the on delay determiner 464 may determine that on delay is not maintained.

The defrost driver 465 may generate control signals, and transfer the generated control signals to the power source 300 so that the power source 300 can perform operation according to decided values to supply decided power to the refrigerant pipes 100 or the compressor 700 for a decided supply time period, based on the magnitude of heating power or driving power decided by the power decider 462, the supply time periods decided by the defrost time decider 463, and the determination on whether or not on delay is maintained, determined by the on delay determiner 464.

If the amount-of-frost determiner 461 determines that the defrost algorithm of splitting the refrigerant pipes 100 needs to be performed, the defrost driver 465 may decide the refrigerant pipes 100 to be splitted, and decide the order of switching the switch elements 280 according to the refrigerant pipes 100 to be splitted.

That is, if the cooling device 1 which performs a defrost algorithm based on data sensed by the sensor 600 determines that frost is formed based on data sensed by the frost sensor 610 upon heat exchange between refrigerants and inhaled air, the cooling device 1 may decide a magnitude of heating power and a supply time period of the heating power based on a sensed amount of frost. Then, the power source 300 may supply the decided heating power for the decided supply time period, and the frost sensor 610 may again determine whether frost is formed. If it is determined that no frost is formed, the power source 300 may stop supplying heating power to the refrigerant pipes 100, and stop supplying driving power to the compressor 700. If a time period measured from time at which the supply of heating power stops is longer than a predetermined delay time period, the power source 300 may again supply driving power to the compressor 700 to perform heat exchange between refrigerants and inhaled air.

Hereinafter, power that is supplied to the cooling device 1 of removing formed frost by self-heating of refrigerant pipes, according to an embodiment of the present disclosure, and effects thereof will be descried with reference to FIGS. 17A to 18B.

FIG. 17A shows a graph of heating power over time in a typical defrost algorithm, and FIG. 17B shows a graph of driving power over time in the typical defrost algorithm.

The power source 300 of the cooling device 1 may supply driving power CP1 the compressor 700 to circulate refrigerants in the refrigerant pipes 100, thereby causing heat exchange between the refrigerants and inhaled air. In this case, the power source 300 may supply diving power CP1 of 80 W in the form of DC pulses to the compressor 700.

After a heat circulation time period t_a elapses, the power source 300 may stop supplying the driving power CP1 to the compressor 700, and supply heating power HP1 to the refrigerant pipes 100 for self-heating of the refrigerant pipes 100. In this case, the power source 300 may supply heating power HP1 of 400W in the form of DC to the refrigerant pipes 100.

After a defrost time period t_b elapses, the power source 300 may stop supplying the heating power HP1 to the refrigerant pipes 100, and supply a zero voltage to the refrigerant pipes 100 and the compressor 700. The reason is to escape from on delay.

The on delay may be due to a change in temperature and pressure of refrigerants inside the refrigerant pipes 100, caused when heat applied to formed frost for removing the frost influences the refrigerants. More specifically, due to a difference in fluid pressure between refrigerants flowing into the compressor 700 and refrigerants flowing out of the compressor 700, starting failure may occur inside the cylinder of the compressor 700. Accordingly, in order to escape from the on delay, a difference in pressure between refrigerants flowing into the compressor 700 and refrigerants flowing out of the compressor 700 may need to be maintained at predetermined pressure or less. For this, the cooling device 1 may require delay time so that a difference in pressure between refrigerants can be maintained at the predetermined pressure or less to establish equilibrium.

Accordingly, when a delay time period t_c elapses from the time at which the heating power HP1 is no longer supplied to the refrigerant pipes 100, the cooling device 1 may escape from the on delay. That is, the power source 300 may supply driving power to the compressor 700 after the delay time period t_c elapses to exchange heat between the refrigerants and inhaled air.

FIG. 18A shows a graph related to the temperature and consumption power of a cooling device of removing frost through radiation and convection, and FIG. 18B shows a graph related to the temperature and consumption power of a cooling device of removing frost through thermal conductivity.

Thermal conductivity may occur by radiation, convection, and conduction. Herein, the radiation is a phenomenon in which heat energy is emitted as electromagnetic waves from the surface of a heat-radiating object, the convection is a phenomenon in which molecules in the liquid or gaseous state themselves move to transfer heat, and the conduction is a phenomenon in which the motions of molecules are transferred between two objects contacting each other to transfer heat.

A method of disposing a separate heater near the refrigerant pipes 100 inside the cooling device 1 to remove formed frost through heat generated by the heater is to transfer heat to frost through radiation and convection.

In the method of removing frost through radiation and convection in the separate heater, as shown in the graph of FIG. 18A, the temperature a of the heater may rise upto about 200° C., and the temperature b of refrigerants may rise upto about 25° C., when frost is removed. Heat transfer through radiation and convection may increase time taken to transfer heat to frost due to low efficiency, and accordingly, refrigerants may be heated together so that a difference in pressure between refrigerants flowing into the compressor 700 and refrigerants flowing out of the compressor 70 increases, resulting in an increase of time taken to escape from on delay. Accordingly, consumption power and consumption time may increase.

However, in a method of removing frost through conduction using the refrigerant pipes 100 as a plane heater, as shown in FIG. 18B, the temperature d of the heater may slightly rise upto about 15° C., and the temperature e of refrigerants may also slightly rise upto about 5° C., when frost is removed. Heat transfer through conduction may decrease time taken to transfer heat to frost due to high efficiency, and accordingly, a change in temperature of refrigerants may be small, resulting in a decrease of time taken to escape from on delay.

Differences between the methods can be numerically compared as follows. In the specification of the cooling device 1 related to FIG. 18A, a supply time period of heating power is 17 min, consumption power is 49.6 Wh, the amount of removed frost is 154 g, and defrost capability is 0.322 Wh/g. However, in the specification of the cooling device 1 referred to FIG. 18B, a supply time period of heating power is 7 min, consumption power is 40.8 Wh, the amount of removed frost is 142 g, and defrost capability is 0.29 Wh/g. Accordingly, the cooling device 1 of removing frost through conduction may have a shorter defrost time period, a shorter on delay time period, and higher defrost capability.

Hereinafter, a method of controlling the cooling device that operates according to the typical defrost algorithm, according to an embodiment of the present disclosure, will be described with reference to FIGS. 19 to 22, below.

FIG. 19 is a flowchart schematically illustrating the typical defrost algorithm.

First, the power source may supply driving power to the compressor to circulate refrigerants inside the refrigerant pipes, thereby causing heat exchange between the refrigerants and inhaled air, in operation S100. Then, the power source may supply heating power to the refrigerant pipes to self-heat the refrigerant pipes in operation S200 to thereby transfer heat to frost formed on the refrigerant pipes through conduction.

Thereafter, if the formed frost is removed, the power source may stop supplying power to the compressor and the refrigerant pipes to induce the refrigerants to escape from on delay, in operation S300.

FIG. 20 is a flowchart illustrating an embodiment a of the typical defrost algorithm.

More specifically, the power source may supply driving power to the compressor to circulate refrigerants inside the refrigerant pipes, thereby causing heat exchange between the refrigerants and air, in operation S100. Then, the timer may compare an execution time period taken to perform operation S100 of exchanging heat to a predetermined heat-exchange time period based on defrost data stored in the memory to determine whether the execution time period is longer than the predetermined heat-exchange time period, in operation S150.

If it is determined that the execution time period is not longer than the predetermined heat-exchange time period, operation S100 may be again performed. However, if it is determined that the execution time period is longer than the predetermined heat-exchange time period, the power source may supply predetermined heating power to the refrigerant pipes based on the defrost data stored in the memory, to self-heat the refrigerant pipes, in operation S210.

Then, the timer may compare an execution time period taken to perform operation S210 of supplying the heating power to a predetermined defrost time period based on the defrost data stored in the memory, to determine whether the execution time period is longer than the predetermined defrost time period, in operation S260.

If it is determined that the execution time period is not longer than the predetermined defrost time period, operation S210 may be again performed. However, if it is determined that the execution time period is longer than the predetermined defrost time period, the power source may stop supplying power to the refrigerant pipes and the compressor in order to escape from on delay, in operation S310.

Then, the timer may compare an execution time period for which the supply of power stops to a predetermined delay time period based on the defrost data stored in the memory to determine whether the execution time period is longer than the predetermined delay time period, in operation S360.

If it is determined that the execution time period is not longer than the predetermined delay time period, operation S310 may be again performed. However, if it is determined that the execution time period is longer than the predetermined delay time period, the cooling device 1 may terminate the defrost algorithm.

FIG. 21 is a flowchart illustrating an embodiment b of the typical defrost algorithm.

More specifically, the power source may supply driving power to the compressor to circulate refrigerants inside the refrigerant pipes, thereby causing heat exchange between refrigerants and air, in operation S100. Then, the sensor may sense frost formed on the refrigerant pipes, in operation S160. Also, the controller may determine whether frost is formed on the refrigerant pipes, based on data sensed by the sensor, in operation S170. That is, if the amount of the formed frost is greater than or equal to a predetermined value, the controller may determine that frost is formed on the refrigerant pipes.

If the controller determines that no frost is formed on the refrigerant pipes, operations S100 and operation S160 may be again performed. However, if the controller determines that frost is formed on the refrigerant pipes, the power source may supply predetermined heating power to the refrigerant pipes based on the defrost data stored in the memory to self-heat the refrigerant pipes, in operation S210.

Thereafter, the sensor may again sense frost formed on the refrigerant pipes, in operation S270. Also, the controller may again determine whether frost is formed on the refrigerant pipes, based on data sensed by the sensor, in operation S280.

If the controller determines that frost is formed on the refrigerant pipes, operations S210 and operation S270 may be again performed. However, if the controller determines that no frost is formed on the refrigerant pipes, the power source may stop supplying power to the refrigerant pipes and the compressor in order to escape from on delay, in operation S310.

Then, the timer may compare an execution time period for which the supply of power stops to a predetermined delay time period based on the defrost data stored in the memory to determine whether the execution time period is longer than the predetermined delay time period, in operation S360.

If it is determined that the execution time period is not longer than the predetermined delay time period, operation S310 may be again performed. However, if it is determined that the execution time period is longer than the predetermined delay time period, the cooling device may terminate the defrost algorithm.

FIG. 22 is a flowchart illustrating an embodiment c of the typical defrost algorithm.

More specifically, the power source may supply driving power to the compressor to circulate refrigerants inside the refrigerant pipes, thereby causing heat exchange between refrigerants and air, in operation S100. Then, the sensor may sense frost formed on the refrigerant pipes, in operation S160. Also, the controller may determine whether frost is formed on the refrigerant pipes, based on data sensed by the sensor, in operation S170. That is, if the sensed amount of the formed frost is greater than or equal to a predetermined value, the controller may determine that frost is formed on the refrigerant pipes.

If the controller determines that no frost is formed on the refrigerant pipes, operations S100 and operation S160 may be again performed. However, if the controller determines that frost is formed on the refrigerant pipes, the power source may decide a magnitude of heating power and a supply time period of the heating power based on the sensed amount of the formed frost, in operation S220. Then, the power source may supply the decided heating power to the refrigerant pipes for the decided supply time period to self-heat the refrigerant pipes, in operation S230.

Thereafter, the sensor may again sense frost formed on the refrigerant pipes, in operation S270. Also, the controller may again determine whether frost is formed on the refrigerant pipes, based on data sensed by the sensor, in operation S280.

If the controller determines that frost is formed on the refrigerant pipes, operations S210 and operation S270 may be again performed. However, if the controller determines that no frost is formed on the refrigerant pipes, the power source may stop supplying power to the refrigerant pipes and the compressor in order to escape from on delay, in operation S310.

Then, the timer may compare an execution time period for which the supply of power stops to a predetermined delay time period based on the defrost data stored in the memory to determine whether the execution time period is longer than the predetermined delay time period, in operation S360.

If it is determined that the execution time period is not longer than the predetermined delay time period, operation S310 may be again performed. However, if it is determined that the execution time period is longer than the predetermined delay time period, the cooling device 1 may terminate the defrost algorithm.

Hereinafter, a cooling device of splitting refrigerant pipes to supply heating power, according to an embodiment of the present disclosure, will be described with reference to FIGS. 23 to 25.

FIG. 23 is a view for describing the technical concept of a cooling device including a switch, according to an embodiment of the present disclosure.

As shown in FIG. 23, the plurality of refrigerant pipes 100 may be splitted into two groups, wherein one group includes four refrigerant pipes 100S (also, referred to as inlet side refrigerant pipes 100S) disposed close to the inlet side and the other group includes four refrigerant pipes 100E (also, referred to as outlet side refrigerant pipes 100E) disposed close to the outlet side. In the heat exchanger 10, a larger amount of frost may be formed in the inlet side into which humid air flows than in the outlet side. Accordingly, the defrost algorithm of splitting the refrigerant pipes 100 can raise efficiency.

More specifically, the switch 280 may be switched to an inlet side contact 285S to connect the power source 300 to the inlet side refrigerant pipes 100S, and the power source 300 may supply heating power to the inlet side refrigerant pipes 100S to self-heat the inlet side refrigerant pipes 100S.

Then, the frost sensor 610 may sense frost formed on the refrigerant pipes 100. If the frost sensor 610 determines that no frost is formed on the refrigerant pipes 100, the compressor 700 may be driven after on delay to exchange heat between inhaled air and refrigerants.

However, if the frost sensor 610 determines that frost is formed on the refrigerant pipes 100, the switch 280 may be switched to an outlet side contact 285E to connect the power source 300 to the outlet side refrigerant pipes 100E, and the power source 300 may supply heating power to the outlet side refrigerant pipes 100E to self-heat the outlet side refrigerant pipes 100E.

Herein, the switch 280 may be a switching circuit for switching between the plurality of refrigerant pipes 100, and as shown in FIG. 23, the switch 280 may be a two-contact switch to connect the power source 300 to different refrigerant pipes 100, or a single-contact switch to connect the different refrigerant pipes 100 to each other.

Also, the switch 280 may be a mechanical switch that is switched according to a user's input, or a switch that is switched by a control signal from the controller 400.

More specifically, the switch 280 may be a relay circuit that is switched by a magnetic field, a photo coupler that is switched by sensing light, or a Field Effect Transistor that is switched by a threshold voltage.

Also, the switch 280 may be any other kind of switch that is switched between the different refrigerant pipes 100 or that connects the different refrigerant pipes 100 to each other.

FIG. 24 is a view for describing the technical concept of a cooling device including a switch, according to another embodiment of the present disclosure.

Two switches 280 may be disposed to both sides of the plurality of refrigerant pipes 100. The switches 280 may be disposed between the plurality of refrigerant pipes 100 to change connections between the plurality of refrigerant pipes 100.

More specifically, as shown in FIG. 24, the switch 280 including 12 switch elements may be disposed to both sides of four refrigerant pipes 100.

The switch 280 may be turned on/off by a control signal from the controller 400 to connect the different refrigerant pipes 100 to each other.

For example, in order to connect a first refrigerant pipe 100 and a second refrigerant pipe 100 that are the inlet side refrigerant pipes 100 in parallel to each other, and to connect a third refrigerant pipe 100 and a fourth refrigerant pipe 100 that are the outlet side refrigerant pipes 100 in parallel to each other, the controller 400 may transfer control signals to the switch 280 so as to close the left and right switch elements between the first refrigerant pipe 100 and the second refrigerant pipe 100, to close the left and right switch elements between the third refrigerant pipe 100 and the fourth refrigerant pipe 100, and to open the remaining switch elements (ON: QL12, QR12, QL34, QR34/OFF: QL13, QL14, QL23, QL24, QR13, QR14, QR23, QR24).

Also, in order to sequentially connect the first refrigerant pipe 100 to the fourth refrigerant pipe 100 in series, the controller 400 may transfer control signals to the switch 280 so as to close the right switch element between the first refrigerant pipe 100 and the second refrigerant pipe 100, to close the left switch element between the second refrigerant pipe 100 and the third refrigerant pipe 100, to close the right switch element between the third refrigerant pipe 100 and the fourth refrigerant pipe 100, and to open the remaining switch elements (ON: QR12, QL23, QR34/OFF: QL12, QL34, QL13, QL14, QL24, QR13, QR14, QR23, QR24).

Also, in order to connect the first refrigerant pipe 100 to the fourth refrigerant pipe 100 in parallel to each other, the controller 400 may transfer control signals to the switch 280 so as to close the left and right switch elements between the first refrigerant pipe 100 and the second refrigerant pipe 100, to close the left and right switch elements between the second refrigerant pipe 100 and the third refrigerant pipe 100, to close the left and right switch elements between the third refrigerant pipe 100 and the fourth refrigerant pipe 100, and to open the remaining switch elements (ON: QL12, QR12, QL23, QR23, QL34, QR34/OFF: QL13, QL14, QL24, QR13, QR14, QR24).

FIG. 25A shows a graph of heating power over time in the defrost algorithm of splitting refrigerant pipes, and FIG. 25B shows a graph of driving power over time in the defrost algorithm of splitting refrigerant pipes.

The power source 300 of the cooling device 1 may supply driving power CP2 to the compressor 700 to circulate refrigerants inside the refrigerant pipes 100, thereby causing heat exchange between the refrigerants and inhaled air. In this case, the power source 300 may supply driving power CP2 of 80 W in the form of DC pulses to the compressor 700.

After a heat circulation time period t_e elapses, the power source 300 may stop supplying driving power to the compressor 700, and supply heating power to the refrigerant pipes 100 for self-heating of the refrigerant pipes 100. In this case, the switch 280 may connect the inlet side refrigerant pipes 100 to the power source 300 to supply heating power HP2_S to the inlet side refrigerant pipes 100 for a first defrost time period t_f, may disconnect all of the inlet side refrigerant pipes 100 and the outlet side refrigerant pipes 100 from the power source 300 for a second defrost time period t_g, and may connect the outlet side refrigerant pipes 100 to the power source 300 to supply heating power to the outlet side refrigerant pipes 100 for a third defrost time period t_h. Also, the power source 300 may supply heating power of 400 W in the form of DC to the refrigerant pipes 100.

After the defrost time periods elapse, the power source 300 may stop supplying heating power to the refrigerant pipes 100, and then supply a zero voltage to the refrigerant pipes 100 and the compressor 700 in order to escape from on delay.

The on delay may be due to a change in temperature and pressure of refrigerants inside the refrigerant pipes 100, caused when heat applied to formed frost for removing the frost influences the refrigerants. More specifically, due to a difference in fluid pressure between refrigerants flowing into the compressor 700 and refrigerants flowing out of the compressor 700, starting failure may occur inside the cylinder of the compressor 700. Accordingly, in order to escape from the on delay, a difference in pressure between refrigerants flowing into the compressor 700 and refrigerants flowing out of the compressor 700 may need to be maintained at predetermined pressure or less. For this, the cooling device 1 may require delay time so that a difference in pressure between refrigerants can be maintained at the predetermined pressure or less to establish equilibrium.

Accordingly, when a delay time period t_i elapses from the time at which the heating power is no longer supplied to the refrigerant pipes 100, the cooling device 1 may escape from the on delay. That is, the power source 300 may supply driving power to the compressor 700 after the delay time period t_i elapses to exchange heat between refrigerants and inhaled air.

Hereinafter, an embodiment of a method of controlling a cooling device that operates according to the defrost algorithm of splitting refrigerant pipes will be described with reference to FIGS. 26 and 27.

FIG. 26 is a flowchart illustrating an embodiment a of the defrost algorithm of splitting refrigerant pipes.

More specifically, the power source may supply driving power to the compressor to circulate refrigerants inside refrigerant pipes, thereby causing heat exchange between the refrigerants and air, in operation S400. Then, the timer may compare an execution time period for which the heat exchange is performed, to a predetermined heat-exchange time period based on defrost data stored in the memory to determine whether the execution time period is longer than the predetermined heat-exchange time period, in operation S450.

If it is determined that the execution time period is not longer than the predetermined heat-exchange time period, operation S400 may be again performed. However, if it is determined that the execution time period is longer than the predetermined heat-exchange time period, the power source may supply predetermined heating power to the inlet side refrigerant pipes based on the defrost data stored in the memory to self-heat the inlet side refrigerant pipes, in operation S510.

Thereafter, the timer may compare an execution time period for which the heating power is supplied, to a predetermined first defrost time period based on the defrost data stored in the memory to determine whether the execution time period is longer than the predetermined first defrost time period, in operation S520.

If it is determined that the execution time period is not longer than the predetermined first defrost time period, operation S510 may be again performed. However, if it is determined that the execution time period is longer than the predetermined first defrost time period, the power source may connect to all of the refrigerant pipes through switching of the switch to supply predetermined heating power to all of the refrigerant pipes based on the defrost data stored in the memory to self-heat the refrigerant pipes, in operation S530.

Thereafter, the timer may compare an execution time period for which the heating power is supplied, to a predetermined second defrost time period based on the defrost data stored in the memory to determine whether the execution time period is longer than the predetermined second defrost time period, in operation S540.

If it is determined that the execution time period is not longer than the predetermined second defrost time period, operation S530 may be again performed. However, if it is determined that the execution time period is longer than the predetermined second defrost time period, the power source may stop supplying power to the refrigerant pipes and the compressor in order to escape from on delay, in operation S610.

The timer may compare an execution time period for which the supply of power stops, to a predetermined delay time period based on the defrost data stored in the memory to determine whether the execution time period is longer than the predetermined delay time period, in operation S660.

If it is determined that the execution time period is not longer than the predetermined delay time period, operation S610 may be again performed. However, if it is determined that the execution time period is longer than the predetermined delay time period, the cooling device may terminate the defrost algorithm.

FIG. 27 is a flowchart illustrating an embodiment b of the defrost algorithm of splitting refrigerant pipes.

More specifically, the power source may supply driving power to the compressor to circulate refrigerants inside the plurality of refrigerant pipes, thereby causing heat exchange between the refrigerants and air, in operation S400. Then, the sensor may sense frost formed on the plurality of refrigerant pipes, in operation S450. Also, the controller may determine whether frost is formed on at least one of the plurality of refrigerant pipes, based on data sensed by the sensor, in operation S470.

If the controller determines that no frost is formed on any one of the plurality of refrigerant pipes, operation S400 and operation S450 may be again performed. However, if the controller determines that frost is formed on at least one of the plurality of refrigerant pipes, the power source may decide a magnitude of heating power and a supply time period of the heating power based on the amount of frost formed on each of the refrigerant pipes, in operation S550. Then, the power source may supply the decided heating power to the individual refrigerant pipes for the decided supply time period to self-heat the refrigerant pipes, in operation S560.

Thereafter, the sensor may again sense frost formed on the refrigerant pipes, in operation S570. Also, the controller may again determine whether frost is formed on the refrigerant pipes, based on data sensed by the sensor, in operation S580.

If the controller determines that frost is formed on the refrigerant pipes, operation S550, S560, and S570 may be again performed. However, if the controller determines that no frost is formed on the refrigerant pipes, the power source may stop supplying power to the refrigerant pipes and the compressor in order to escape from on delay, in operation S610.

The timer may compare an execution time period for which the supply of power stops, to a predetermined delay time period based on defrost data stored in the memory to determine whether the execution time period is longer than the predetermined delay time period, in operation S660.

If it is determined that the execution time period is not longer than the predetermined delay time period, operation S610 may be again performed. However, if it is determined that the execution time period is longer than the predetermined delay time period, the cooling device may terminate the defrost algorithm.

Hereinafter, an embodiment of heating power and driving power of a cooling device that operates according to the minute defrost algorithm will be described with reference to FIGS. 28A and 28B.

FIG. 28A shows a graph of heating power over time in the minute defrost algorithm, and FIG. 28B shows a graph of driving power over time in the minute defrost algorithm.

The power source 300 of the cooling device 1 may supply driving power to the compressor 700 to circulate refrigerants inside the refrigerant pipes 100, thereby causing heat exchange between the refrigerants and inhaled air. In this case, the power source 300 may supply driving power CP3 of 80 W in the form of DC pulses to the compressor 700.

When the cooling device 1 exchanges heat between the refrigerants and the inhaled air, frost may be formed on the surfaces of the refrigerant pipes 100. In this case, on the surfaces of the refrigerant pipes 100, a large amount of frost or a minute amount of frost may be formed. Accordingly, if the amount of frost sensed by the frost sensor 610 is less than a minute frost level, the power source 300 may supply minute heating power HP3 to the refrigerant pipes 100, and supply driving power CP3 to the compressor 700. In this case, the power source 300 may supply minute heating power HP3 of 200 W to the refrigerant pipes 100, and supply driving power CP3 of 20 W to the compressor 700. Also, the power source 300 may supply the minute heating power CP3 and the driving power CP3 for a supply time period t_k of 1 min or less.

When the cooling device 1 performs the minute defrost algorithm, the magnitude of the minute heating power HP3 to be supplied to the refrigerant pipes 100 may be small, and the supply time period of the minute heating power HP3 may also be short, so that a change in temperature or pressure of refrigerants inside the refrigerant pipes 100 may be small, unlike when the cooling device 1 performs the typical defrost algorithm. Also, driving power CP3 for minimum rotation may be supplied to the compressor 700. Accordingly, the cooling device 1 can perform heat exchange between inhaled air and refrigerants immediately without any on delay. Also, it is possible to prevent frost from being formed on the refrigerant pipes 100, to improve the performance of the heat exchanger 10, and to evaporate a minute amount of frost to thereby maintain the inside humidity of the refrigerator.

Herein, the minute heating power means low power required for removing a minute amount of frost in the minute defrost algorithm, and the minute frost level means a maximum value that can be determined to be a minute amount of frost according to the amount of frost sensed by the frost sensor 610.

Hereinafter, an embodiment of a cooling device that operates according to the minute defrost algorithm will be described with reference to FIGS. 29 to 30B.

FIG. 29 is a flowchart illustrating an embodiment a of the minute defrost algorithm.

More specifically, the power source may supply driving power to the compressor to circulate refrigerants inside the refrigerant pipes, thereby causing heat exchange between the refrigerants and air, in operation S700. Then, the sensor may sense frost formed on the refrigerant pipes, in operation S760. Also, the controller may determine whether frost is formed on the refrigerant pipes 100, based on data sensed by the sensor, in operation S770.

If the controller determines that no frost is formed on the refrigerant pipes, operations S700 and operation S760 may be again performed. However, if the controller determines that frost is formed on the refrigerant pipes, the controller may determine whether the amount of the formed frost is less than a minute frost level, in operation S780.

If the controller determines that the amount of the formed frost is more than or equal to the minute frost level, the typical defrost algorithm, instead of the minute defrost algorithm may be performed. That is, the power source may supply predetermined heating power to the refrigerant pipes based on defrost data stored in the memory to self-heat the refrigerant pipes, in operation S810.

Thereafter, the timer may compare an execution time period for which the heating power is supplied, to a predetermined first defrost time period based on the defrost data stored in the memory to determine whether the execution time period is longer than the predetermined first defrost time period, in operation S860.

If it is determined that the execution time period is not longer than the predetermined first defrost time period, operation S810 may be again performed. However, if it is determined that the execution time period is longer than the predetermined first defrost time period, the power source may stop supplying power to the refrigerant pipes and the compressor in order to escape from on delay, in operation S910.

Then, the timer may compare an execution time period for which the supply of power stops, to a predetermined delay time period based on the defrost data stored in the memory to determine whether the execution time period is longer than the predetermined delay time period, in operation S960.

If it is determined that the execution time period is not longer than the predetermined delay time period, operation S910 may be again performed. However, if it is determined that the execution time period is longer than the predetermined delay time period, the cooling device may terminate the defrost algorithm.

However, if the amount of the formed frost is less than the minute frost level, the cooling device may perform the minute defrost algorithm. That is, the power source may supply predetermined minute heating power to the refrigerant pipes, and supply predetermined driving power to the compressor, in operation S1010.

The timer may compare an execution time period measured from time at which minute driving power is supplied to the refrigerant pipes or from time at which driving power is supplied to the compressor, to a predetermined second defrost time period based on the defrost data stored in the memory to determine whether the execution time period is longer than the predetermined second defrost time period, in operation S1060.

FIGS. 30A and 30B are flowcharts illustrating an embodiment b of the minute defrost algorithm.

More specifically, the power source may supply driving power to the compressor to circulate refrigerants inside the refrigerant pipes, thereby causing heat exchange between the refrigerants and air, in operation S700. Then, the sensor may sense frost formed on the refrigerant pipes, in operation S760. Also, the controller may determine whether frost is formed on the refrigerant pipes 100, based on data sensed by the sensor, in operation S770.

If the controller determines that no frost is formed on the refrigerant pipes, operations S700 and operation S760 may be again performed. However, if the controller determines that frost is formed on the refrigerant pipes, the controller may determine whether the amount of the formed frost is less than a minute frost level, in operation S780.

If the controller determines that the amount of the formed frost is more than or equal to the minute frost level, the typical defrost algorithm, instead of the minute defrost algorithm may be performed. That is, the power source may decide a magnitude of heating power and a supply time period of the heating power based on the sensed amount of the formed frost, in operation S820. Then, the power source may supply the decided heating power to the refrigerant pipes for the decided supply time period, and stop supplying power to the compressor to self-heat the refrigerant pipes, in operation S830.

Thereafter, the sensor may again sense frost formed on the refrigerant pipes, in operation S870. Also, the controller may again determine whether frost is formed on the refrigerant pipes, based on data sensed by the sensor, in operation S880.

If the controller determines that frost is formed on the refrigerant pipes, operation S820, operation S830, and operation S870 may be again performed. However, if the controller determines that no frost is formed on the refrigerant pipes, the power source may stop supplying power to the refrigerant pipes and the compressor in order to escape from on delay, in operation S910.

The timer may compare an execution time period measured from time at which the supply of power stops, to a predetermined delay time period based on the defrost data stored in the memory to determine whether the execution time period is longer than the predetermined delay time period, in operation S960.

If it is determined that the execution time period is not longer than the predetermined delay time period, operation S910 may be again performed. However, if it is determined that the execution time period is longer than the predetermined delay time period, the cooling device may terminate the defrost algorithm.

However, if the amount of the formed frost is less than the minute frost level, the cooling device may perform the minute defrost algorithm. That is, the controller may decide a magnitude of minute heating power, a magnitude of driving power, and a supply time period, based on the amount of frost sensed by the sensor, in operation S1020.

Then, the power source may supply the decided minute heating power to the refrigerant pipes, and the decided driving power to the compressor, for the decided supply time period, in operation S1030.

An embodiment of the cooling device has been described above.

Hereinafter, an application example of the cooling device will be described.

FIG. 31 shows the outer appearance of a refrigerator to which the cooling device is applied, and FIG. 32 shows the inside of the refrigerator to which the cooling device is applied.

A refrigerator 1100 may include a main body 1110 forming the outer appearance of the refrigerator 1100, a storage chamber 1120 configured to store food, and the cooling device 1 configured to cool the storage chamber 1120.

The storage chamber 1120 may be located in the inside of the main body 1110, and partitioned into a refrigerating compartment 1121 to refrigerate food and a freezing compartment 1122 to freeze food, with an intermediate partition wall in between. Also, the front portions of the refrigerating compartment 1121 and the freezing compartment 1122 may open to enable a user to put or take out food.

In the rear portion of the storage chamber 1120, a pair of ducts may be provided in which the cooling device 1 for cooling the inside of the storage chamber 1120 is disposed. More specifically, a first duct 1141 may be disposed in the rear portion of the refrigerating compartment 1121, and a second duct 1142 may be disposed in the rear portion of the freezing compartment 1122.

In the rear portion of the storage chamber 1120, a pair of blow fans may be provided to blow air cooled by the cooling device 1 in the ducts toward the storage chamber 1120.

More specifically, in the rear portion of the refrigerating compartment 1121, a first blow fan 1151 may be provided to blow air in the first duct 1141 toward the refrigerating compartment 1121, and a second blow fan 1152 may be provided to blow air in the second duct 1142 toward the freezing compartment 1122.

Also, a temperature sensor for sensing the inside temperature of the storage chamber 1120 may be disposed in the storage chamber 1120.

More specifically, in the refrigerating compartment 1121, a refrigerating temperature sensor 1161 may be provided to sense the inside temperature of the refrigerating compartment 1121, and in the freezing compartment 1122, a freezing temperature sensor 1162 may be provided to sense the inside temperature of the freezing compartment 1122. The temperature sensors 1161 and 1162 may be thermistors whose electric resistance values change according to a change in temperature.

In the front portions of the refrigerating compartment 1121 and the freezing compartment 1122, a pair of doors may be provided to shield the refrigerating compartment 1121 and the freezing compartment 1122 from the outside.

The cooling device 1 may include the compressor 700 to compress refrigerants, a condenser 10*b* to condense refrigerants, a directional switch valve 1175 to change the flow of refrigerants, an expansion valve to decompress refrigerants, and an evaporator to evaporate refrigerants.

The compressor 700 may be disposed in a machine room 111 located in the rear, lower portion of the main body 1110. The compressor 700 may compress refrigerants to high pressure using the rotatory force of a compressor motor of receiving electrical energy from an external power source to rotate, and send the high-pressure refrigerants to the condenser 10*b* which will be described later. Also, the refrigerants may be circulated in the cooling device 1 by the compression force of the compressor 700 to cool the storage chamber 1120.

The compressor motor may include a cylindrical stator fixed at the compressor 700, and a rotor disposed in the inside of the stator to rotate with respect to the rotation shaft. The stator may include, generally, a coil to form a rotating magnetic field, and the rotor may include a coil or a permanent magnet to form a magnetic field. The rotor may rotate by interaction between the rotating magnetic field formed by the stator and the magnetic field formed by the rotor.

The condenser 10*b* may be disposed in the inside of the machine room 1111 in which the compressor 700 is disposed, to condense refrigerants. Also, the condenser 10*b* may include a condenser refrigerant pipe 100 through which refrigerants pass, a condenser cooling fin to widen the surface area of the refrigerant pipes 100 contacting air in order to improve the heat-exchange efficiency of the condenser 10*b*, and a cooling fan 1170*a* to cool the condenser 10*b*.

The directional switch valve 1175 may change the direction of refrigerants according to the inside temperature of the storage chamber 1120. More specifically, the directional switch valve 1175 may cause refrigerants to be provided to a first evaporator 10*a*2 and a second evaporator 10*a*1 according to the inside temperature of the refrigerating compartment 1121 and the freezing compartment 1122.

The expansion valve may include a first expansion valve 1181 to decompress the refrigerants provided to the first evaporator 10*a*2, and a second expansion valve 1182 to decompress the refrigerants provided to the second evaporator 10*a*1.

The evaporator may be disposed in the ducts positioned in the rear portion of the storage chamber 1120, to evaporate the refrigerants. Also, the evaporator may include the first evaporator 10*a*2 located in the first duct 1141 provided in the rear portion of the refrigerating compartment 1121, and the second evaporator 10*a*1 located in the second duct 1142 provided in the rear portion of the freezing compartment 1122. Each of the first and second evaporators 10*a*2 and 10*a*1 may include an evaporator refrigerant pipe 100 through which refrigerants pass, and an evaporator cooling fin to widen the surface area of the evaporator refrigerant pipe 100 contacting air.

Also, if frost is formed on the surfaces of the refrigerant pipes 100 of the evaporators 10*a*2 and 10*a*1, the power source 300 may supply heating power to the refrigerant pipes 100 to remove the formed frost through self-heating.

In regard of circulation of the refrigerants inside the refrigerator 1100, first, the refrigerants may be compressed by the compressor 700. While the refrigerants are compressed, the pressure and temperature of the refrigerants may increase.

The compressed refrigerants may be condensed by the condenser 1170, and while the refrigerants are condensed, heat exchange may occur between the refrigerants and the outside air of the storage chamber 1120.

More specifically, while the refrigerants change from a gaseous state to a liquid state, the refrigerants may emit energy (latent heat) corresponding to a difference between internal energy in the gaseous state and internal energy in the liquid state to the indoor space.

The condensed refrigerants may be decompressed by the expansion valve, and while the refrigerants are decompressed, the pressure and temperature of the refrigerants may be lowered.

The decompressed refrigerants may be evaporated by the evaporator, and while the refrigerants are evaporated, heat exchange may occur between the refrigerants and the inside air of the ducts.

More specifically, while the refrigerants change from the liquid state to the gaseous state, the refrigerants may absorb energy (latent heat) corresponding to a difference between internal energy of the refrigerants in the gaseous state and internal energy of the refrigerants in the liquid state, from the indoor air. As such, the refrigerator 1100 can cool the inside air of the ducts and the storage chamber 1120 using heat exchange between refrigerants and the inside air of the ducts, occurring in the evaporator, that is, using a phenomenon in which refrigerants absorb latent heat from the inside air of the ducts.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A cooling device comprising:

a plurality of refrigerant pipes formed of a polymer material;

a power source configured to supply heating power to the plurality of refrigerant pipes formed of the polymer material for self-heating of the plurality of refrigerant pipes; and a connector including a first end connection and a second end connection, disposed at opposite longitudinal ends of each of the plurality of refrigerant pipes, the connector configured to electrically connect the plurality of refrigerant pipes to the power source, the first end connection and the second end connection including a plurality of insertion holes configured to support the plurality of refrigerant pipes relative to each other.

2. The cooling device according to claim 1, wherein the connector further includes, a header configured to circulate refrigerants in the plurality of refrigerant pipes, and a connection film contacting the plurality of refrigerant pipes inserted into the plurality of insertion holes, and wherein the connection film is disposed on an inner circumference surfaces of the plurality of insertion holes.

3. The cooling device according to claim 1, wherein the connector includes a plurality of insertion holes, a header configured to circulate refrigerants in the plurality of refrigerant pipes, and a Flexible Printed Circuit Board (FPCB) having flexibility and including a plurality of connection holes corresponding to the plurality of insertion holes, wherein the FPCB includes a connection film contacting the plurality of refrigerant pipes inserted into the plurality of connection holes, and wherein the connection film is disposed on an inner circumference surfaces of the plurality of connection holes.

4. The cooling device according to claim 1, wherein an insulator film is formed on surfaces of the plurality of refrigerant pipes to prevent surface current from leaking out.

5. The cooling device according to claim 1, wherein consumption power of inlet side refrigerant pipes disposed close to an inlet side among the plurality of refrigerant pipes is higher than or equal to consumption power of outlet side refrigerant pipes disposed close to an outlet side among the plurality of refrigerant pipes.

6. The cooling device according to claim 5, wherein consumption power of the plurality of refrigerant pipes is reduced to predetermined consumption power levels in order from the inlet side refrigerant pipes to the outlet side refrigerant pipes.

7. The cooling device according to claim 1, wherein electric resistance values of inlet side refrigerant pipes disposed close to an inlet side among the plurality of refrigerant pipes are smaller than or equal to electric resistance values of outlet side refrigerant pipes disposed close to an outlet side among the plurality of refrigerant pipes, and wherein the electric resistance values of the plurality of refrigerant pipes increase to predetermined resistance values in order from the inlet side refrigerant pipes to the outlet side refrigerant pipes.

8. The cooling device according to claim 7, further comprising a sensor configured to sense an amount of frost formed on the plurality of refrigerant pipes, wherein provided the sensed amount of frost is smaller than a predetermined minute frost level, the power source supplies predetermined minute heating power to the plurality of refrigerant pipes, and supplies predetermined driving power to the compressor.

9. The cooling device according to claim 8, wherein provided the sensed amount of frost is smaller than the predetermined minute frost level, the power source decides a magnitude of minute heating power, a magnitude of driving power, and a supply time period, based on the sensed amount of frost, supplies the decided minute heating power to the plurality of refrigerant pipes for the decided supply time period, and supplies the decided driving power to the compressor for the decided supply time period.

10. The cooling device according to claim 1, wherein the power source supplies predetermined heating power to the plurality of refrigerant pipes for a predetermined defrost time period.

11. The cooling device according to claim 10, wherein the power source stops supplying power to the plurality of refrigerant pipes and a compressor for a delay time period.

12. The cooling device according to claim 11, wherein after a predetermined heat-exchange time period elapses, the power source supplies the predetermined heating power to the plurality of refrigerant pipes.

13. The cooling device according to claim 11, further comprising a sensor configured to sense an amount of frost formed on the plurality of refrigerant pipes, wherein provided the sensed amount of frost is greater than or equal to a predetermined value, the power source supplies the predetermined heating power to the plurality of refrigerant pipes.

14. The cooling device according to claim 13, wherein the power source decides a magnitude of heating power and a supply time period of the heating power, based on the sensed amount of frost, and supplies the decided heating power to the plurality of refrigerant pipes for the decided supply time period.

15. The cooling device according to claim 1, further comprising a switch configured to select one or more refrigerant pipes of the plurality of refrigerant pipes to which the heating power is supplied.

16. The cooling device according to claim 15, wherein the switch selects the refrigerant pipes of the plurality of refrigerant pipes such that the heating power is supplied to the selected refrigerant pipes of the plurality of refrigerant pipes, starting from inlet side refrigerant pipes disposed close to an inlet side among the selected refrigerant pipes of the plurality of refrigerant pipes, for a predetermined defrost time period.

17. The cooling device according to claim 15, further comprising a sensor configured to sense an amount of frost formed on the plurality of refrigerant pipes, wherein provided the sensed amount of frost is greater than or equal to a predetermined value, the switch connects the selected refrigerant pipes of the plurality of refrigerant pipes to the power source.

18. The cooling device according to claim 17, wherein the power source decides a magnitude of heating power and a supply time period of the heating power for each refrigerant pipe of the selected refrigerant pipes based on the sensed amount of frost, and supplies the decided heating power to each refrigerant pipe of the selected refrigerant pipes for the decided supply time period.

19. A method of controlling a cooling device, the method including:

supplying predetermined heating power to a plurality of refrigerant pipes formed of a polymer material, from a power source through a connector disposed at opposite longitudinal ends of each of the plurality of refrigerant pipes, the predetermined heating power being supplied to the plurality of refrigerant pipes for a defrost time period for self-heating of the plurality of refrigerant pipes; and stopping supplying power to the plurality of refrigerant pipes and a compressor for a delay time period, wherein the connector mechanically positions the plurality of refrigerant pipes relative to each other and electrically connects the plurality of refrigerant pipes to the power source.

* * * * *